US012448172B2

(12) United States Patent
Apps et al.

(10) Patent No.: US 12,448,172 B2
(45) Date of Patent: Oct. 21, 2025

(54) COLLAPSIBLE CONTAINER

(71) Applicant: Rehrig Pacific Company, Los Angeles, CA (US)

(72) Inventors: William P. Apps, Alpharetta, GA (US); Derick Foster, Cumming, GA (US)

(73) Assignee: Rehrig Pacific Company, Monterey Park, CA (US)

( * ) Notice: Subject to any disclaimer, the term of this patent is extended or adjusted under 35 U.S.C. 154(b) by 1348 days.

(21) Appl. No.: 16/293,510

(22) Filed: Mar. 5, 2019

(65) Prior Publication Data

US 2019/0270545 A1 Sep. 5, 2019

Related U.S. Application Data

(60) Provisional application No. 62/782,326, filed on Dec. 19, 2018, provisional application No. 62/723,691, filed on Aug. 28, 2018, provisional application No. 62/638,950, filed on Mar. 5, 2018.

(51) Int. Cl.

| | |
|---|---|
| ***B65D 19/18*** | (2006.01) |
| ***B65D 6/00*** | (2006.01) |
| ***B65D 6/18*** | (2006.01) |
| ***B65D 21/08*** | (2006.01) |
| ***B65D 25/20*** | (2006.01) |

(52) U.S. Cl.

CPC ..... *B65D 11/1806* (2013.01); *B65D 11/10* (2013.01); *B65D 19/18* (2013.01); *B65D 21/086* (2013.01); *B65D 25/20* (2013.01); *B65D 2519/00273* (2013.01); *B65D 2519/00502* (2013.01); *B65D 2519/009* (2013.01)

(58) Field of Classification Search

CPC .... B65D 11/10; B65D 11/1806; B65D 19/18; B65D 21/086; B65D 25/20; B65D 2519/00273

USPC ..... 206/600; 220/6, 7, 4.28, 4.29, 4.33

See application file for complete search history.

(56) References Cited

U.S. PATENT DOCUMENTS

| | | | |
|---|---|---|---|
| 625,678 | A | 5/1899 | Hilzheim |
| 826,600 | A | 7/1906 | Oakman |
| 882,184 | A | 3/1908 | Donaldson et al. |
| 1,028,933 | A | 6/1912 | Compton |

(Continued)

FOREIGN PATENT DOCUMENTS

| | | | |
|---|---|---|---|
| DE | 2020581 | A1 | 11/1971 |
| DE | 10345285 | A1 | 4/2005 |

(Continued)

OTHER PUBLICATIONS

U.S. Appl. No. 16/293,510.

(Continued)

*Primary Examiner* — Jacob K Ackun

(74) *Attorney, Agent, or Firm* — Carlson, Gaskey & Olds, P.C,

(57) ABSTRACT

In one embodiment, a container includes a base and a lower wall section extending upward from the base. One or more upper wall sections are stacked on the first wall section. A pair of flanges may extend perpendicularly from outer edges of the lower wall section and the upper wall sections. An upper door may be hingeably connected to one of the flanges of the second wall section. A lower door may be hingeably connected to one of the flanges of the lower wall section.

16 Claims, 53 Drawing Sheets

(56) References Cited

U.S. PATENT DOCUMENTS 1,330,338 A 2/1920 Peavy
1,389,199 A 8/1921 Leonard
1,407,054 A 2/1922 Farley
1,443,901 A 1/1923 Murray
1,554,161 A 9/1925 Hubbard
1,611,629 A 12/1926 Artas
1,671,051 A 5/1928 Soderquist
1,809,523 A 6/1931 McLean
1,869,071 A 7/1932 McLean
1,980,482 A 11/1934 Golden
2,200,699 A 5/1940 McNulty
2,462,693 A 2/1949 Wabshaw
2,497,453 A 2/1950 Hazen
2,542,920 A * 2/1951 Gardner ..... F23G 5/42 220/7
2,667,398 A 1/1954 Claflin
2,714,466 A 8/1955 Killeen
2,731,761 A 1/1956 Marshall
2,759,622 A 8/1956 Simmons et al.
2,760,669 A 8/1956 Kreutzer
2,780,381 A 2/1957 Coit, Jr.
2,785,822 A 3/1957 Kus
2,793,780 A 5/1957 Walklet et al.
2,847,794 A 8/1958 Loud et al.
2,868,406 A 1/1959 Kookogey
3,000,049 A 9/1961 Terry, Jr.
3,048,147 A 8/1962 McKean
3,095,965 A 7/1963 Stahl et al.
3,122,127 A 2/1964 Shechmeister et al.
3,130,850 A 4/1964 Oakley et al.
3,220,603 A 11/1965 Bromley
3,311,254 A 3/1967 Beh
3,360,180 A 12/1967 Venturi
3,372,829 A 3/1968 Averill
3,398,850 A 8/1968 Kennard
3,446,145 A 5/1969 Weeks et al.
3,446,415 A 5/1969 Bromley
3,497,127 A 2/1970 Box
3,516,592 A 6/1970 Friedrich
3,591,212 A 7/1971 Rhyne et al.
3,747,794 A 7/1973 Bitney
3,752,349 A * 8/1973 Rana ..... B65D 7/26 217/14
3,770,186 A 11/1973 Kupersmit
3,782,579 A 1/1974 Zarges
3,796,342 A 3/1974 Sanders et al.
3,804,033 A 4/1974 Izawa et al.
3,814,220 A 6/1974 Brody
3,821,861 A 7/1974 Jalbert
3,835,792 A 9/1974 Wharton
3,853,238 A 12/1974 Luisada et al.
3,870,185 A 3/1975 Sanders et al.
3,874,546 A 4/1975 Sanders et al.
3,941,271 A 3/1976 Zarges et al.
3,955,703 A 5/1976 Zebarth
3,966,285 A * 6/1976 Porch ..... B65D 7/24 312/263
3,970,209 A 7/1976 Baxter
3,973,692 A 8/1976 Cloyd
3,981,410 A 9/1976 Schurch
4,005,795 A 2/1977 Mikkelsen et al.
4,030,232 A 6/1977 Niva
4,030,600 A 6/1977 Heaps
4,043,476 A 8/1977 Joseph
4,044,910 A * 8/1977 Box ..... B65D 11/1833 220/7
4,062,467 A 12/1977 Friedrich
4,081,099 A 3/1978 Shead
4,109,791 A 8/1978 Clipson et al.
4,120,417 A 10/1978 Aquino
4,148,407 A 4/1979 Sinclair
4,159,591 A 7/1979 Plante
4,163,495 A 8/1979 Drader
4,170,313 A 10/1979 Caves et al.
4,181,236 A 1/1980 Prodel
4,186,841 A 2/1980 Buckley et al.
4,192,430 A 3/1980 Cornou
4,235,345 A 11/1980 VandeDrink et al.
4,241,831 A 12/1980 Locatelli
4,300,695 A 11/1981 Hsu
4,314,686 A 2/1982 Marz
4,320,845 A 3/1982 Waller
4,342,393 A 8/1982 Box
4,391,369 A 7/1983 Stahl et al.
4,406,380 A 9/1983 Paige
4,417,686 A 11/1983 Wozniacki
4,423,813 A 1/1984 Kreeger et al.
4,591,065 A 5/1986 Foy
4,648,199 A 3/1987 Deaton et al.
4,648,200 A 3/1987 Miller et al.
4,662,532 A 5/1987 Anderson et al.
4,663,803 A 5/1987 Gora
4,674,647 A 6/1987 Gyenge et al.
4,676,534 A 6/1987 Hix, Jr.
4,693,386 A 9/1987 Hughes et al.
4,720,020 A 1/1988 Su
4,726,486 A 2/1988 Masuda
4,735,330 A 4/1988 Hoss
4,735,331 A 4/1988 Keenan et al.
4,759,149 A 7/1988 Dunn
4,775,068 A 10/1988 Reiland et al.
4,781,300 A 11/1988 Long
4,798,304 A 1/1989 Rader
4,807,774 A 2/1989 Karpisek
4,820,383 A 4/1989 Shchamorov et al.
4,846,089 A 7/1989 Cedergreen
4,848,578 A 7/1989 Schafer
4,863,062 A 9/1989 Holliday
4,887,747 A 12/1989 Ostrowsky et al.
4,887,874 A 12/1989 Joffe
4,909,188 A 3/1990 Tominaga
4,917,255 A * 4/1990 Foy ..... B65D 25/005 220/6
4,923,079 A 5/1990 Foy
4,953,735 A 9/1990 Tisbo et al.
4,960,223 A 10/1990 Chiang et al.
4,967,927 A 11/1990 Reiland et al.
5,016,772 A 5/1991 Wilk
5,022,529 A 6/1991 Kang
5,038,953 A 8/1991 Radar
5,048,715 A 9/1991 Wolff
5,076,457 A 12/1991 Marovskis
5,092,270 A 3/1992 Simons et al.
5,094,356 A 3/1992 Miller
5,109,980 A 5/1992 Matsuoka et al.
5,114,037 A 5/1992 Hillis et al.
5,161,709 A 11/1992 Oestreich, Jr.
5,199,592 A 4/1993 Reiland et al.
5,289,935 A 3/1994 Hillis et al.
5,331,763 A 7/1994 Miller
5,398,834 A 3/1995 Umiker
5,398,835 A 3/1995 Blinstrub
5,429,261 A 7/1995 Machino
5,467,885 A 11/1995 Blinstrub
5,474,197 A 12/1995 Hillis et al.
5,501,354 A 3/1996 Stromberg
5,515,987 A 5/1996 Jacques et al.
5,538,153 A 7/1996 Marovskis et al.
5,544,935 A * 8/1996 Cone, II ..... A47D 13/02 297/183.2
5,558,241 A 9/1996 Huffstutler, Jr. et al.
5,562,224 A 10/1996 Pascal et al.
5,564,599 A 10/1996 Barber et al.
5,586,675 A 12/1996 Borsboom et al.
5,588,549 A 12/1996 Furtner
5,595,305 A 1/1997 Hart
5,622,276 A 4/1997 Simmons
5,632,114 A 5/1997 McKenzie
5,632,392 A 5/1997 Oh
5,660,291 A 8/1997 Dash
5,671,857 A 9/1997 Stromberg
5,699,926 A 12/1997 Jacques et al.
5,720,405 A 2/1998 Karpisek
5,746,342 A 5/1998 Jacques et al.

(56) References Cited

U.S. PATENT DOCUMENTS 5,788,103 A 8/1998 Wagner et al.
5,797,508 A 8/1998 Loftus et al.
5,829,595 A 11/1998 Brown et al.
5,829,617 A 11/1998 Umiker
5,853,099 A 12/1998 Lessard
5,904,262 A * 5/1999 Coppi ..... B65D 88/524 220/666
5,918,743 A 7/1999 Uitz
5,938,059 A 8/1999 Luburic
5,950,546 A 9/1999 Brown et al.
5,967,356 A 10/1999 Laarhoven et al.
5,975,324 A 11/1999 Schmitt
5,988,420 A 11/1999 Jacques et al.
6,015,056 A 1/2000 Overholt et al.
6,029,840 A 2/2000 Brauner
D423,217 S 4/2000 Varfeldt
D424,299 S 5/2000 Varfeldt
6,056,177 A 5/2000 Schneider
6,073,790 A 6/2000 Umiker
6,082,570 A 7/2000 Tai
6,098,827 A 8/2000 Overholt et al.
6,131,757 A 10/2000 Clark et al.
6,138,851 A 10/2000 Townson
6,142,329 A 11/2000 Dotan
6,170,689 B1 1/2001 Flesher et al.
6,189,695 B1 2/2001 Ching-rong
6,209,742 B1 4/2001 Overholt et al.
6,267,079 B1 7/2001 Eby
6,283,319 B1 9/2001 Hillis et al.
6,286,701 B1 9/2001 Umiker
6,290,081 B1 9/2001 Merey
6,293,417 B1 9/2001 Varfeldt
6,293,418 B1 9/2001 Ogden et al.
6,305,566 B1 10/2001 Pigott et al.
D452,614 S 1/2002 Overholt
6,386,388 B1 5/2002 Overholt
D458,753 S 6/2002 Overholt et al.
6,398,054 B1 6/2002 Overholt et al.
6,401,953 B2 6/2002 Kofod
6,405,888 B1 6/2002 Overholt et al.
6,409,041 B1 6/2002 Overholt et al.
6,415,938 B1 7/2002 Karpisek
6,446,825 B1 9/2002 Godoy
6,460,717 B1 10/2002 Smyers et al.
D466,392 S 12/2002 Halajko
6,488,168 B1 12/2002 Wang
6,601,724 B1 8/2003 Koefelda et al.
6,607,514 B2 * 8/2003 Reese ..... B32B 5/00 604/289
6,623,059 B2 9/2003 Gehring et al.
6,631,822 B1 10/2003 Overholt
6,669,044 B2 12/2003 Murakami et al.
6,691,885 B2 2/2004 Brown
6,702,135 B2 3/2004 Pickler
6,722,516 B1 4/2004 Zelko
6,772,897 B2 8/2004 Kellerer et al.
6,820,761 B1 11/2004 Mouri et al.
6,863,180 B2 3/2005 Apps et al.
6,868,979 B2 * 3/2005 Rader ..... B65D 11/184 220/4.28
6,899,242 B2 5/2005 Overholt et al.
6,918,502 B1 * 7/2005 Overholt ..... A45C 7/0036 220/6
6,981,605 B2 1/2006 Kasuya et al.
7,011,225 B2 3/2006 Oster et al.
7,017,765 B2 3/2006 Overholt
7,017,766 B2 3/2006 Hsu et al.
7,044,319 B2 5/2006 Overholt et al.
7,048,134 B1 5/2006 Hagan
7,059,489 B2 6/2006 Apps et al.
7,086,555 B2 8/2006 Overholt et al.
7,100,786 B2 9/2006 Smyers
7,104,414 B2 9/2006 Apps et al.
7,128,231 B2 10/2006 Overholt
7,159,730 B2 * 1/2007 Rumpel ..... B65D 11/1833 220/23.6
7,195,127 B2 * 3/2007 Hsu ..... B65D 11/1833 220/6
7,195,128 B2 3/2007 Murakami et al.
7,264,122 B2 * 9/2007 Koefelda ..... B65D 11/1833 206/600
7,267,227 B2 9/2007 Dubois et al.
7,281,637 B2 10/2007 Hadar
7,331,480 B1 2/2008 Nolan
7,353,962 B2 4/2008 Parnall et al.
7,357,269 B2 4/2008 Apps
7,438,197 B2 10/2008 Yamauchi
7,484,634 B2 2/2009 Apps
7,533,486 B2 5/2009 Ribeiro De Matos
7,549,550 B2 6/2009 Smyers et al.
7,556,166 B2 7/2009 Parnall et al.
7,607,542 B1 10/2009 Hsieh
7,641,066 B2 1/2010 Baltz
7,694,836 B2 4/2010 Overholt et al.
7,717,283 B2 5/2010 Apps et al.
7,726,502 B2 6/2010 Apps
7,740,146 B2 6/2010 Cavalcante et al.
7,753,222 B1 * 7/2010 Heinrichs ..... B65D 21/0209 220/4.28
7,823,728 B2 11/2010 Baltz
D628,801 S 12/2010 Talbot Pouliot et al.
7,896,184 B2 3/2011 Meers
8,050,000 B2 11/2011 Wright et al.
8,056,723 B2 11/2011 Cavalcante
8,066,147 B2 11/2011 Meers et al.
8,091,706 B2 1/2012 Koefelda
8,261,924 B2 * 9/2012 Karpisek ..... B65D 88/522 220/4.28
8,348,076 B2 * 1/2013 Rader ..... B65D 11/184 229/175
8,561,836 B2 10/2013 Cook
8,844,753 B2 * 9/2014 Starnes ..... B65D 19/18 220/531
8,955,709 B2 * 2/2015 Lorenz ..... B65D 21/083 220/621
9,278,775 B2 3/2016 Meers et al.
10,118,727 B2 * 11/2018 Wilcox ..... B65D 25/54
10,273,052 B2 * 4/2019 Wilcox ..... B65D 85/34
2002/0070215 A1 6/2002 Walsh et al.
2002/0092850 A1 7/2002 Iwahara et al.
2002/0108950 A1 8/2002 Moorman et al.
2002/0148842 A1 10/2002 Overholt et al.
2002/0158067 A1 10/2002 Overholt et al.
2003/0000950 A1 1/2003 Murakami et al.
2003/0080024 A1 * 5/2003 Vourganas ..... B65D 19/18 206/600
2003/0116564 A1 6/2003 Overholt et al.
2003/0132228 A1 7/2003 Apps et al.
2003/0136781 A1 7/2003 Rumpel
2003/0155275 A1 * 8/2003 Apps ..... B65D 11/1833 206/600
2003/0222080 A1 12/2003 Fulton et al.
2003/0222081 A1 12/2003 Apps et al.
2004/0020821 A1 * 2/2004 Koefelda ..... B65D 11/1833 206/600
2004/0069780 A1 4/2004 Apps et al.
2004/0099662 A1 5/2004 Overholt
2004/0104231 A1 6/2004 Hassell et al.
2004/0129700 A1 7/2004 Oster et al.
2004/0159659 A1 8/2004 Rumpel
2004/0178197 A1 9/2004 Hsu et al.
2004/0182858 A1 9/2004 Smyers
2004/0200833 A1 10/2004 Dubois et al.
2004/0226945 A1 11/2004 Hsu et al.
2004/0256385 A1 12/2004 Hartwall
2005/0040166 A1 2/2005 Nolet et al.
2005/0098556 A1 5/2005 Kellerer
2005/0121447 A1 6/2005 Barth
2005/0150892 A1 * 7/2005 Miller ..... B65D 19/18 220/324
2005/0155967 A1 7/2005 Vial
2005/0194382 A1 9/2005 B.

(56) References Cited

U.S. PATENT DOCUMENTS

| | | | | |
|---|---|---|---|---|
| 2006/0011627 | A1 | 1/2006 | Overholt et al. | |
| 2006/0181101 | A1 | 8/2006 | Reynolds et al. | |
| 2006/0231555 | A1 | 10/2006 | Smyers et al. | |
| 2006/0237341 | A1 | 10/2006 | McDade | |
| 2006/0260976 | A1* | 11/2006 | Apps | B65D 19/18 206/600 |
| 2007/0056967 | A1* | 3/2007 | Dobrinski | B65D 11/1826 220/6 |
| 2007/0075077 | A1* | 4/2007 | Dubois | B65D 19/40 220/1.5 |
| 2007/0095842 | A1 | 5/2007 | Apps | |
| 2007/0125779 | A1 | 6/2007 | Cope | |
| 2007/0158345 | A1 | 7/2007 | Booth et al. | |
| 2007/0187276 | A1 | 8/2007 | Stahl | |
| 2007/0194023 | A1 | 8/2007 | Apps et al. | |
| 2008/0142399 | A1 | 6/2008 | Apps | |
| 2008/0142530 | A1 | 6/2008 | Meers et al. | |
| 2008/0169285 | A1 | 7/2008 | Marazita et al. | |
| 2008/0179322 | A1* | 7/2008 | Parnall | B65D 11/1833 220/6 |
| 2008/0296308 | A1 | 12/2008 | Barbalho et al. | |
| 2008/0302791 | A1 | 12/2008 | Baltz | |
| 2009/0014445 | A1 | 1/2009 | Hay et al. | |
| 2009/0057320 | A1 | 3/2009 | Meers et al. | |
| 2009/0078701 | A1 | 3/2009 | Cavalcante | |
| 2009/0084783 | A1 | 4/2009 | Apps | |
| 2009/0134057 | A1* | 5/2009 | Hidalgo Vargas | B65D 11/1833 206/600 |
| 2009/0134157 | A1 | 5/2009 | Meers | |
| 2009/0151226 | A1 | 6/2009 | Apps et al. | |
| 2009/0159593 | A1 | 6/2009 | Apps | |
| 2009/0223953 | A1 | 9/2009 | Cavalcante | |
| 2009/0308866 | A1* | 12/2009 | Elvin-Jensen | B65D 11/26 220/6 |
| 2010/0025398 | A1* | 2/2010 | Krohn | B65D 88/12 220/7 |
| 2010/0065558 | A1 | 3/2010 | Cavalcante et al. | |
| 2010/0072199 | A1 | 3/2010 | Manuel | |
| 2011/0180533 | A1* | 7/2011 | Hay | B65F 1/02 220/4.28 |
| 2011/0215105 | A1* | 9/2011 | Dubois | B65D 11/18 220/682 |
| 2011/0220643 | A1* | 9/2011 | Van Der Korput | B65D 19/06 220/6 |
| 2011/0240639 | A1* | 10/2011 | Nolan | B65D 21/068 220/6 |
| 2011/0290811 | A1 | 12/2011 | Koefelda et al. | |
| 2012/0037647 | A1 | 2/2012 | Cook | |
| 2012/0111859 | A1 | 5/2012 | Pils et al. | |
| 2012/0285951 | A1 | 11/2012 | Cavalcante | |
| 2013/0193137 | A1* | 8/2013 | Nolan | B65D 88/522 220/7 |
| 2013/0193153 | A1 | 8/2013 | Baltz et al. | |
| 2016/0185487 | A1 | 6/2016 | Meers et al. | |
| 2019/0270545 | A1 | 9/2019 | Apps et al. | |

FOREIGN PATENT DOCUMENTS

| | | | |
|---|---|---|---|
| DE | 202007015378 | U1 | 2/2008 |
| EP | 0071467 | A2 | 2/1983 |
| EP | 0073357 | A2 | 3/1983 |
| EP | 0127414 | A2 | 12/1984 |
| EP | 0178211 | A1 | 4/1986 |
| EP | 0211116 | A2 | 2/1987 |
| EP | 0404041 | A1 | 12/1990 |
| EP | 0485672 | A1 | 5/1992 |
| EP | 0690003 | A1 | 1/1996 |
| EP | 0785142 | A1 | 7/1997 |
| EP | 0962394 | A1 | 12/1999 |
| EP | 0962396 | A1 | 12/1999 |
| EP | 1114779 | A2 | 7/2001 |
| EP | 1160169 | A2 | 12/2001 |
| EP | 1225131 | A1 | 7/2002 |
| EP | 1241105 | A1 | 9/2002 |
| GB | 1018243 | A | 3/1966 |
| GB | 2068338 | A | 8/1981 |
| GB | 2139189 | A | 11/1984 |
| GB | 2141778 | A | 1/1985 |
| GB | 2337985 | A | 12/1999 |
| GB | 2357078 | A | 6/2001 |
| GB | 2360726 | A | 10/2001 |
| GB | 2449502 | A | 11/2008 |
| WO | 8601182 | A1 | 2/1986 |
| WO | 9014295 | A1 | 11/1990 |
| WO | 9324378 | A1 | 12/1993 |
| WO | 9521773 | A1 | 8/1995 |
| WO | 9715502 | A1 | 5/1997 |
| WO | 9726190 | A2 | 7/1997 |
| WO | 9749613 | A1 | 12/1997 |
| WO | 9840199 | A1 | 9/1998 |
| WO | 0027716 | A1 | 5/2000 |
| WO | 0048929 | A1 | 8/2000 |
| WO | 0066440 | A1 | 11/2000 |
| WO | 0234630 | A1 | 5/2002 |
| WO | 03008275 | A2 | 1/2003 |
| WO | 03015513 | A1 | 2/2003 |
| WO | 03078259 | A1 | 9/2003 |
| WO | 03101846 | A1 | 12/2003 |
| WO | 2006010311 | A1 | 2/2006 |
| WO | 2008145977 | A1 | 12/2008 |
| WO | 2010151509 | A1 | 12/2010 |
| WO | 2011006654 | A1 | 1/2011 |

OTHER PUBLICATIONS

U.S. Appl. No. 12/901,606.
U.S. Appl. No. 12/564,966.
U.S. Appl. No. 11/131,772.
U.S. Appl. No. 12/328,254.

* cited by examiner

COLLAPSIBLE CONTAINER

BACKGROUND

Collapsible pallet bins include a pallet base, with supports or columns creating space for fork tines to lift the pallet bin. Walls extend upward from the pallet base to define a bin interior. Latches connect adjacent walls and can be selectively released to collapse the walls onto the pallet base when empty. The pallet bin may include a small door on one or two of the walls for providing some access to the bin interior.

SUMMARY

A container includes a base and a lower wall section extending upward from the base. One or more upper wall sections are stacked on the first wall section. A pair of flanges may extend perpendicularly from outer edges of the lower wall section and the upper wall sections. An upper door may be hingeably connected to one of the flanges of the second wall section. A lower door may be hingeably connected to one of the flanges of the lower wall section.

A second lower wall section may extend upward from the base, opposite the first lower wall section, with a second upper wall section stacked on the second lower wall section. Latches selectively connect the upper door to the second upper wall section and the lower door to the second lower wall section.

In one embodiment, the pair of flanges of the first upper wall section are hingeably connected to the pair of flanges of the first lower wall section, such that the first upper wall section can be pivoted downward to a position between the first lower wall section and the second lower wall section.

Optionally, the base may include a pair of recessed wheels. The pair of recessed wheels are recessed upward relative to a lowermost surface of the base. The container can roll on the wheels when the container is tilted toward the wheels slightly. Alternatively, a jack may be configured to raise and lower the pair of wheels relative to the lowermost surface of the base.

Alternatively, a jack on the pallet assembly is movable between a stowed position, recessed upward relative to the pair of wheels, and a deployed position in which the jack is lower than the pair of wheels.

A latch assembly may selectively connect the upper wall sections to one another and to the lower wall section.

An underside of the base includes a plurality of uninterrupted troughs extending through the base.

In another embodiment, a container includes a pallet base and a plurality of walls pivotably connected to the base. A first wall includes a frame portion pivotably connected to the base. The frame portion includes a lower portion pivotably connected to the base and an upstanding portion extending upward from each of a pair of opposite ends of the lower portion. A door is hingeably connected to the frame.

A second door may also be hingeably connected to the frame, with a latch selectively connecting the first door to the second door.

The first door may include a round center opening having a handle extending thereacross.

As another optional feature disclosed herein, a rail includes an elongated housing having a pair of opposed side walls. A plurality of axles are mounted to the pair of side walls. A plurality of wheels are supported on the plurality of axles, such that the wheels can rotate relative to the elongated housing and such that the wheels project above an uppermost surface of the elongated housing. The plurality of axles may be press fit into the elongated housing.

Each of the opposed side walls of the elongated housing may include an inner wall and an outer wall. The inner walls include a plurality of spaced-apart recesses opening upward. The axles are received in the recesses in the inner walls. A plurality of handle recesses may be formed in the outer walls of the side walls of the elongated housing.

A plurality of identical rails may be connected series and spaced apart from another plurality of identical rails in series. A pallet (optionally a pallet bin) can be supported on the wheels of the rails and easily moved from location to location.

DETAILED DESCRIPTION

Figure 1:
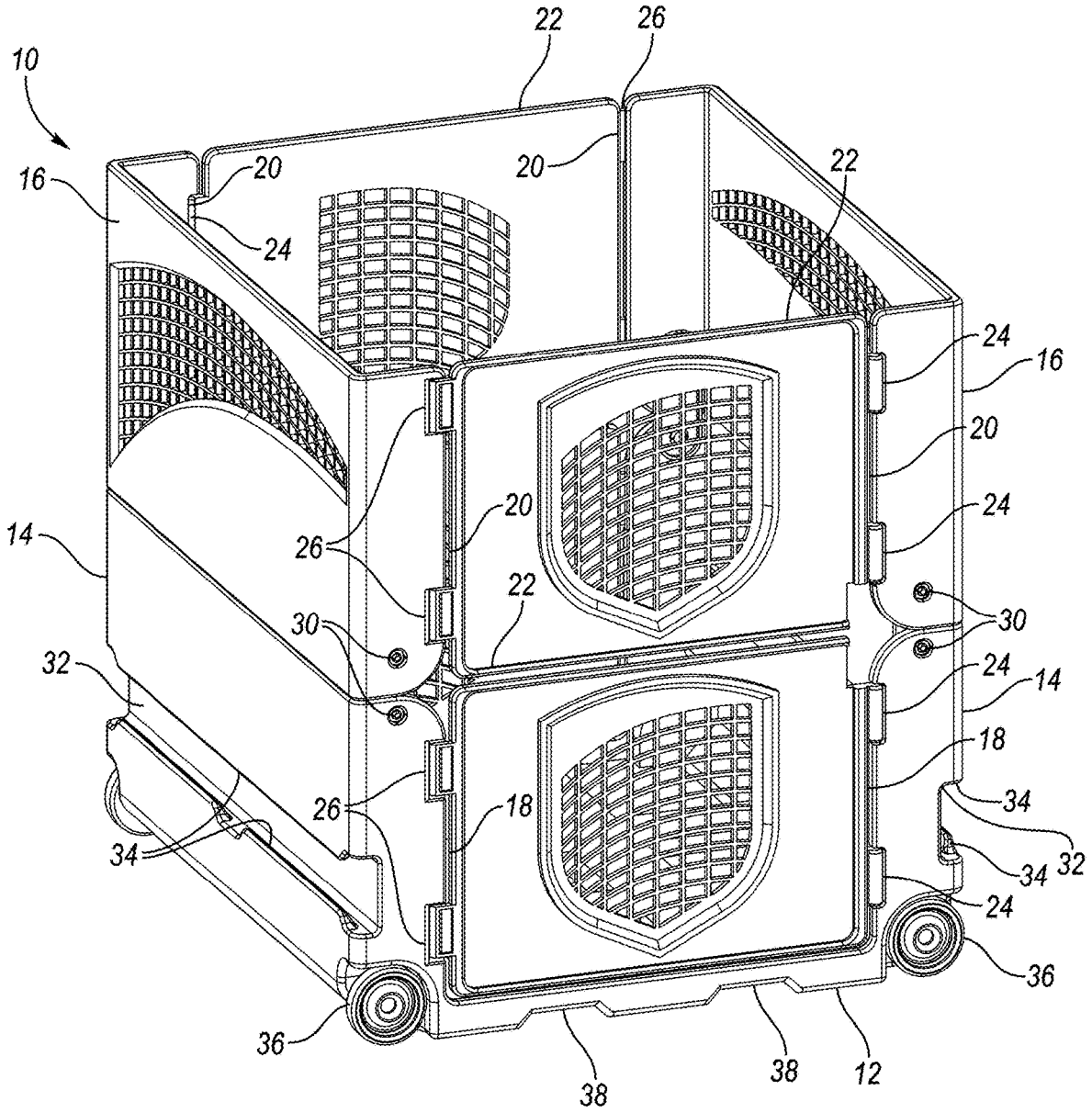
FIG. 1 is a perspective view of a collapsible container according to a first embodiment.

A collapsible container 10 according to a first embodiment is shown in FIGS. 1-11. Referring to FIG. 1, the collapsible container 10 is a collapsible bin. The collapsible container 10 includes a base 12 having integrally molded upstanding lower side walls 14 and hingeably connected upper side walls 16, hingeably connected at upper ends of the lower side walls 14. Integral flanges 20 protrude inward from outer edges of the lower side walls 14 and upper side walls 16. The flanges 20 on the upper side walls 16 are rounded at their lower inner corners, while the flanges 20 on the lower side walls 14 are rounded at the upper inner corners. Doors 22 are hingeably connected between each pair of opposed flanges 20. Each door 22 is connected by hinges 24 to one side wall 14 and selectively secured by latches 26 to the other side wall 14, such that each side wall 14 has one of the doors 22 connected to it by hinges 24. The upper side walls 16 are hingeably connected to the lower side walls 14 by double hinges 30.

Side pockets or channels 32 are formed on outer surfaces of the lower side walls 14. The channels 32 extend generally horizontally or generally parallel to the base 12 and open toward the exterior of the container 10. The channels 32 include lips 34 protruding toward one another across the opening to the channels 32. The channels 32 are configured to receive special tines for lifting and inverting the container 10. Rotatable support wheels 36 are mounted at opposite sides of the base 12. Recesses 38 on the lower surface of the base 12 can receive traditional fork tines.

Figure 3:
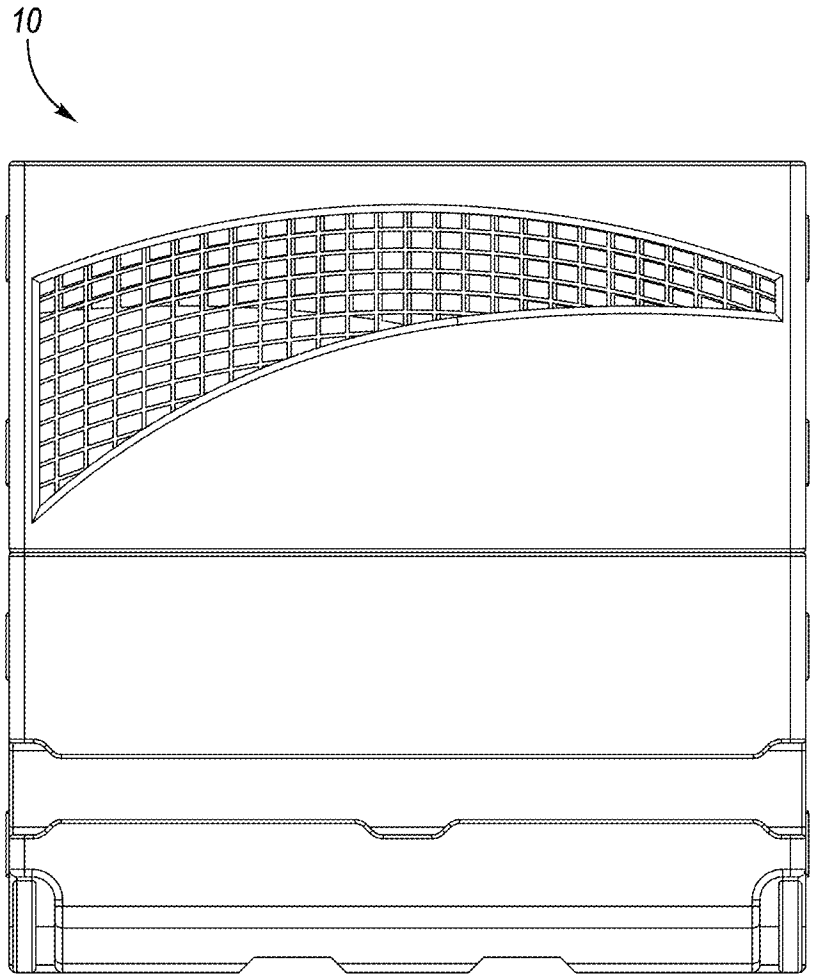
FIG. 3 is a side view of the container of FIG. 1.
Figure 2:
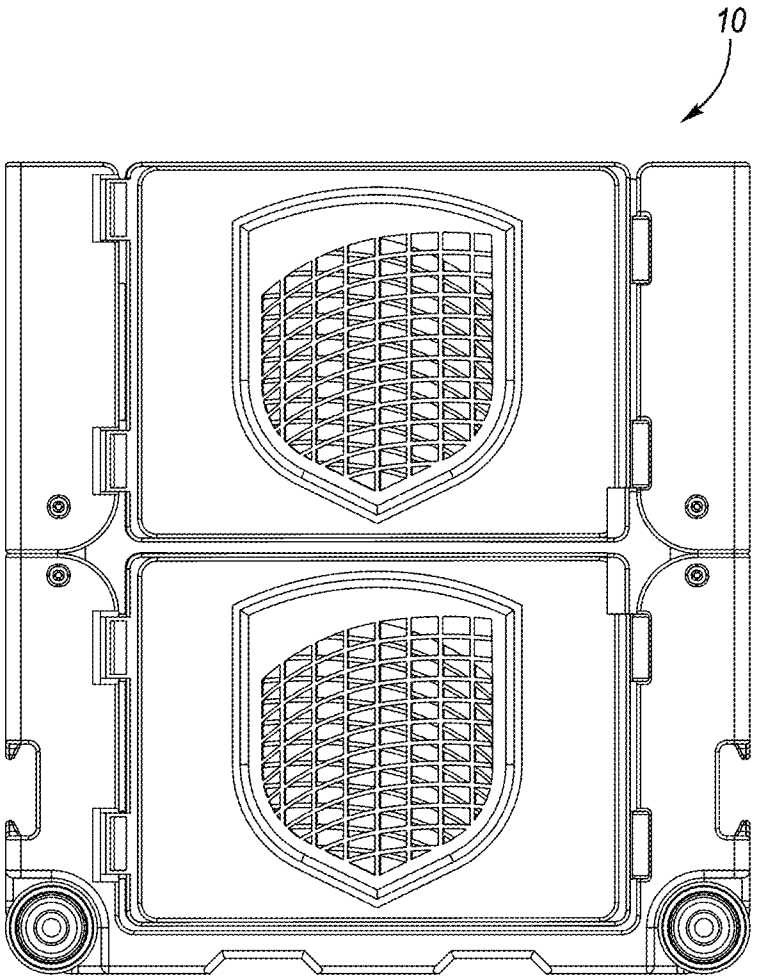
FIG. 2 is a front view of the container of FIG. 1.

FIG. 2 is a front view of the container 10. FIG. 3 is a side view of the container 10.

Figure 4:
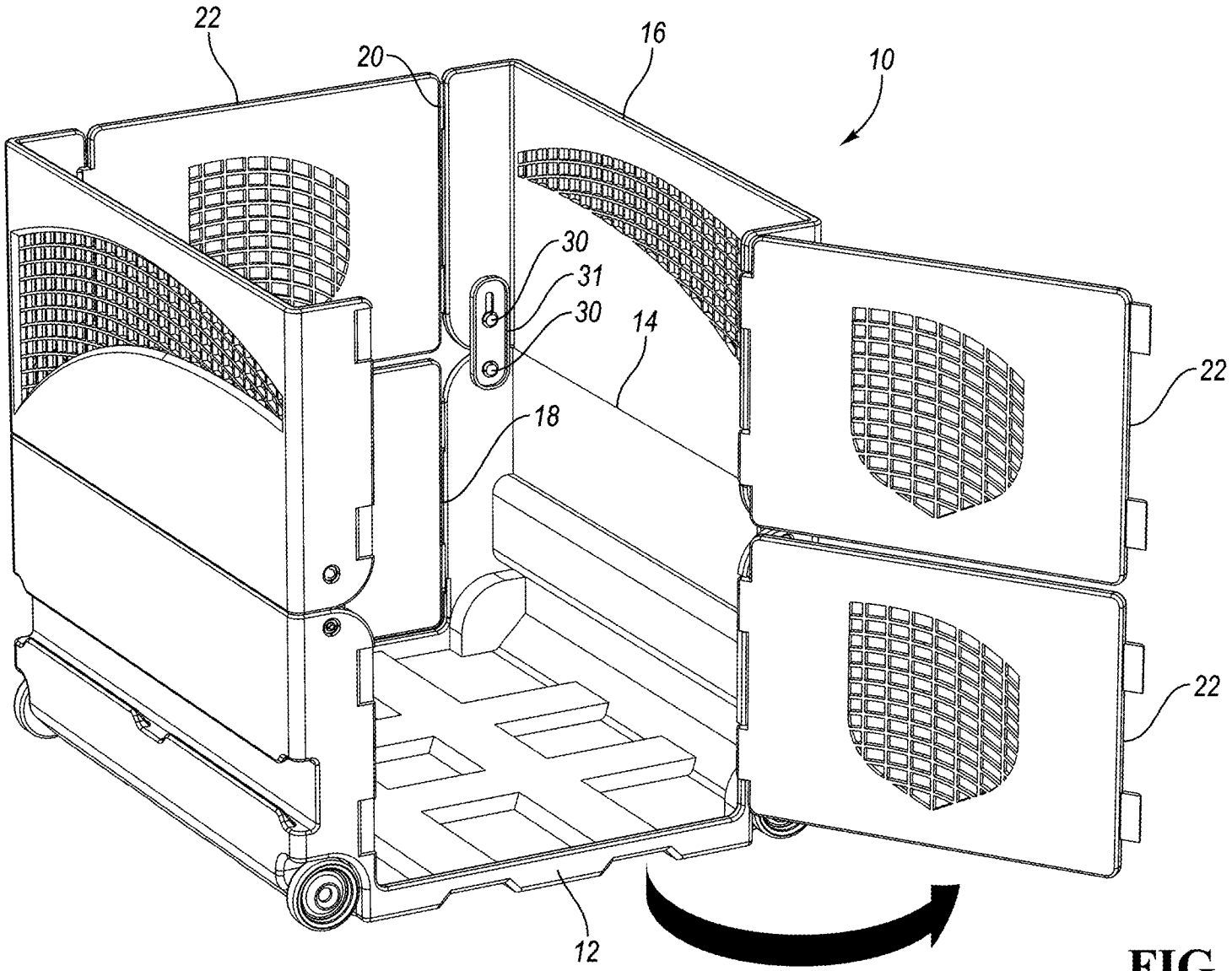
FIG. 4 is a perspective view of the container of FIG. 1 with one set of doors open.

FIG. 4 shows the container 10 with one set of the doors 22 open to permit loading or unloading of the container 10. As can be seen in FIG. 4, the hinge pins 30 together with bracket 31 provide a double-hinge connecting between the upper side walls 16 and the lower side walls 14.

Figure 5:
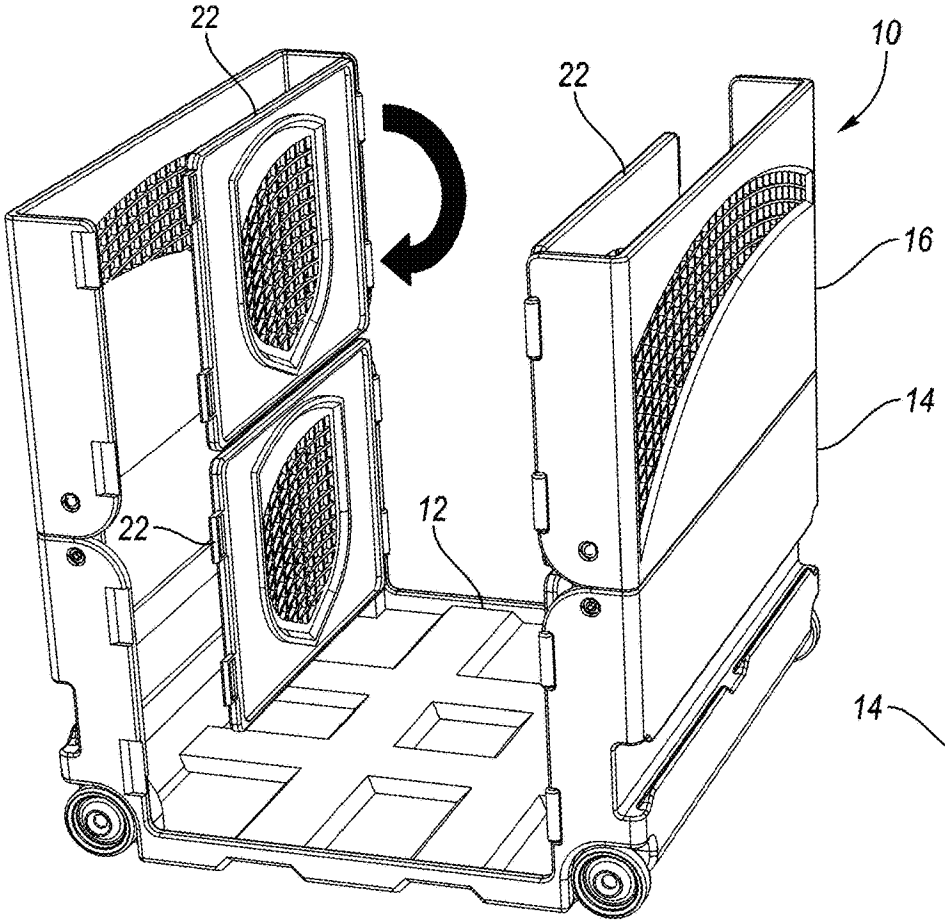
FIG. 5 shows the container of FIG. 1 with both sets of doors pivoted inward.

Referring to FIG. 5, to collapse the container 10 when empty, the doors 22 can be folded inward to a position generally parallel to the upper side walls 16 and lower side walls 14. One upper door 22 is folded toward one upper side wall 16, and the other upper door 22 is folded toward the other upper side wall 16. One lower door 22 is folded toward one lower side wall 14, and the other lower door 22 is folded toward the other lower side wall 14.

Figure 6:
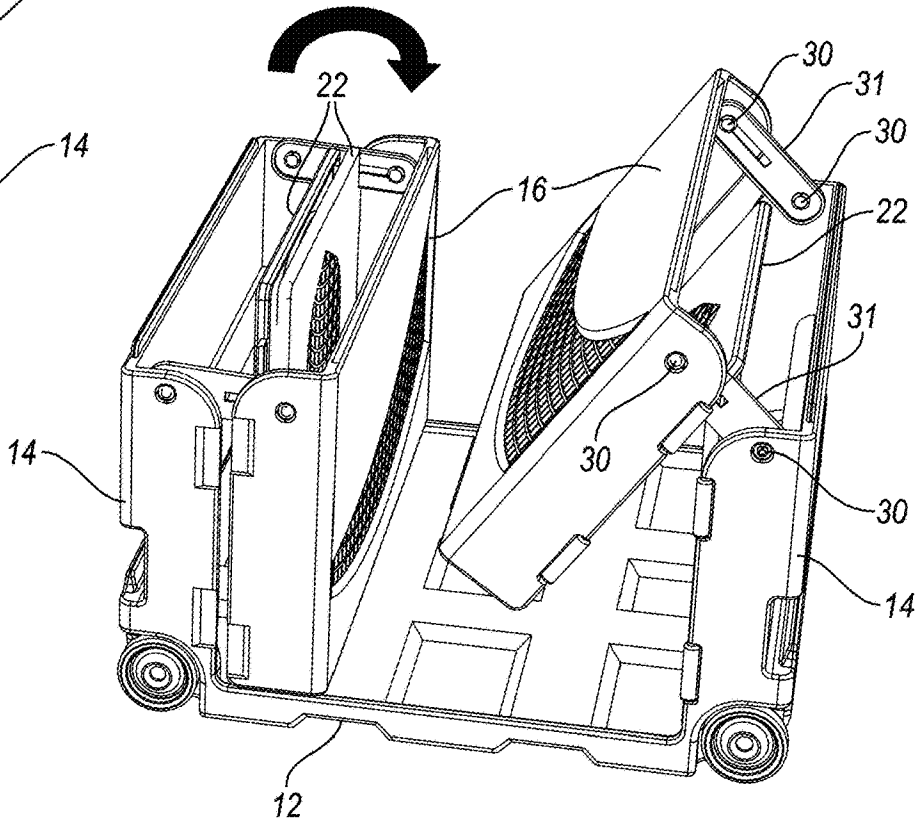
FIG. 6 shows the container of FIG. 5 with the upper side walls pivoted downward between the lower side walls.
Figure 7:
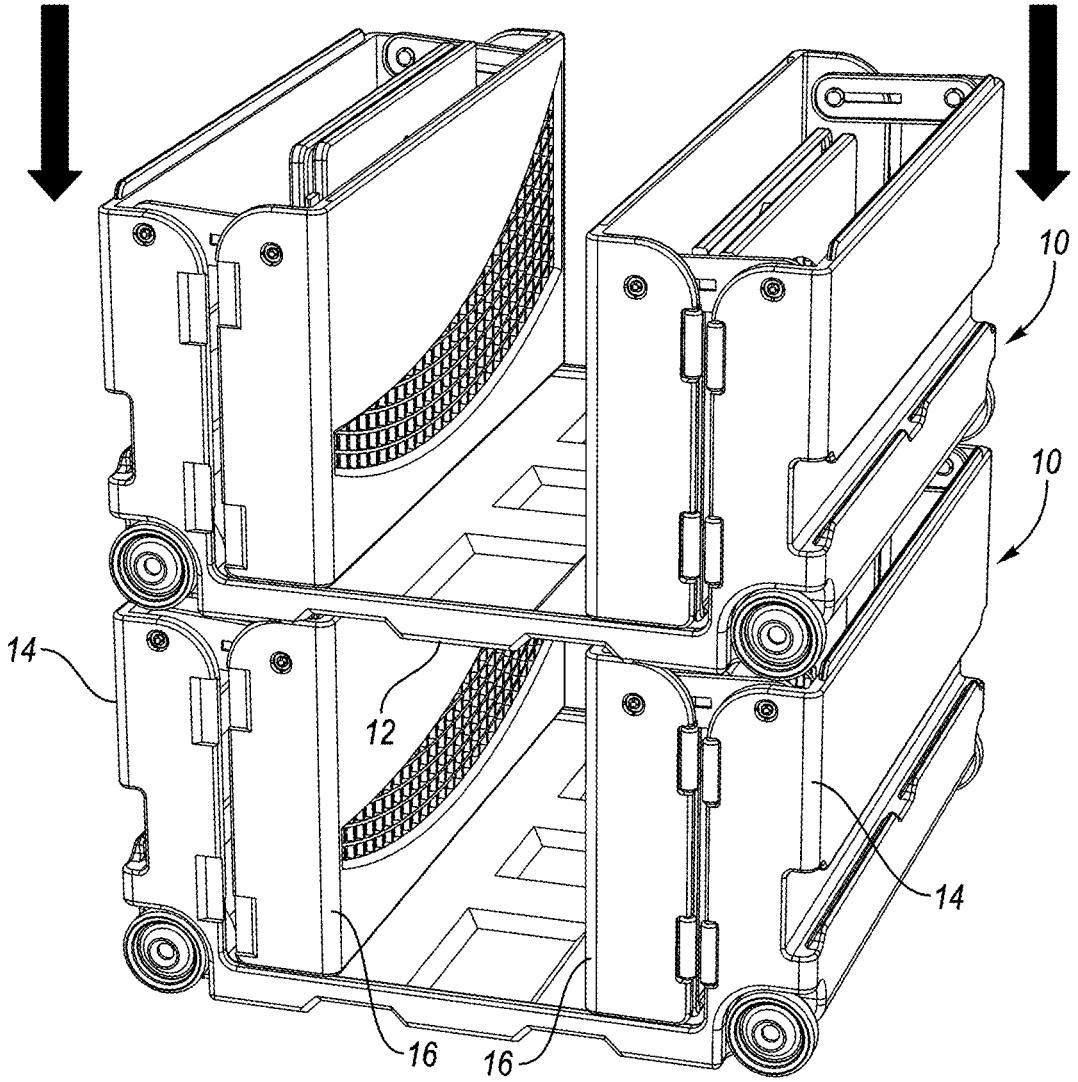
FIG. 7 shows the collapsed container of FIG. 6 stacked on an identical collapsed container.

As shown in FIG. 6, the upper side walls 16 can then be pivoted downward to a position between the lower side walls 14, thus reducing the height of the container 10 for efficient storage and shipping when empty. As shown in FIG. 7, multiple collapsed containers 10 can be stacked, with the base 12 of an upper container 10 supported on the upper side walls 16 and lower side walls 14 of the lower container 10.

Figure 9:
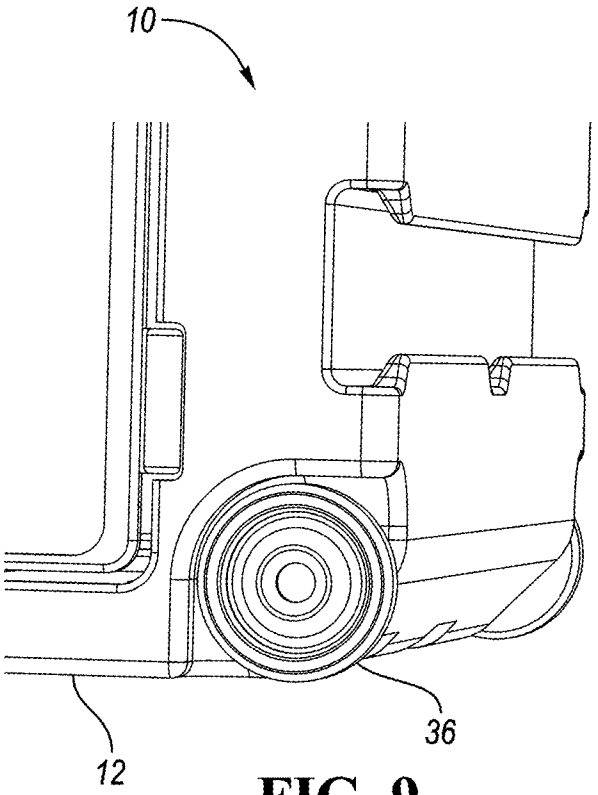
FIG. 9 is an enlarged view of one of the wheels of the container.
Figure 8:
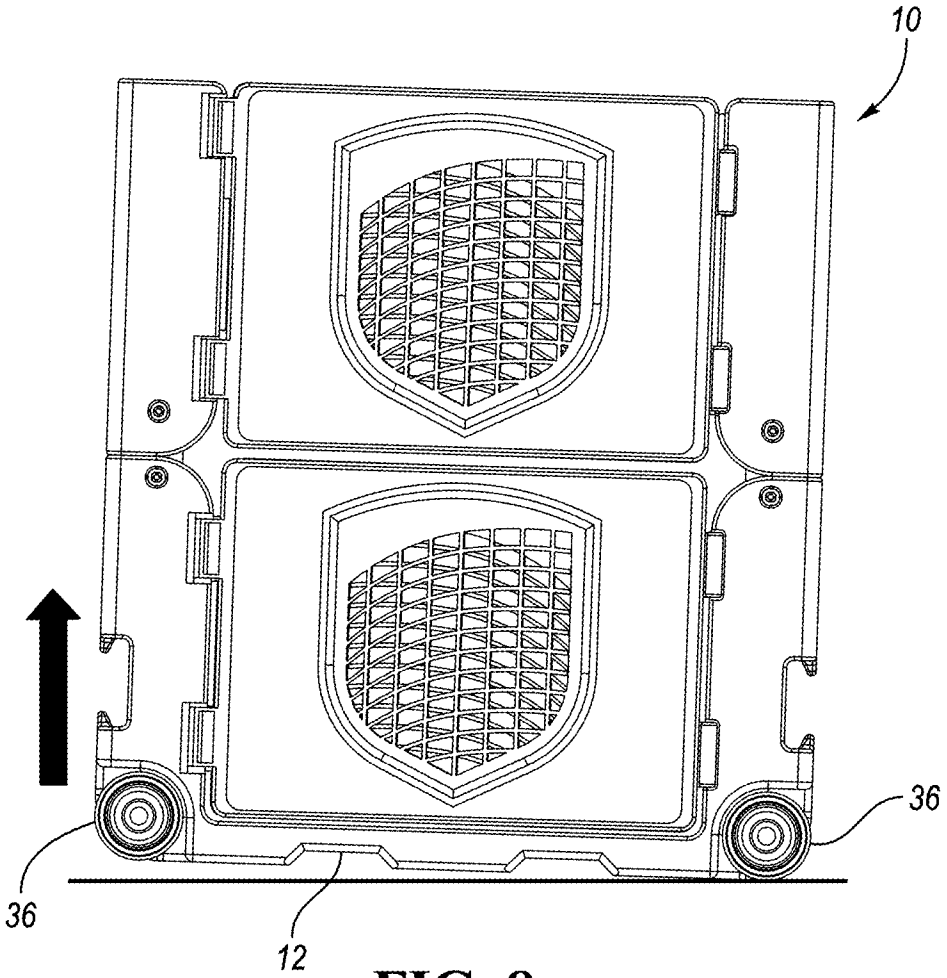
FIG. 8 shows the container of FIG. 1 lifted at one end so that the wheels engage the floor.

As shown in FIG. 8, the wheels 36 are recessed upward relative to the lowermost surface of the base 12 so that the wheels 36 do not generally contact the floor until one end of the base 12 is lifted slightly (e.g. approximately 1 inch) off the floor. Then the container 10 can be rolled on two of the wheels 36. The end of the base 12 can be lifted by a standard dolly, for example. FIG. 9 shows one of the wheels 36.

Figure 11:
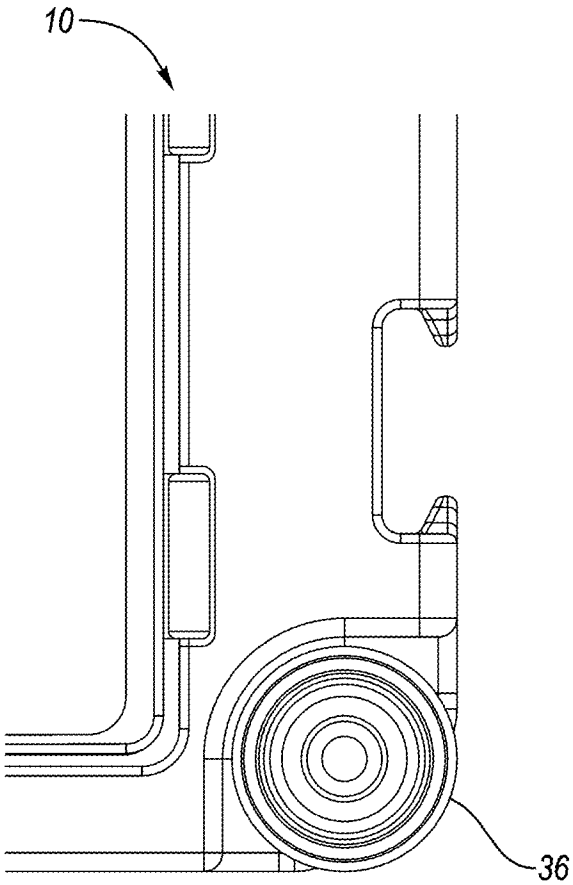
FIG. 11 is an enlarged view of one of the wheels of the container of FIG. 10.
Figure 10:
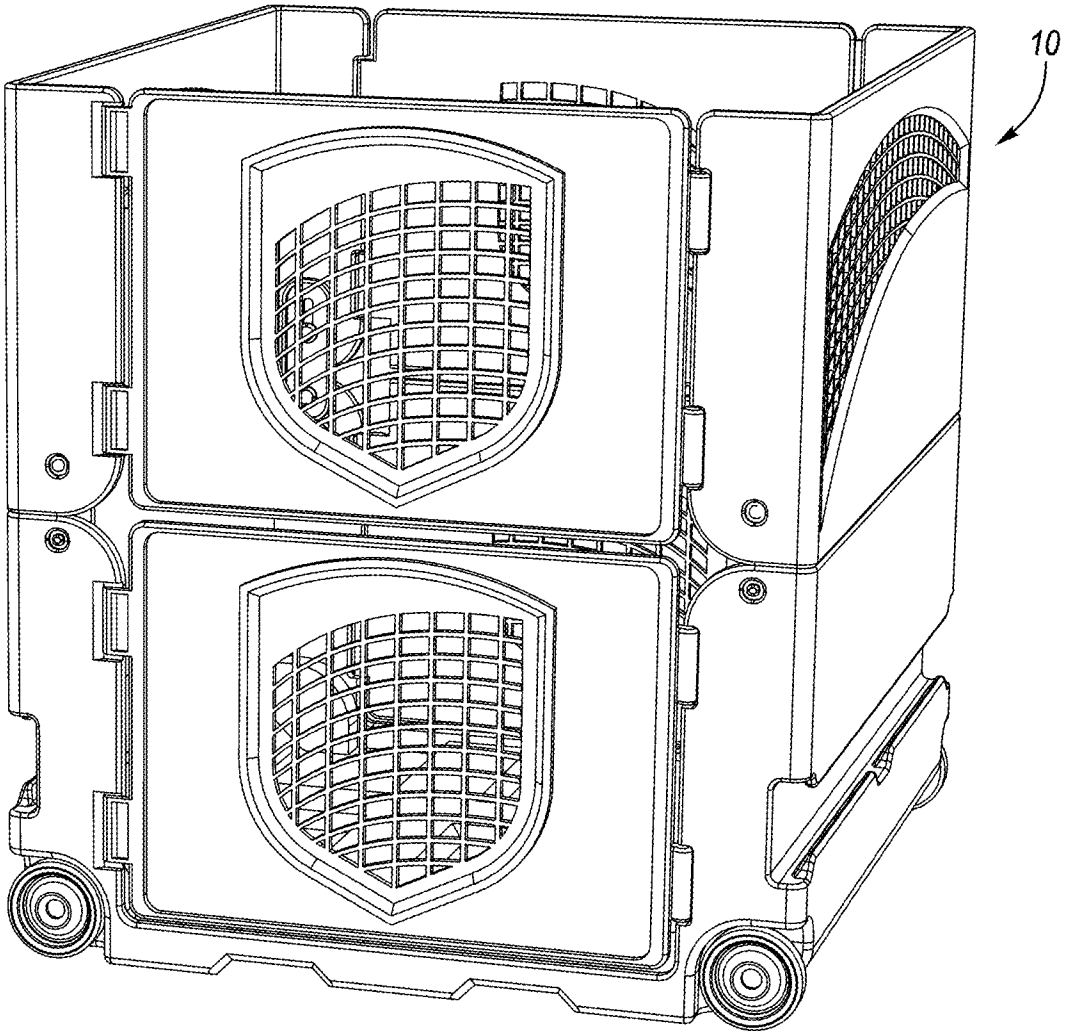
FIG. 10 is a perspective view of the container of FIG. 1.

FIG. 10 shows the assembled container 10. FIG. 11 shows an enlarged view of one of the wheels 36.

Figure 12:
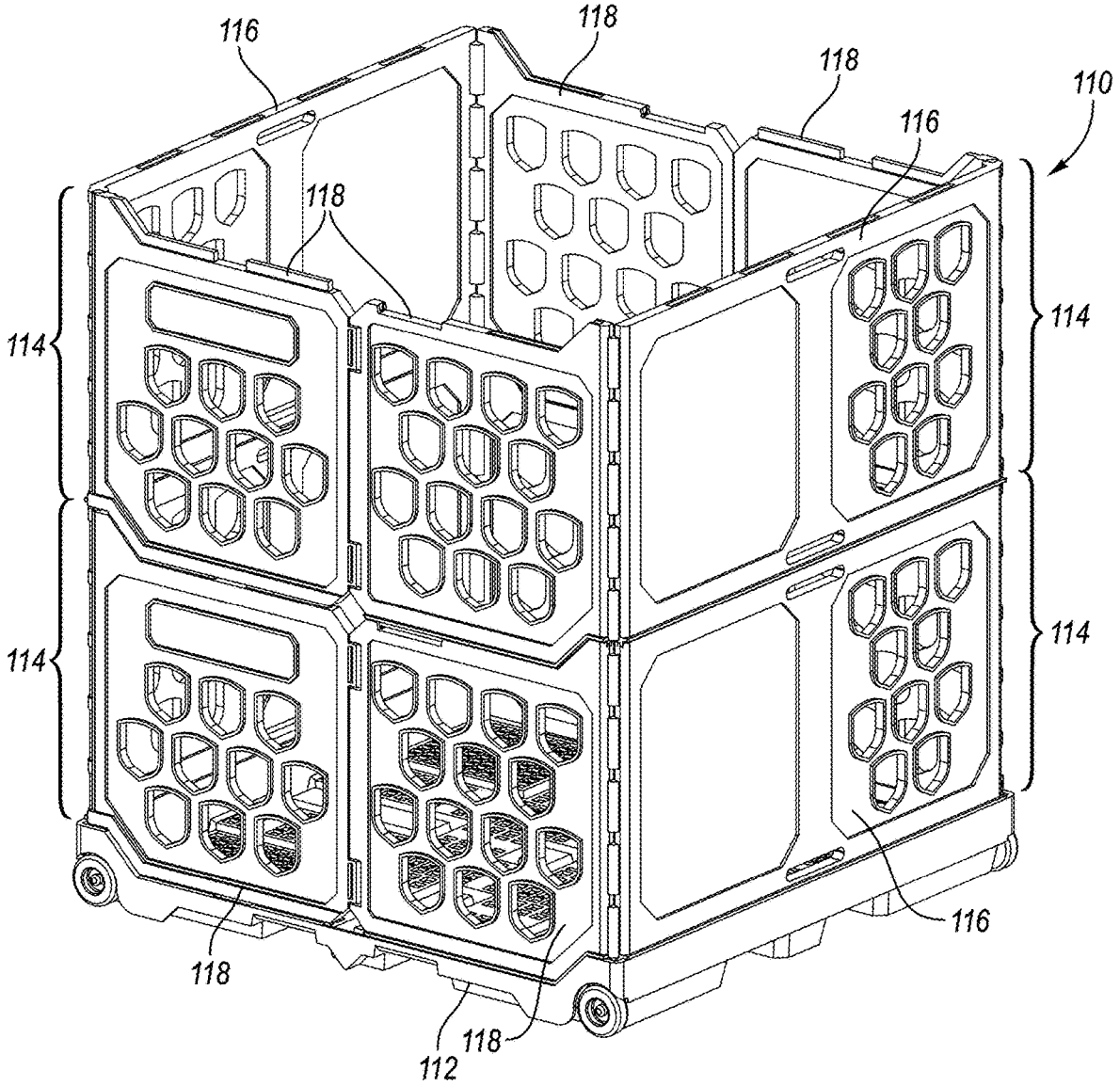
FIG. 12 is a perspective view of a collapsible container according to a second embodiment.
Figure 14:
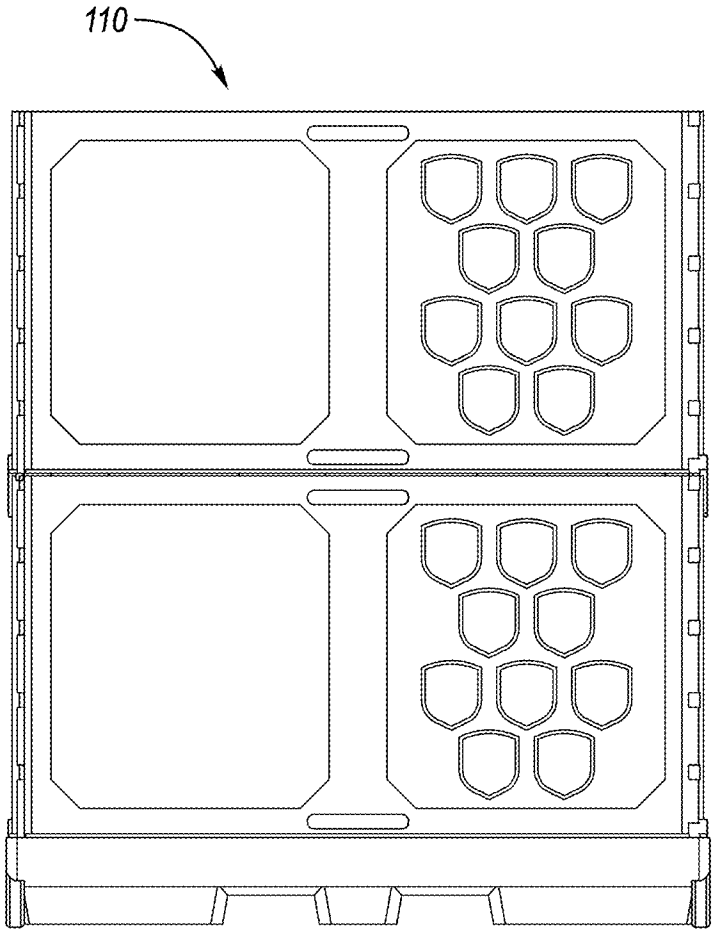
FIG. 14 is a side view of the container of FIG. 12.

FIG. 12 shows a collapsible container 110 according to another embodiment. The container 110 includes a base 112 with recessed wheels, as before. Modular wall sections 114 each include a side wall 116 and a pair of hingeably-connected end walls 118. A pair of wall sections 114 are secured to the perimeter of the base 112, with the end walls 118 selectively latched to one another. A second pair of wall sections 114 can be stacked and secured on top of the first pair of wall sections 114 to increase the height of the container 110 as shown.

Figure 13:
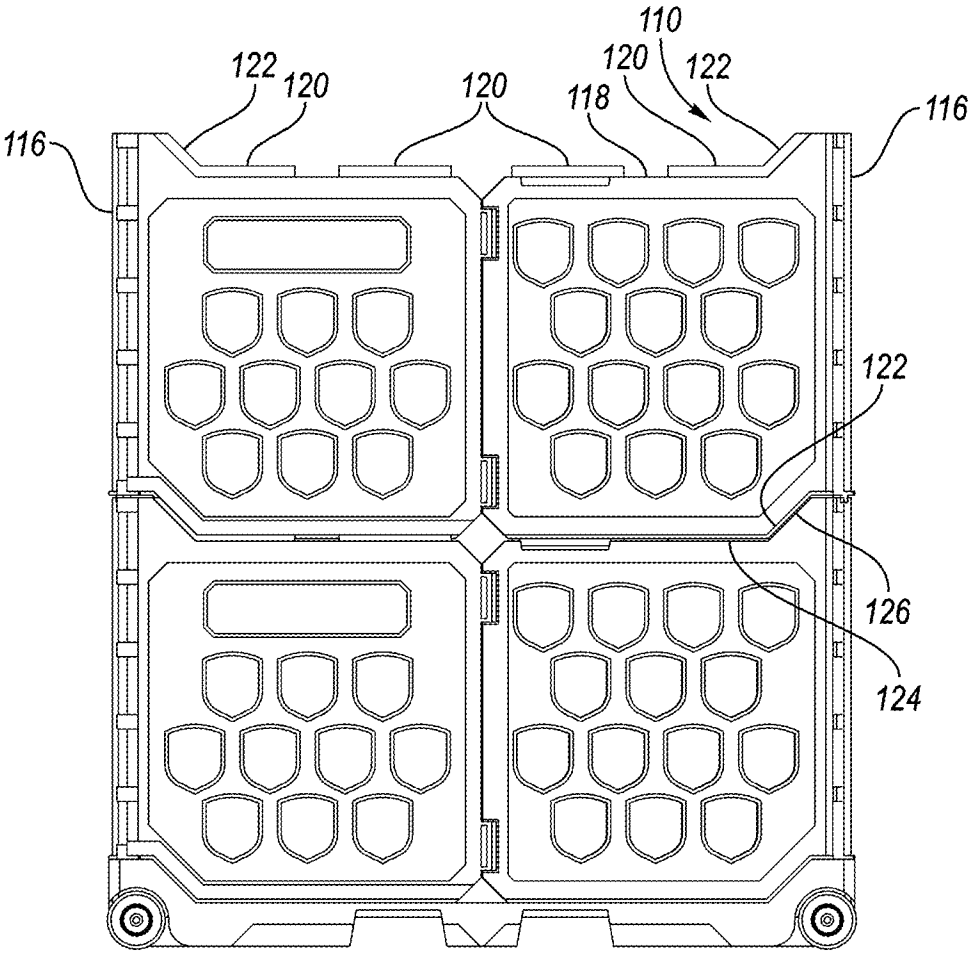
FIG. 13 is an end view of the container of FIG. 12.

As shown in FIG. 13, the upper edges of the end walls 118 include interlocking features 120, such as protrusions, that are complementary to interlocking features (e.g. recesses) in the bottom of end walls 118. As shown, the side walls 116 are taller than the end walls 118. A tapered flange 122 may extend from each side wall 116 on top of the end walls 118. The bottom of the end walls 118 are complementary in shape and include a central portion 124 to be received between the flanges 122 in the lower wall sections.

Figure 15:
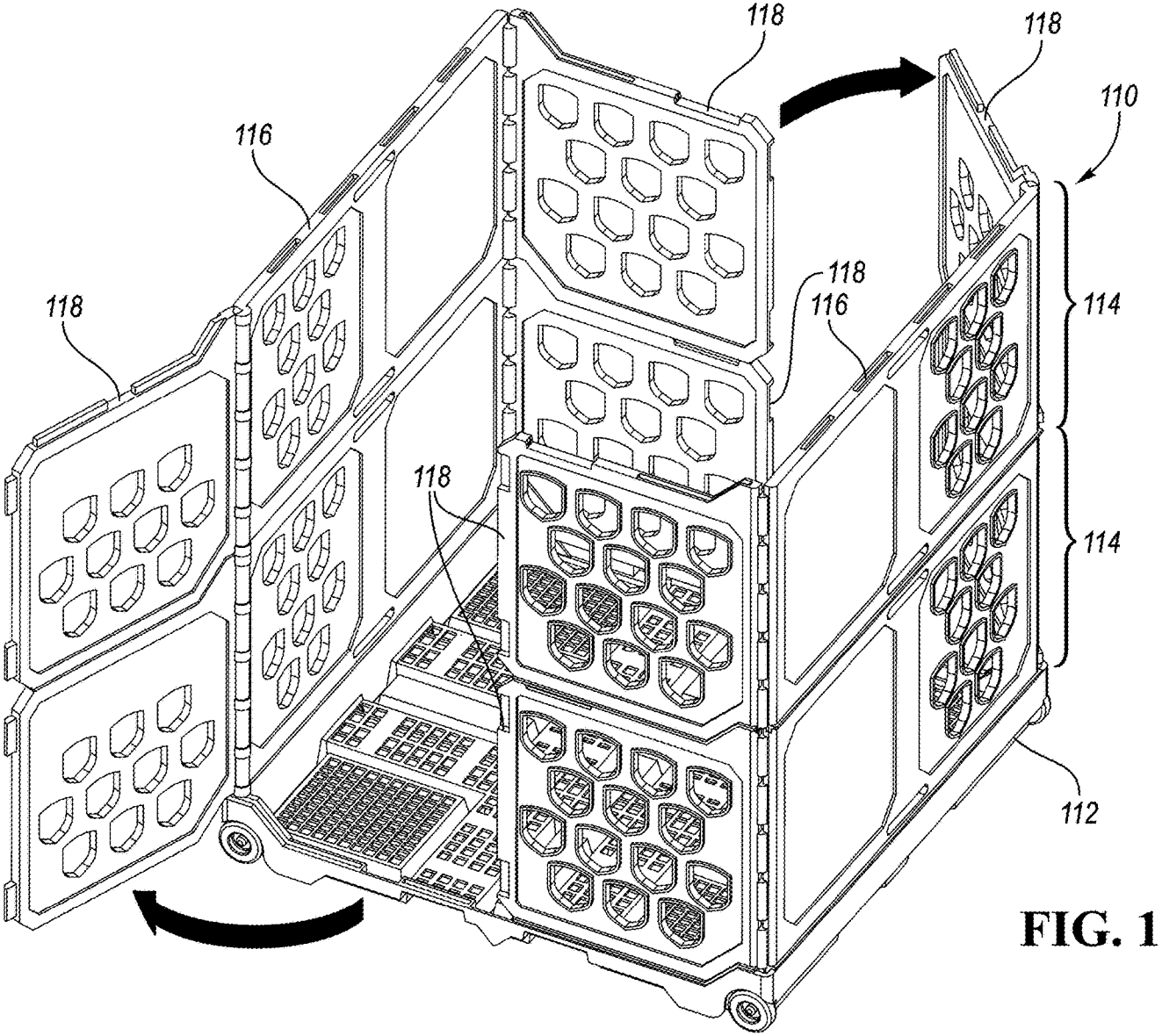
FIG. 15 is a perspective view of the container of FIG. 12 with some of the end walls pivoted open.
Figure 16:
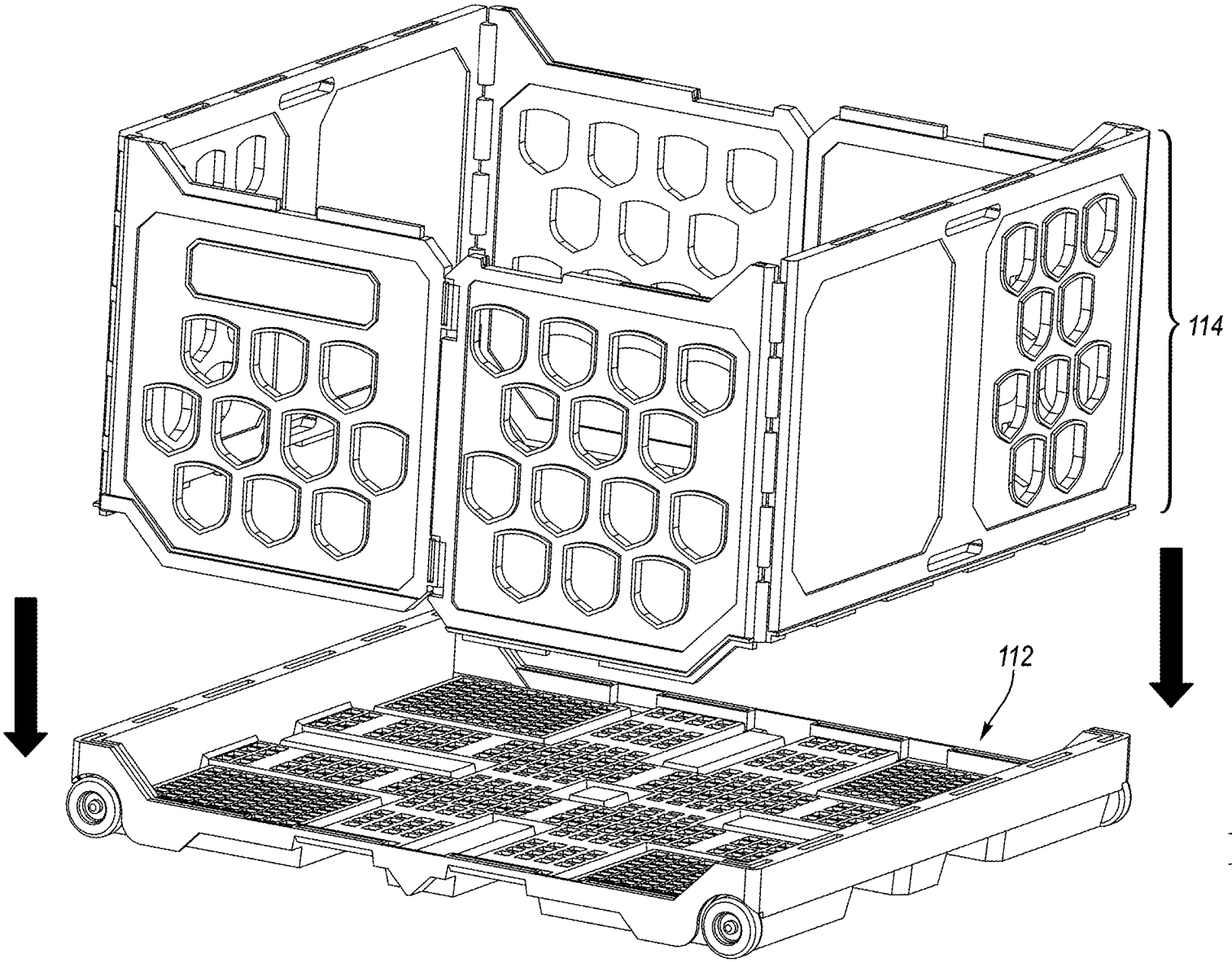
FIG. 16 is a partially exploded view of the container of FIG. 12.

As shown in FIG. 15, the end walls 118 can be pivoted outward to access the container 110. Upper edges of the side walls 116 may include interlocking features (e.g. recesses) complementary to interlocking features (e.g. protrusions) at lower edges of the side walls 116. FIG. 16 shows that the interlocking features at the bottom edges of the side walls 116 are complementary to interlocking features (e.g. recesses) in the perimeter of the base 112.

Figure 18:
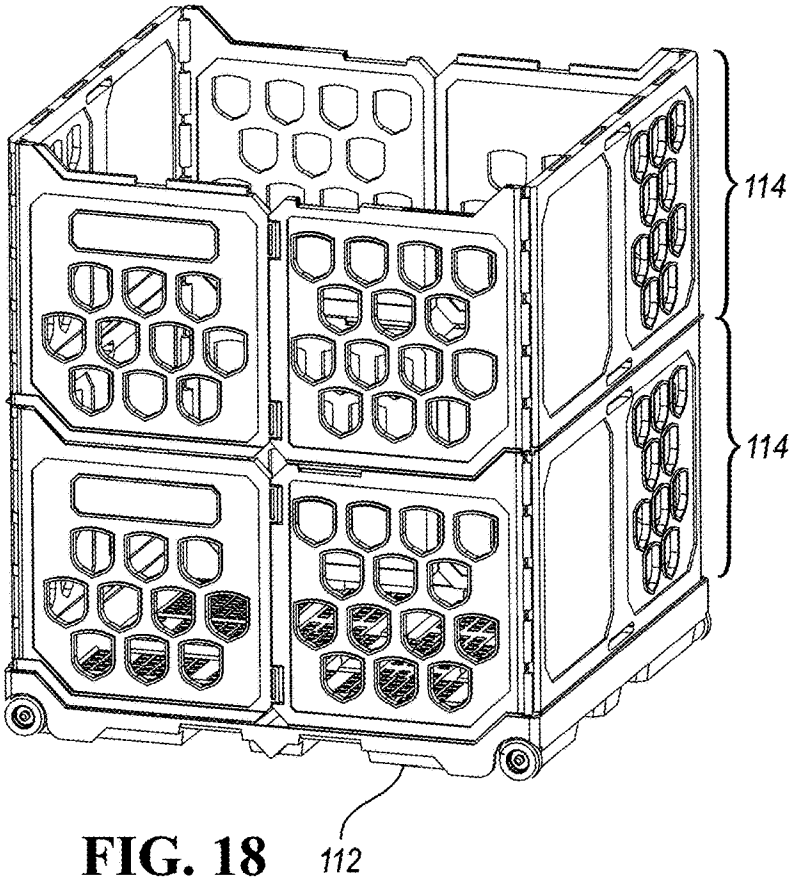
FIG. 18 is a perspective view of the container of FIG. 12.
Figure 17:
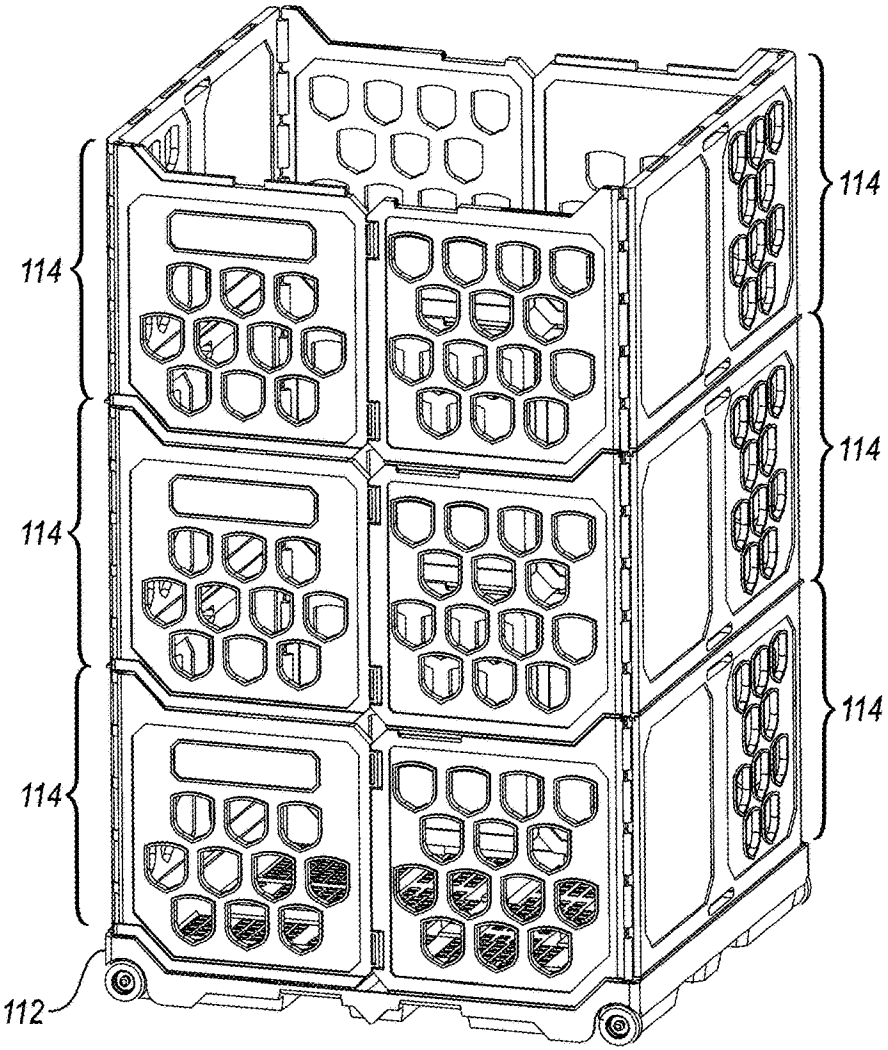
FIG. 17 show the container of FIG. 12 with additional wall sections stacked thereon.

As shown in FIGS. 17 and 18, differing numbers of pairs of walls sections 114 can be stacked to provide containers of different heights and volumes.

Figure 20:
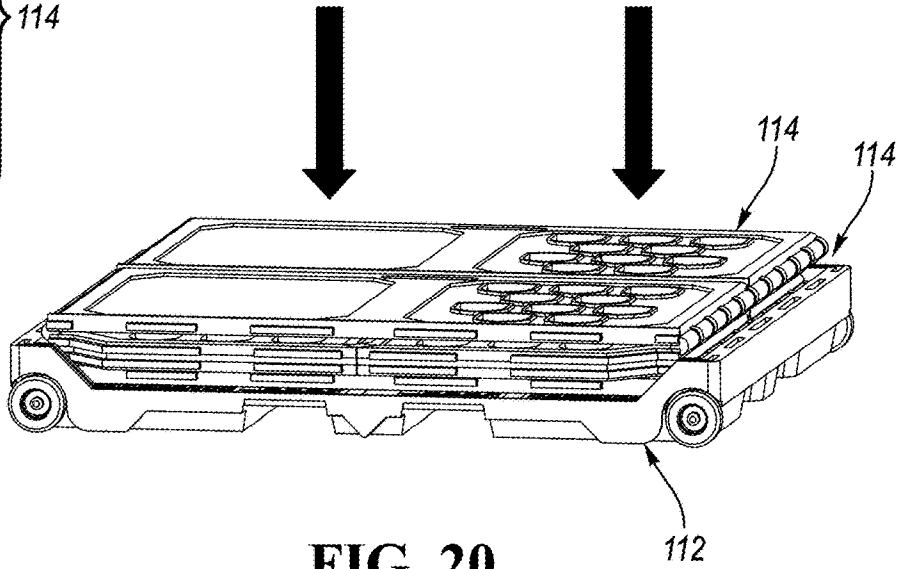
FIG. 20 is a perspective view of the container of FIG. 19 with the wall sections folded and stacked on the base.
Figure 19:
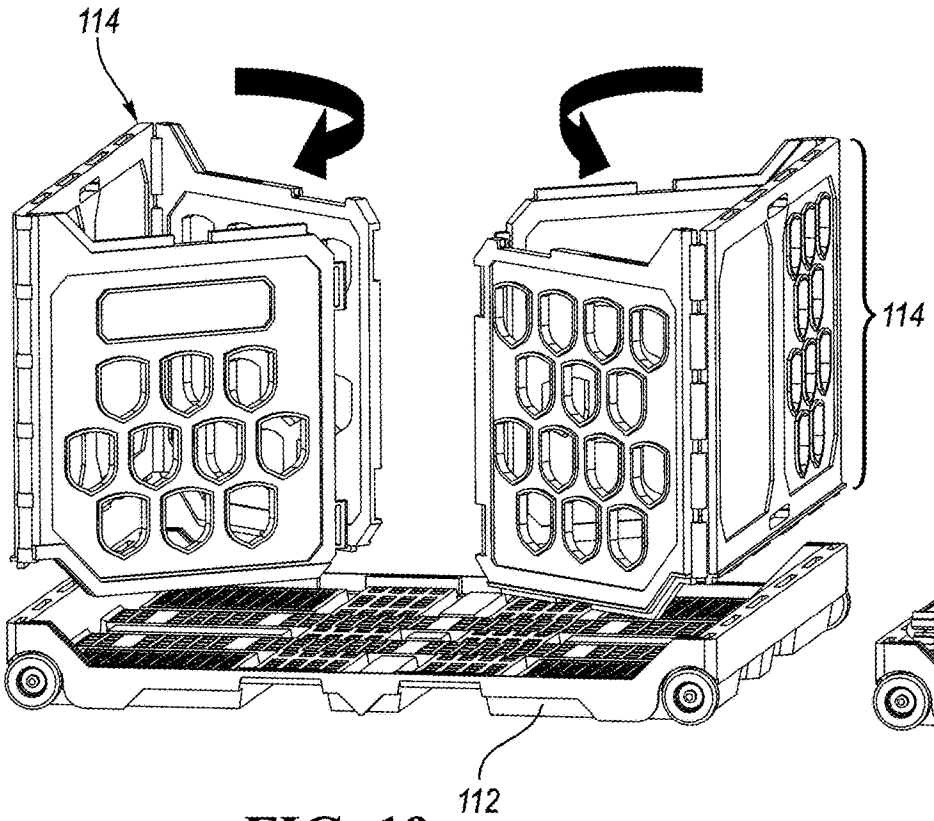
FIG. 19 is a partially exploded view of the container of FIG. 12 with the wall sections being folded inward.
Figure 21:
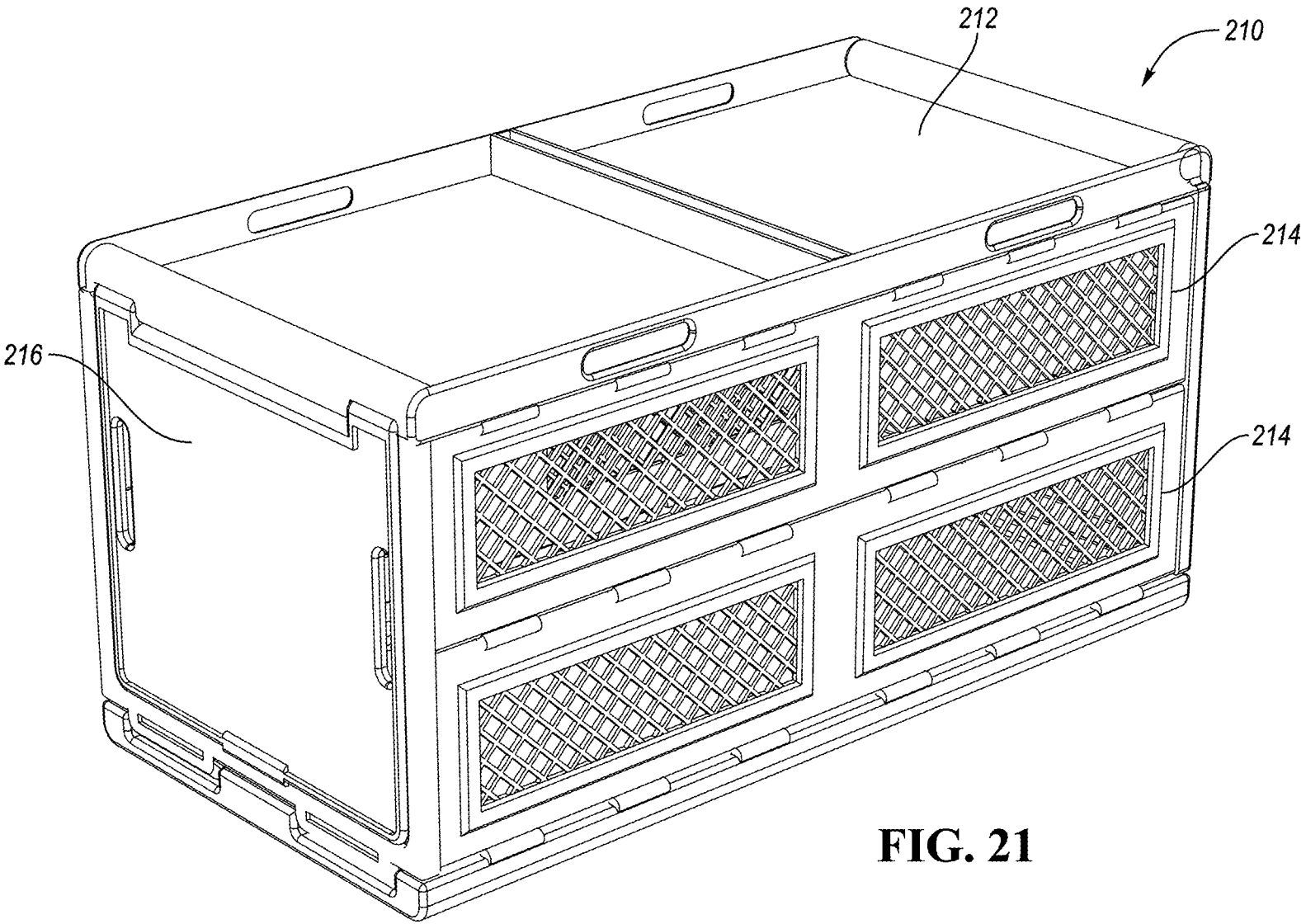
FIG. 21 is a perspective view of a collapsible container according to a third embodiment.

As shown in FIG. 19, the wall sections 114 can be collapsed flat by folding the end walls 118 inward adjacent the side walls 116. The wall sections 114 can then be stacked on the base 112 as shown in FIG. 20 for efficient shipping and storage.

Figure 22:
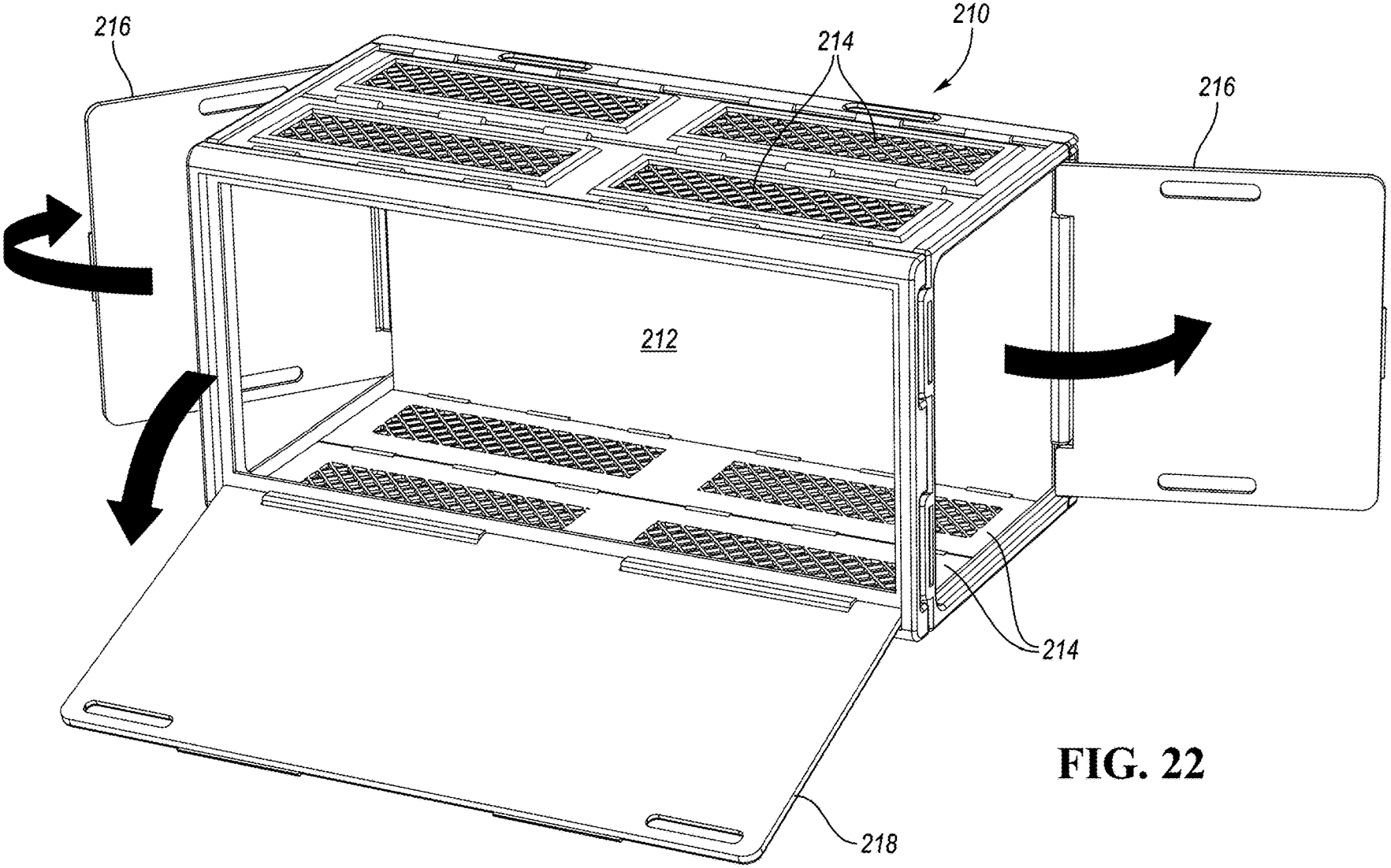
FIG. 22 shows the container of FIG. 21 with the end walls and upper wall pivoted outward.
Figure 23:
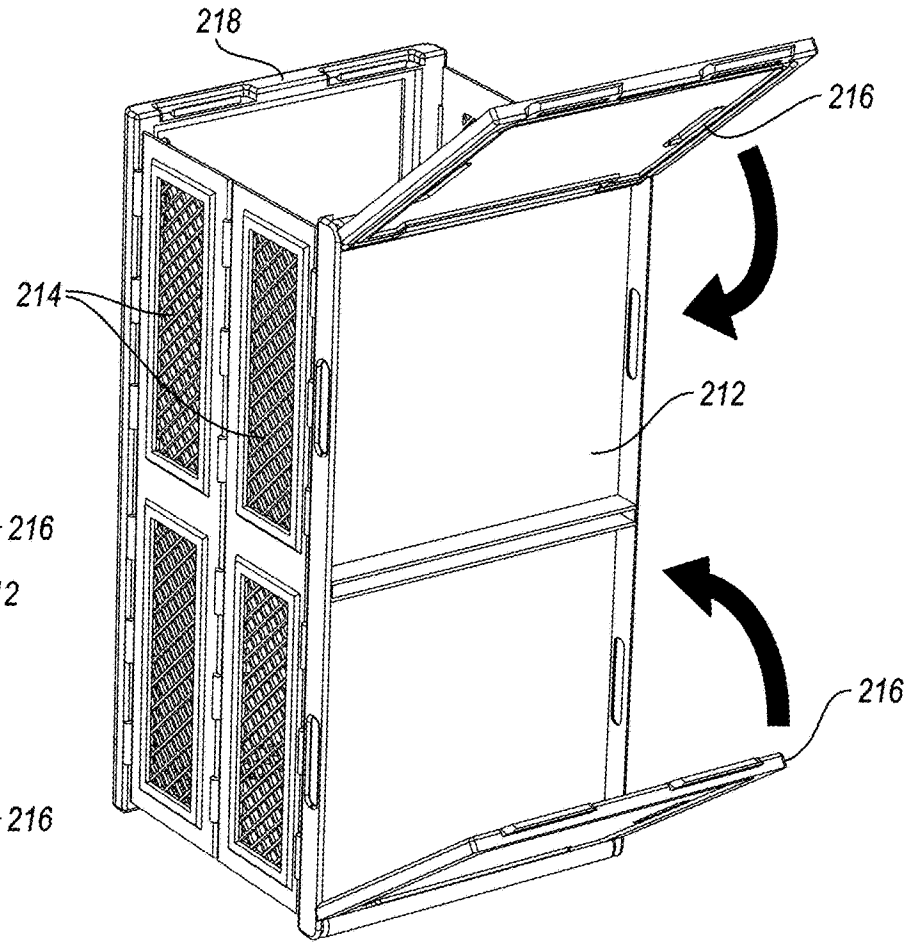
FIG. 23 shows a first step in collapsing the container of FIG. 21.
Figure 24:
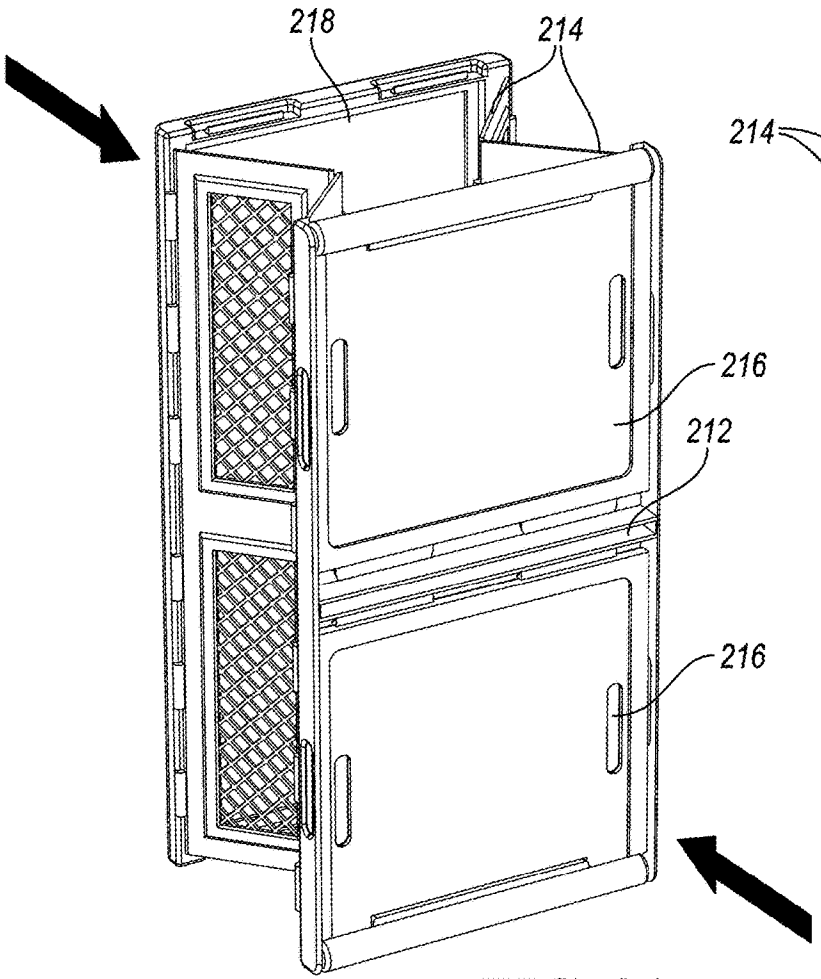
FIG. 24 shows a second step in collapsing the container of FIG. 21.
Figure 26:
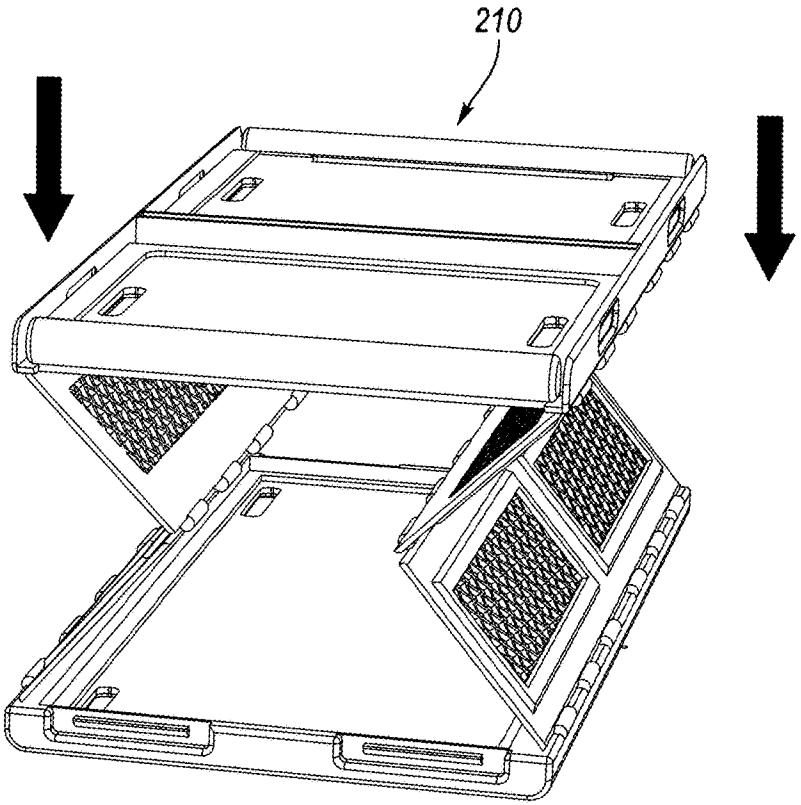
FIG. 26 shows the container of FIG. 21 in a collapsed position.
Figure 25:
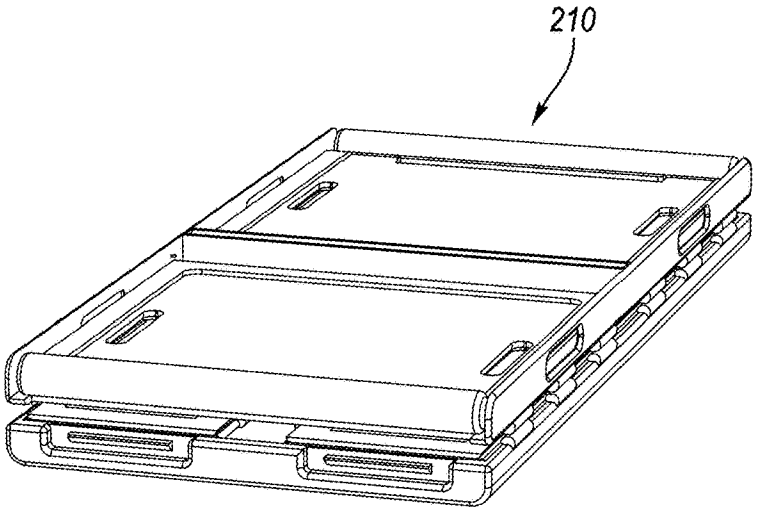
FIG. 25 shows a third step in collapsing the container of FIG. 21.
Figure 28:
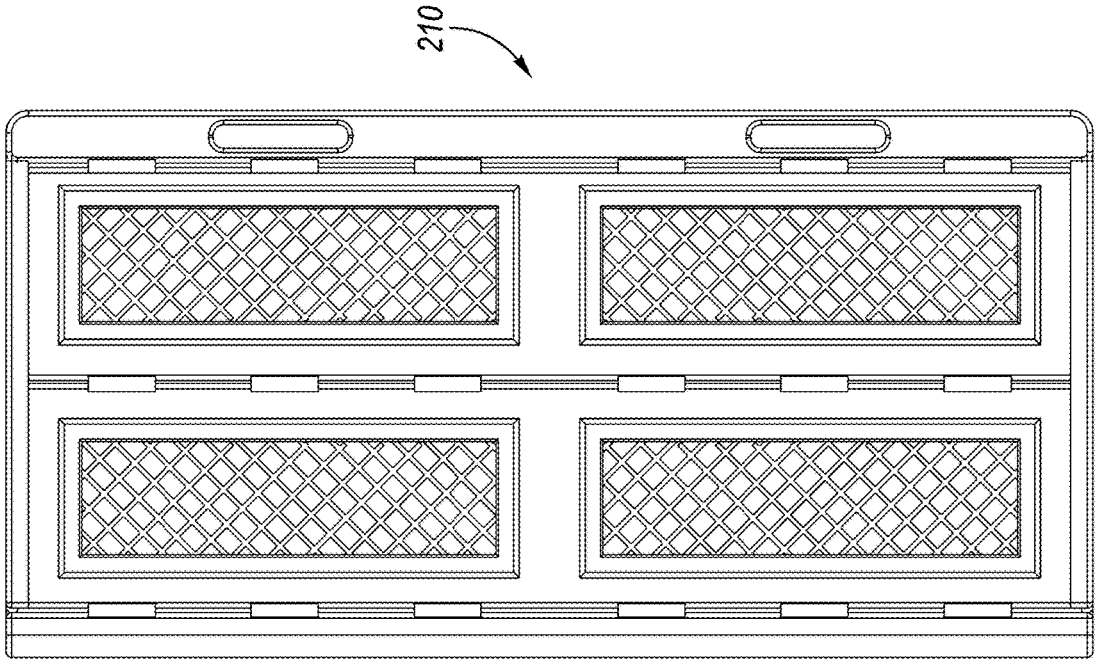
FIG. 28 is a side view of the container of FIG. 21.
Figure 27:
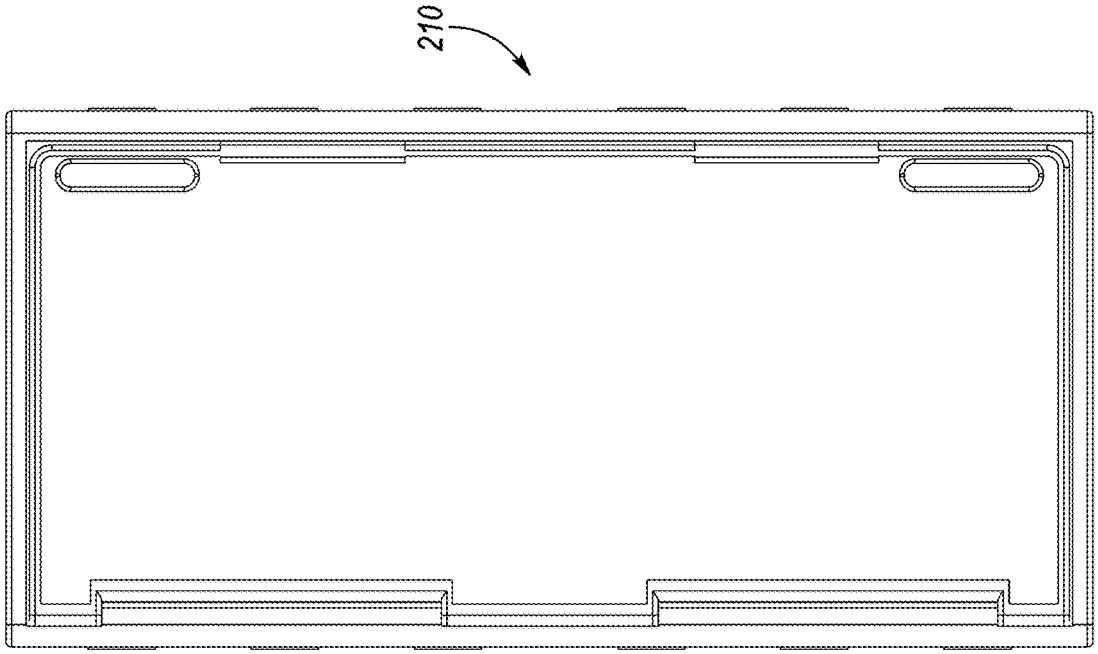
FIG. 27 is a top view of the container of FIG. 21.
Figure 29:
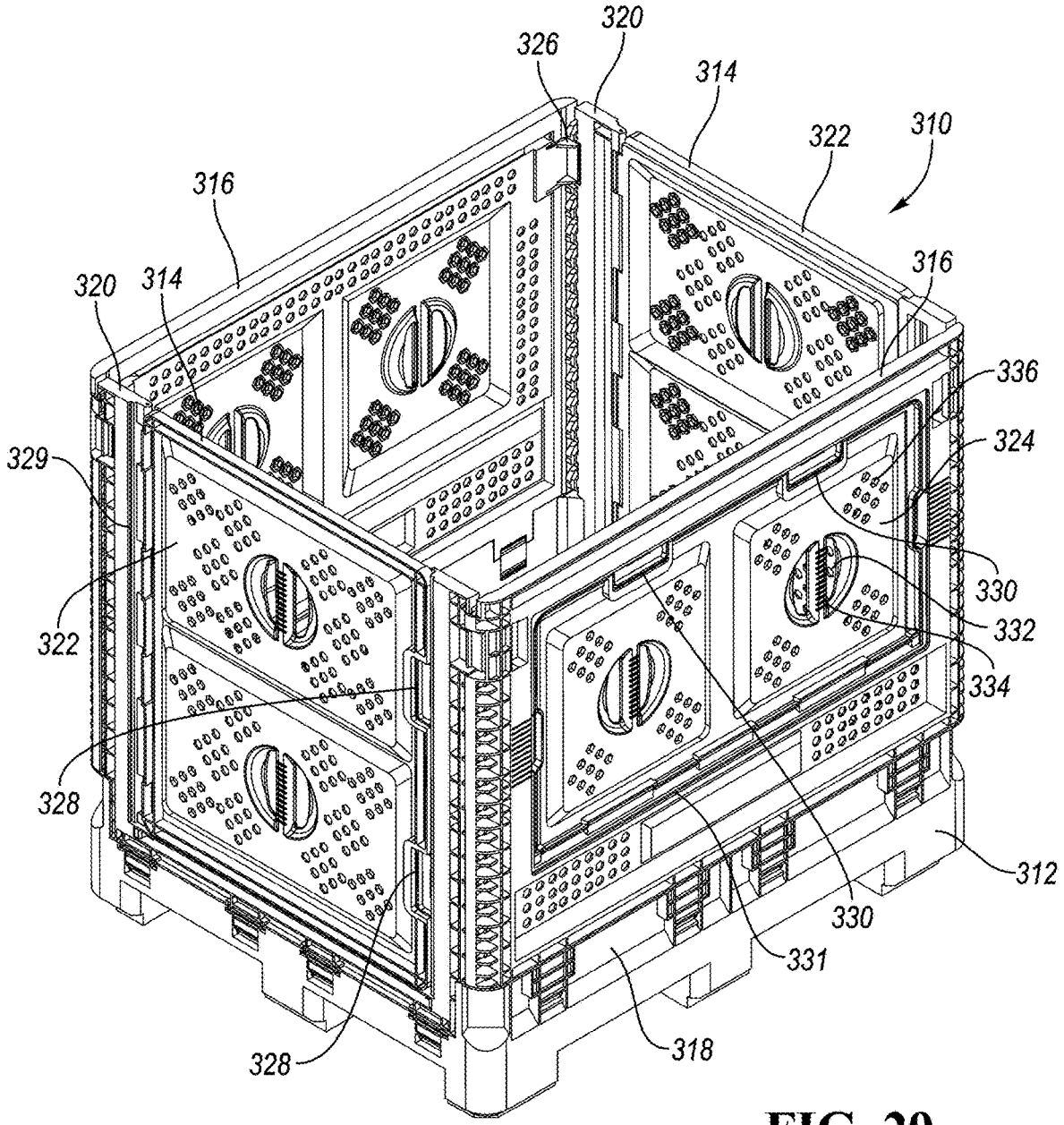
FIG. 29 is a perspective view of a collapsible container according to a fourth embodiment.

FIGS. 21 to 28 show a collapsible container 210 according to a third embodiment. The container 210 includes a base 212 and a pair of side walls 214 hingeably connected to one another and hingeably connected to each side edge of the base 212. End walls 216 are hingeably connected to end edges of the base 212. Referring to FIG. 22, the end walls 216 can be pivoted outward away from the upper wall 218, which can also be pivoted outward. Referring to FIGS. 23 and 24, the end walls 216 are pivoted back onto the exterior of the base 212. The side walls 214 are then pivoted together to collapse the base 212 toward the upper wall 218. FIGS. 25 and 26 further illustrate the collapse of the container 210. FIGS. 27 and 28 are top and side views of the container 210.

FIGS. 29-38 show a container 310 according to a fourth embodiment. The container 310 is generally a pallet bin. The container 310 includes a pallet base 312, side walls 314 and end walls 316. The side walls 314 are pivotably connected to side edges of the pallet base 312. The end walls 316 are pivotably connected to end flanges 318 projecting upward from end edges of the pallet base 312.

The side walls 314 each include a frame portion 320 that is pivotably connected to the side edges of the pallet base 312 and connected by latches 326 to the end walls 316. The frame portion 320 includes a lower portion and upstanding portions from each end of the lower portion, defining a large opening in the frame portion 320. Each side walls 314 further includes a large door 322 connected by a hinge 329 to one of the upstanding portions of the frame portion 320 and connected by latches 328 to the other of the upstanding portions of the frame portion 320. The frame portion 320 occupies a relatively small amount of the opening. For example, the frame portion 320 occupies less than approximately 25% of the width of the opening between the end walls 316 and less than approximately 10% of the height of the opening above the lower portion of the frame portion 320 (i.e. from the top of the lower portion of the frame portion 320 to the plane containing the uppermost surfaces of the container 310). The door 322 occupies a majority of the opening, i.e. all of the area within the frame portion 320.

Each of the end walls 316 includes a door 324 selectively closing an opening through the end wall 316. The door 324 is connected to the rest of the end wall 316 by a hinge 331 at the bottom of the door 324 and by latches 330 at an upper edge of the door 324. Each of the doors 322, 324 is divided into two or more sections (two shown here), each having a round center opening 332. A vertical handle 334 extends across each center opening 332. A plurality of sets 336 of small apertures are positioned adjacent each center opening 332. The small apertures and the center openings 332 provide ventilation to the container 310. Each handle 334 also provides a place where a user can grasp the door to open or close the door.

Figure 30:
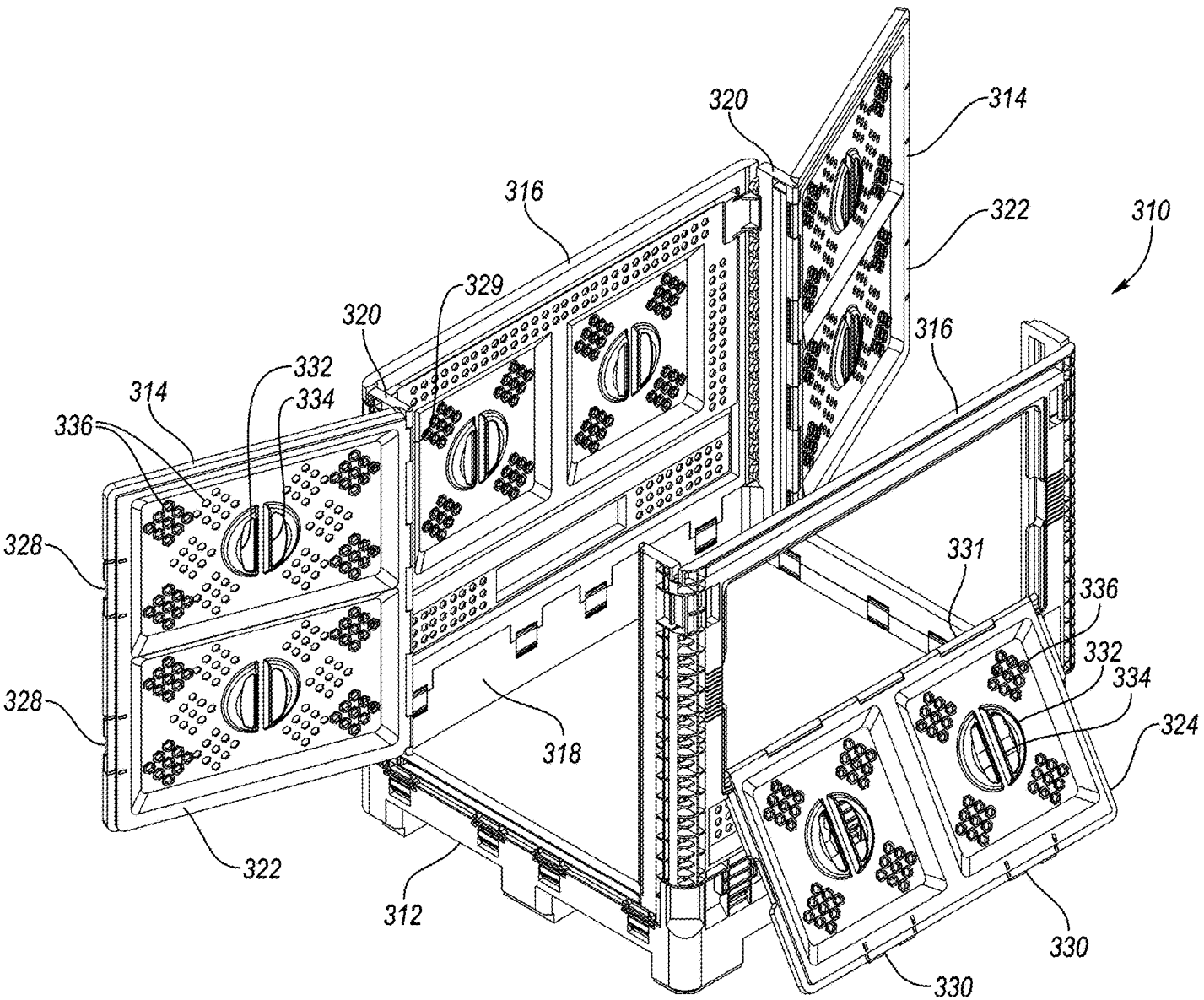
FIG. 30 shows the container of FIG. 29 with many of the doors and walls pivoted outward.

FIG. 30 shows the container 310 with the doors 322 in the side walls 314 pivoted to the open position, and one of the doors 324 of one of the end walls 316 pivoted to the open position.

Figure 32:
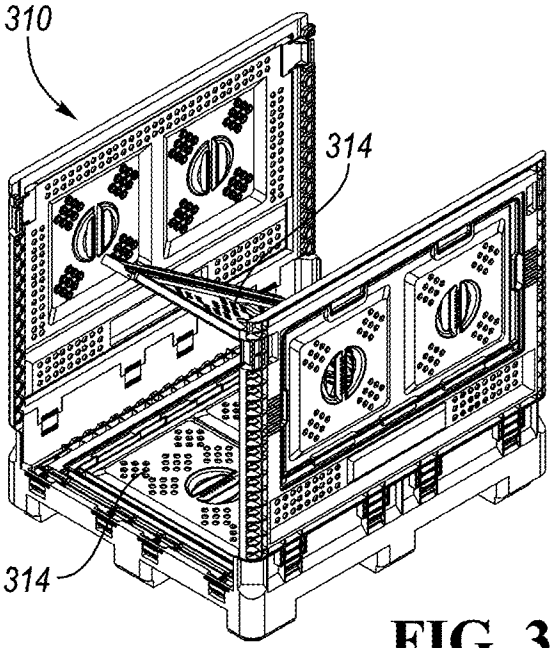
FIGS. 31-34 show the sequential steps in collapsing the container of FIG. 29.
Figure 31:
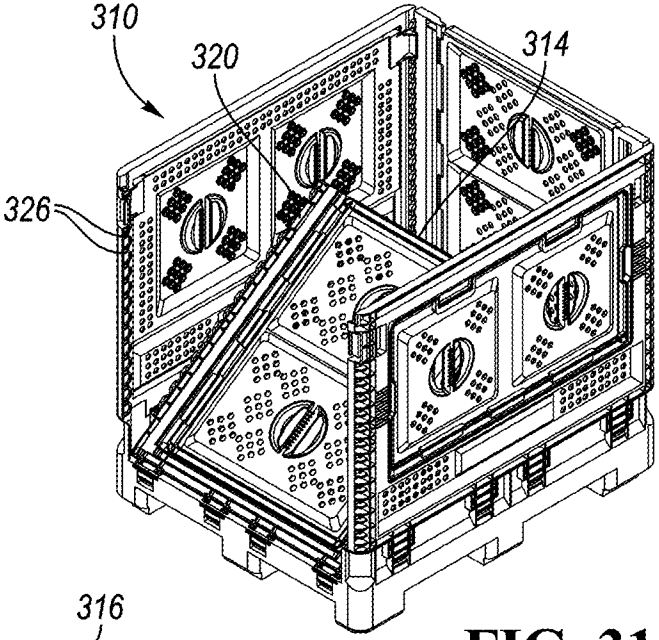
Figure 34:
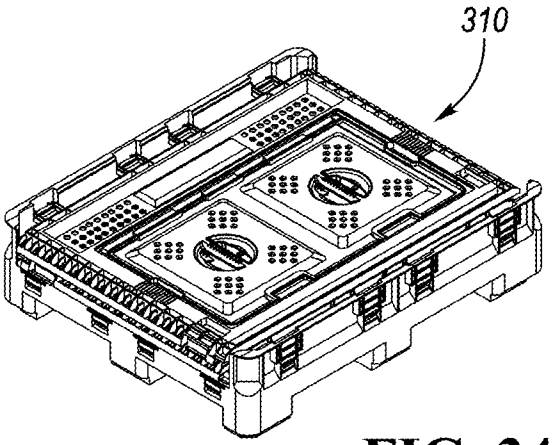
Figure 33:
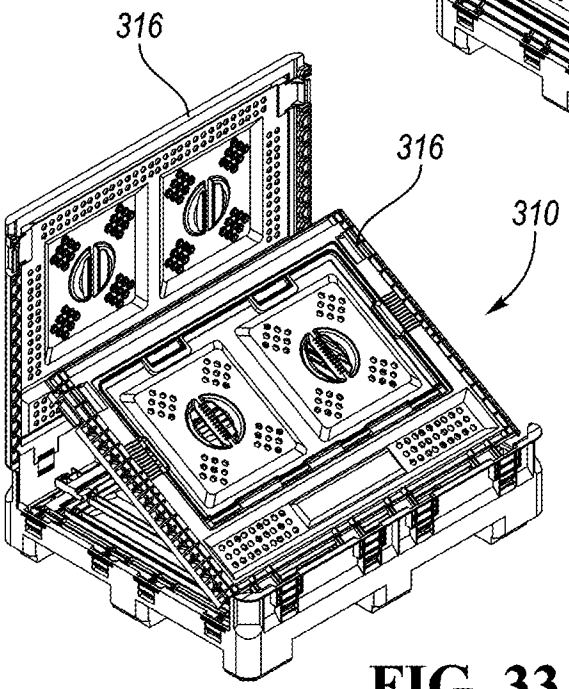
Figure 36:
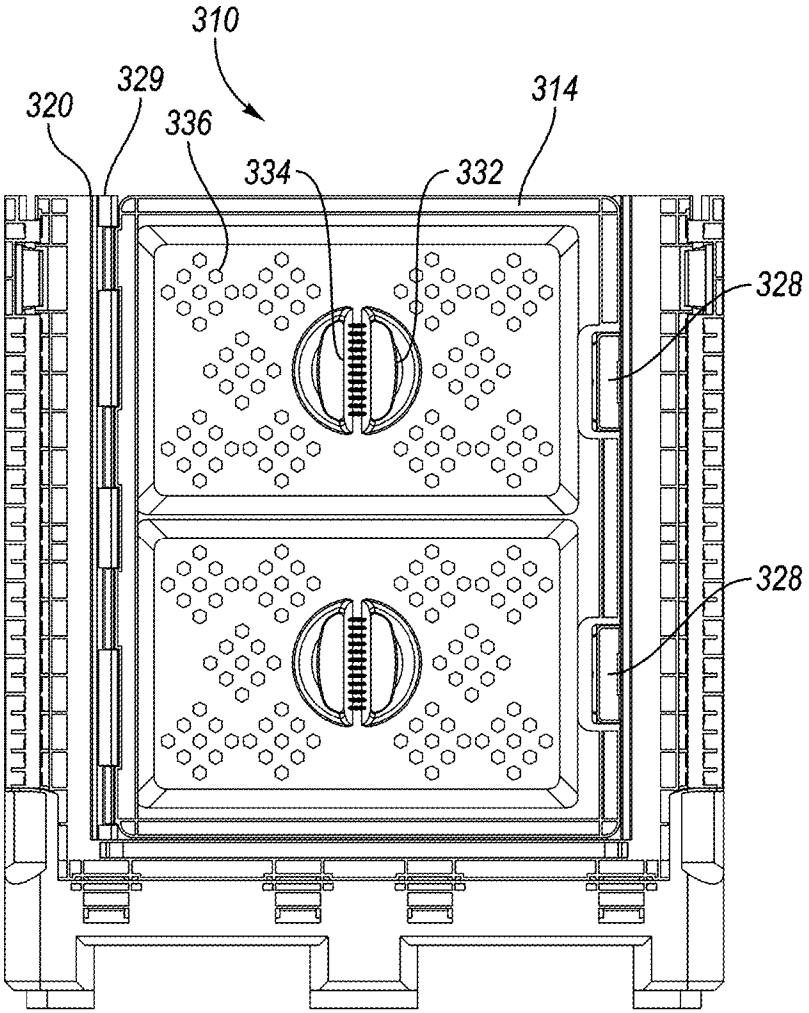
FIG. 36 is a side view of the container of FIG. 29.
Figure 35:
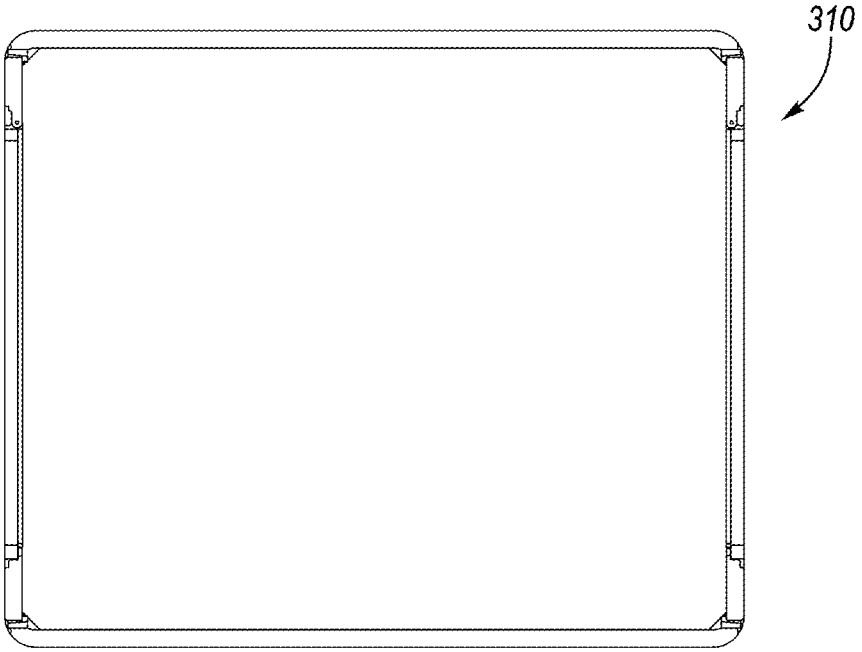
FIG. 35 is a top view of the container of FIG. 29.
Figure 38:
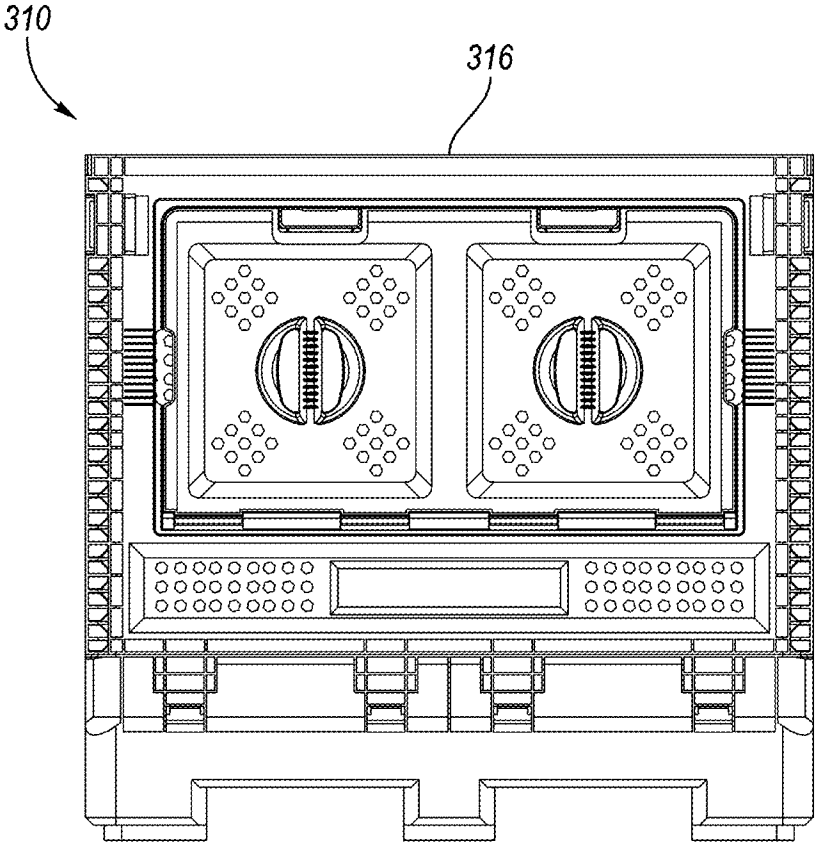
FIGS. 37 and 38 are end views of the container of FIG. 29.
Figure 37:
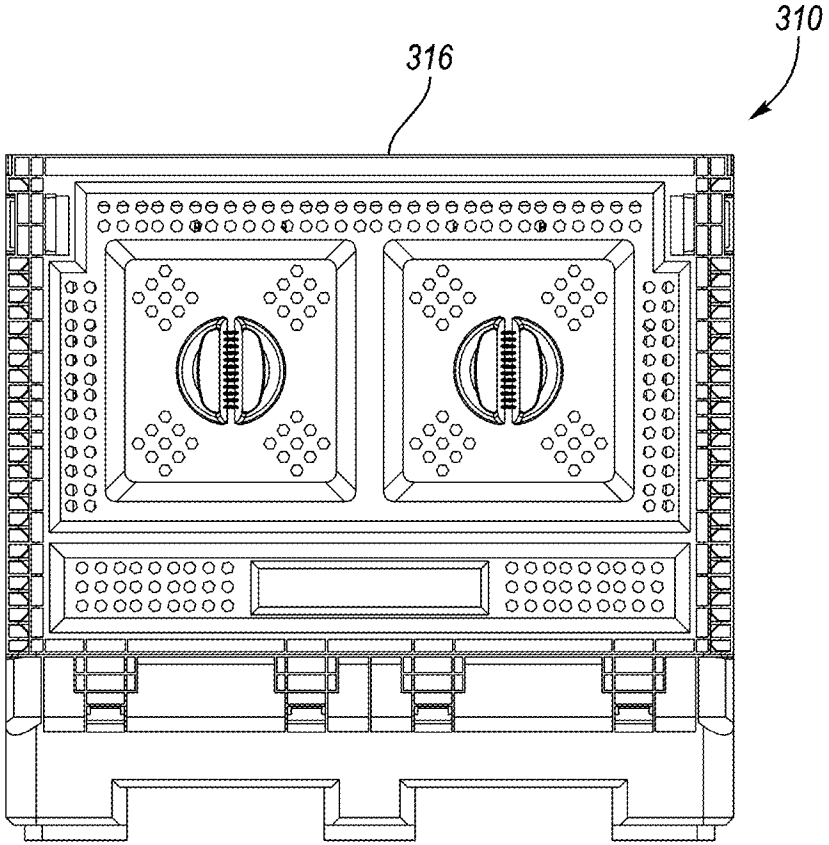

FIGS. 31-34 illustrate the sequence of moving the container 310 to a collapsed position. In FIG. 31, one of the side walls 314 (including its frame portion 320) is pivoted downward toward the base 12 after unlatching the latches 326. Referring to FIG. 32, the opposite side wall 314 is then pivoted down onto the first side wall 314. In FIG. 33, one of the end walls 316 is pivoted down onto the side walls 314. In FIG. 34, the other end wall 316 is pivoted down onto the first end wall 316. FIG. 35 is a top view of the container 310. FIG. 36 is a side view of the container 310. FIGS. 37 and 38 are end views of the container 310.

Figure 40:
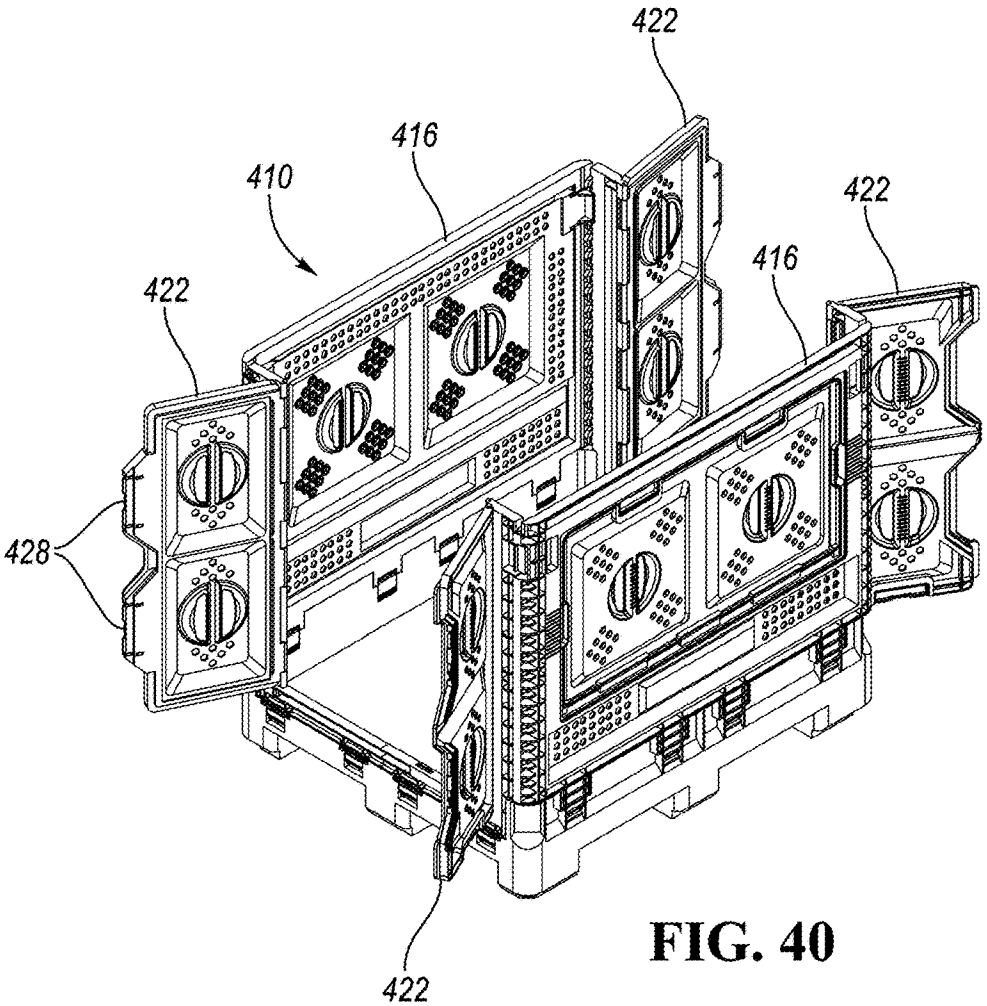
FIG. 40 shows the container of FIG. 39 with the side walls pivoted outward.
Figure 39:
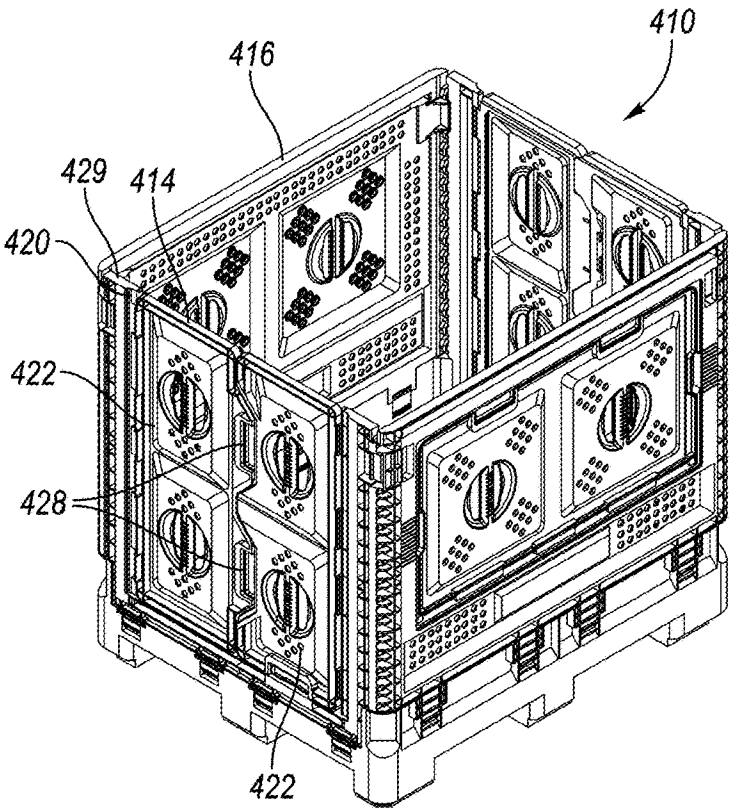
FIG. 39 is a perspective view of a container according to a fifth embodiment.

FIGS. 39-40 show a collapsible container 410 according to a fifth embodiment. Except as otherwise described or shown, the container 410 is identical to the container 310 of FIGS. 29-38. In the container 410, the side walls 414 each include a pair of doors 422 each connected by a hinge 429 to one of the upstanding portions of the frame portion 420. The doors 422 extend toward one another from the hinges 429 and are selectively connected to one another by latches 428. These doors 422 provide access to the interior of the container 410 in areas with limited space for accommodating the large doors of the previous container 310. The doors in the end walls 416 may be identical to those in container 310.

Figure 42:
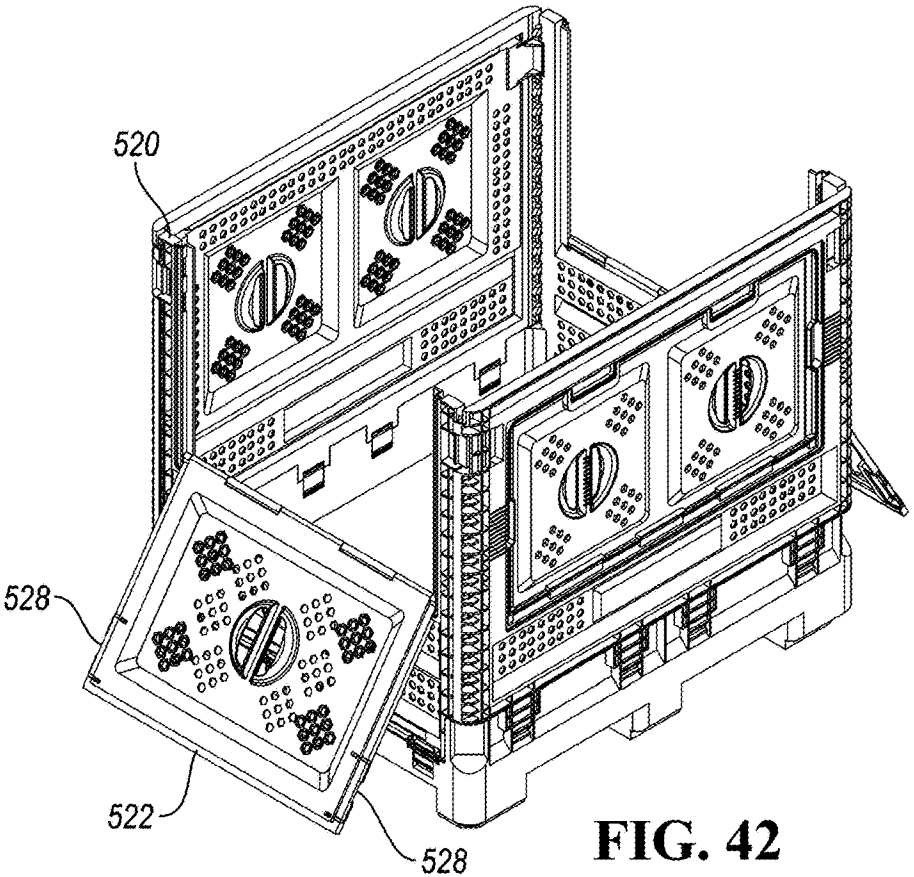
FIG. 42 shows the container of FIG. 41 with the doors pivoted outward.
Figure 41:
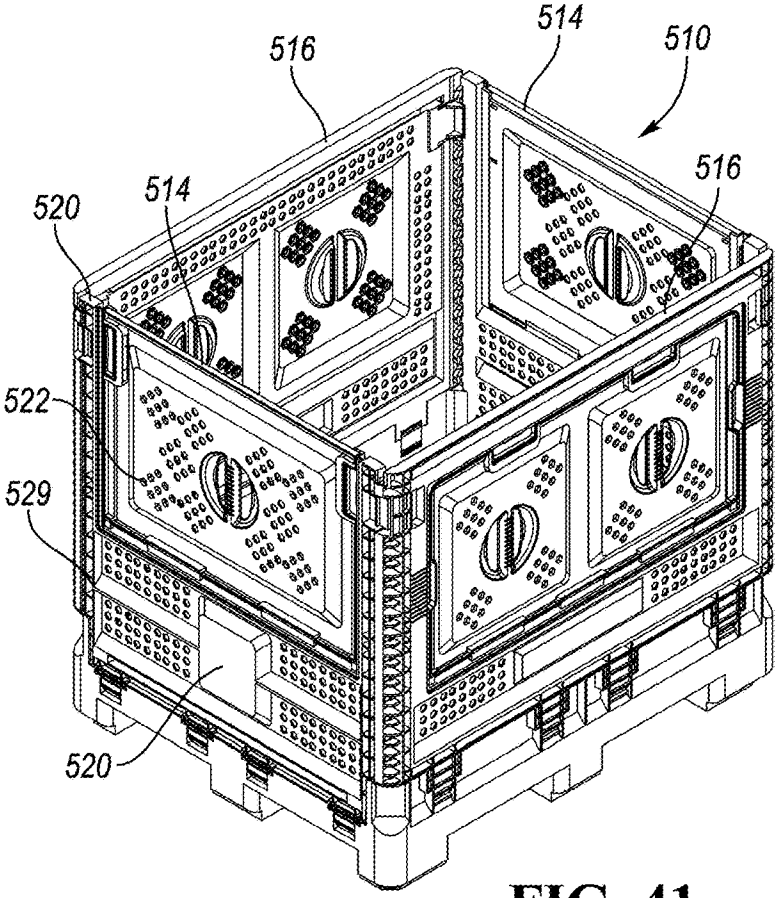
FIG. 41 shows a collapsible container according to a sixth embodiment.

FIGS. 41-42 show a collapsible container 510 according to a sixth embodiment. Except as otherwise described or shown, the container 510 is identical to the container 310 of FIGS. 29-38. In the container 510, the side walls 514 each include a single large door 522 connected at a lower edge by a hinge 529 to a frame portion 520. This container 510 may be suitable for a point of purchase within a retail environment.

Figure 43:
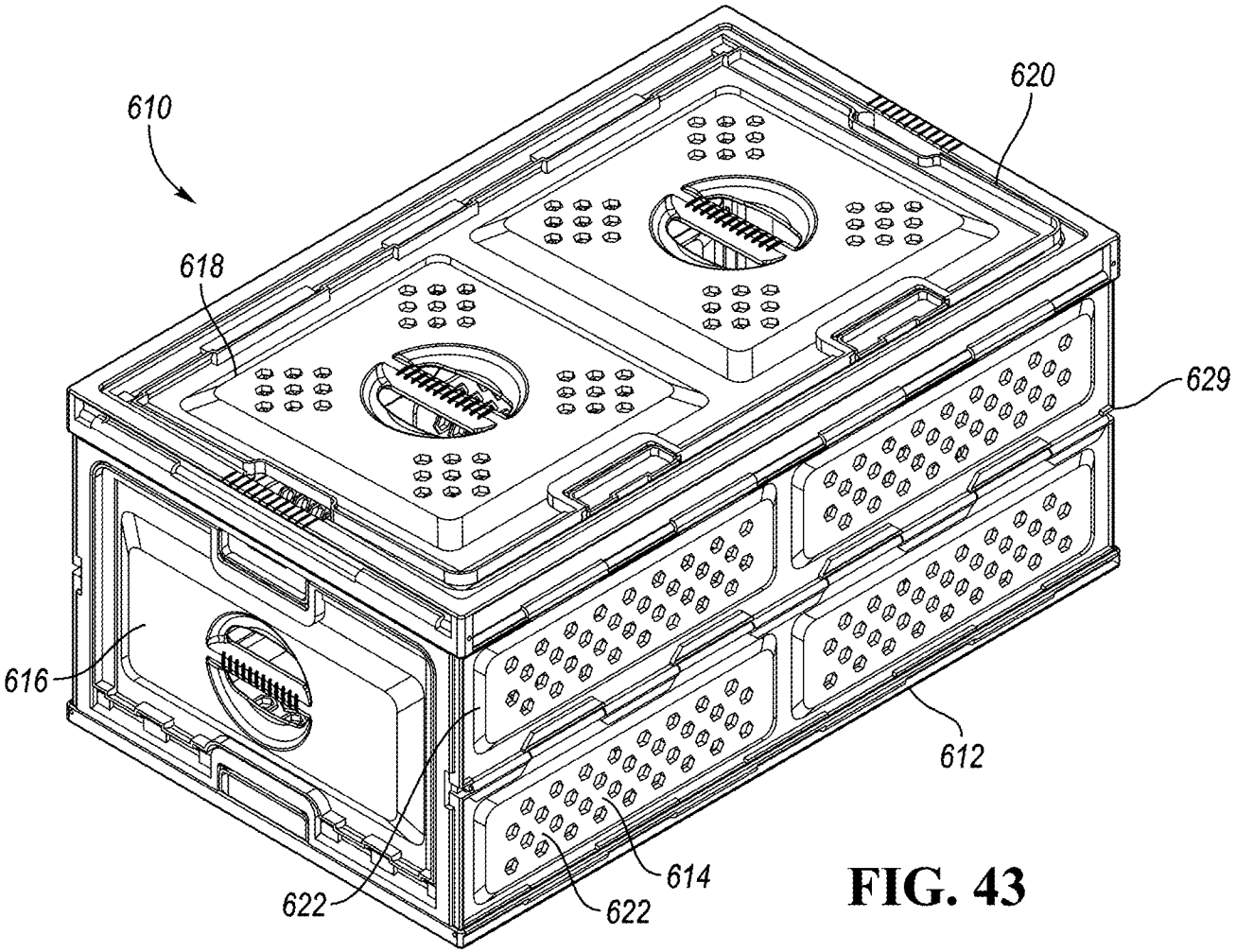
FIG. 43 is a perspective view of a container according to a sixth embodiment.

FIGS. 43-48 show a container 610 according to a seventh embodiment. Referring to FIG. 43, the container 610 includes a base 612 opposite an upper wall 618. Side walls 614 extend from the base 612 to the upper wall 618. Each side wall 614 includes a pair of side panels 622 connected to one another by a hinge 629. Each side wall 614 is connected by a hinge to the base 612 and by another hinge to the upper wall 618. The upper wall 618 is secured inside an upper frame 620 by a hinge and by latches. End walls 616 are each hingeably connected to the upper frame 620 and to the base 612 by a latch. The base 612 may be identical to the upper wall 618 and upper frame 620. As shown, the upper wall 618 and end walls 616 include the round openings and handles described above.

Figure 45:
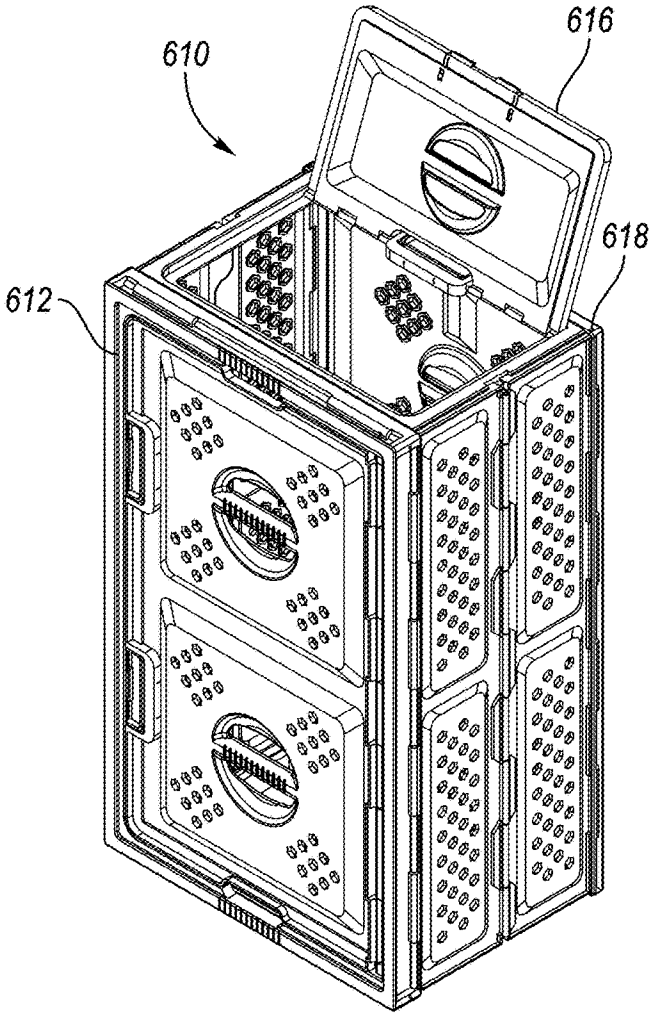
FIG. 45 shows the container of FIG. 43 with an end wall pivoted outward.
Figure 44:
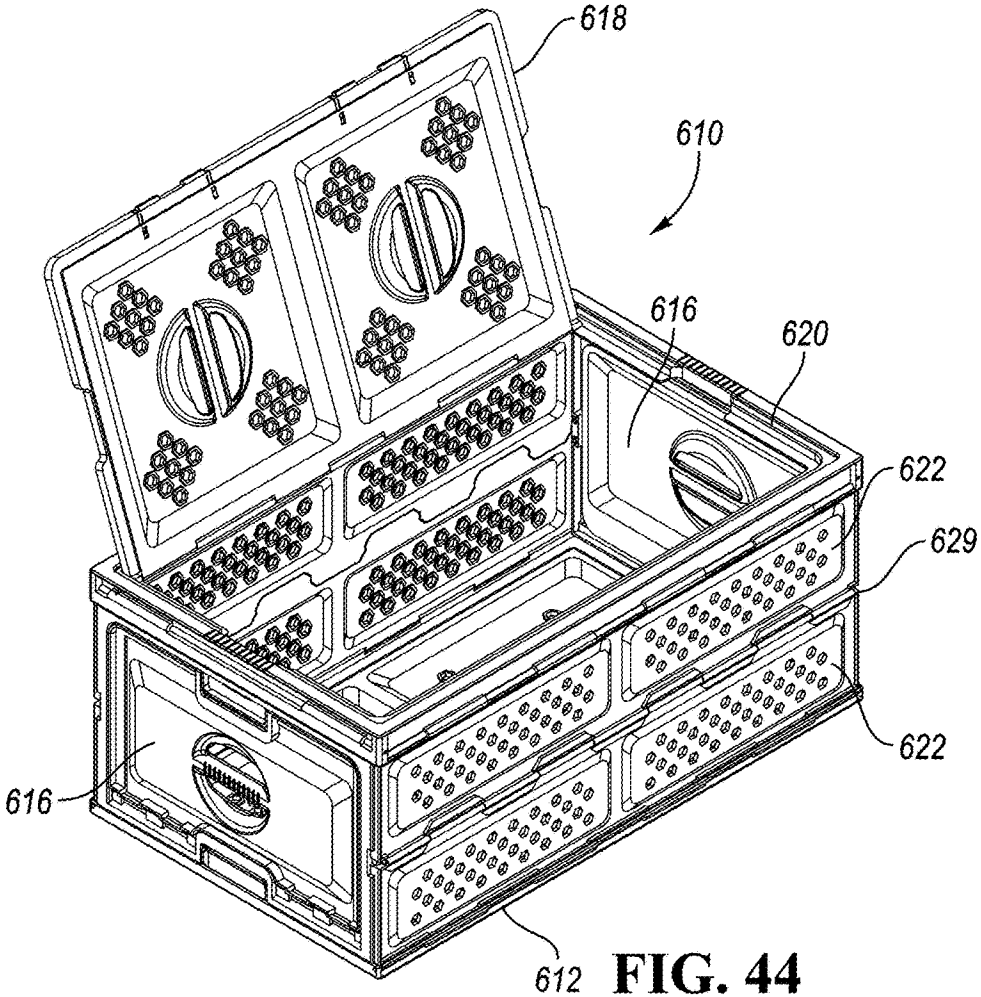
FIG. 44 shows the container of FIG. 43 with the upper wall pivoted upward.

FIG. 44 shows the upper 618 pivoted upward from the upper frame 620 to provide access to the interior of the container 610. FIG. 45 shows one of the end walls 616 pivoted outward to provide access to the interior of the container 610.

Figure 46:
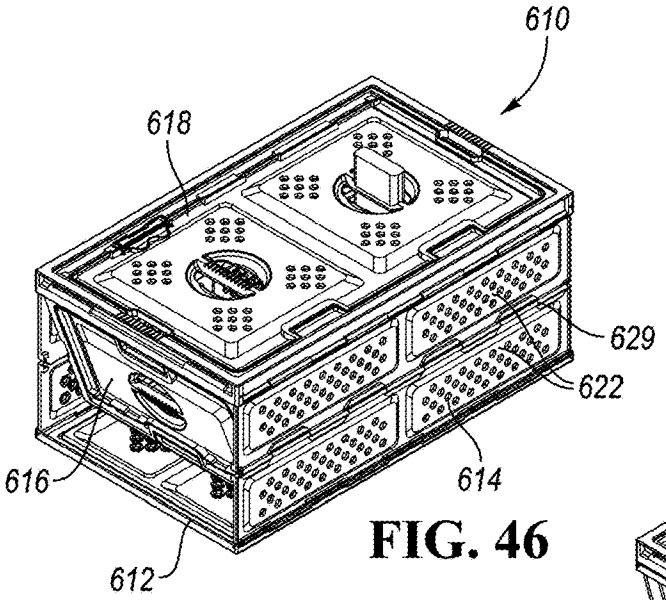
FIGS. 46-48 show a sequence of collapsing the container of FIG. 43.
Figure 47:
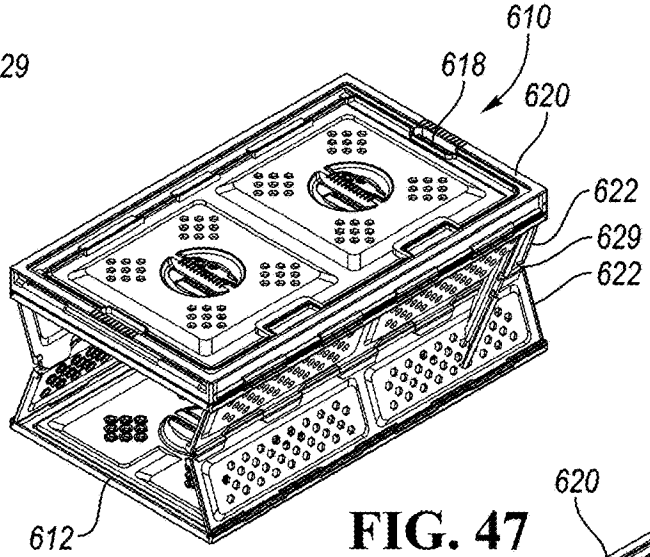
Figure 48:
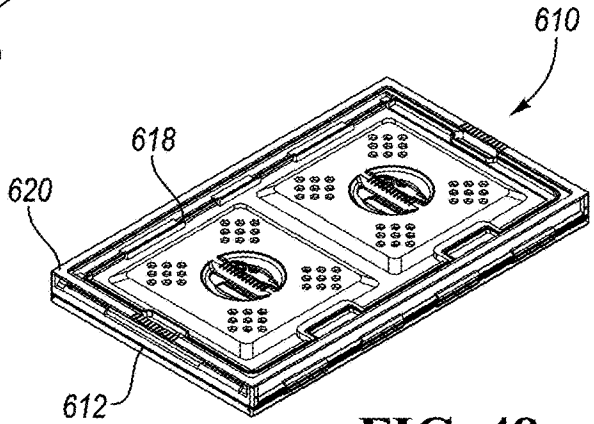
Figure 49:
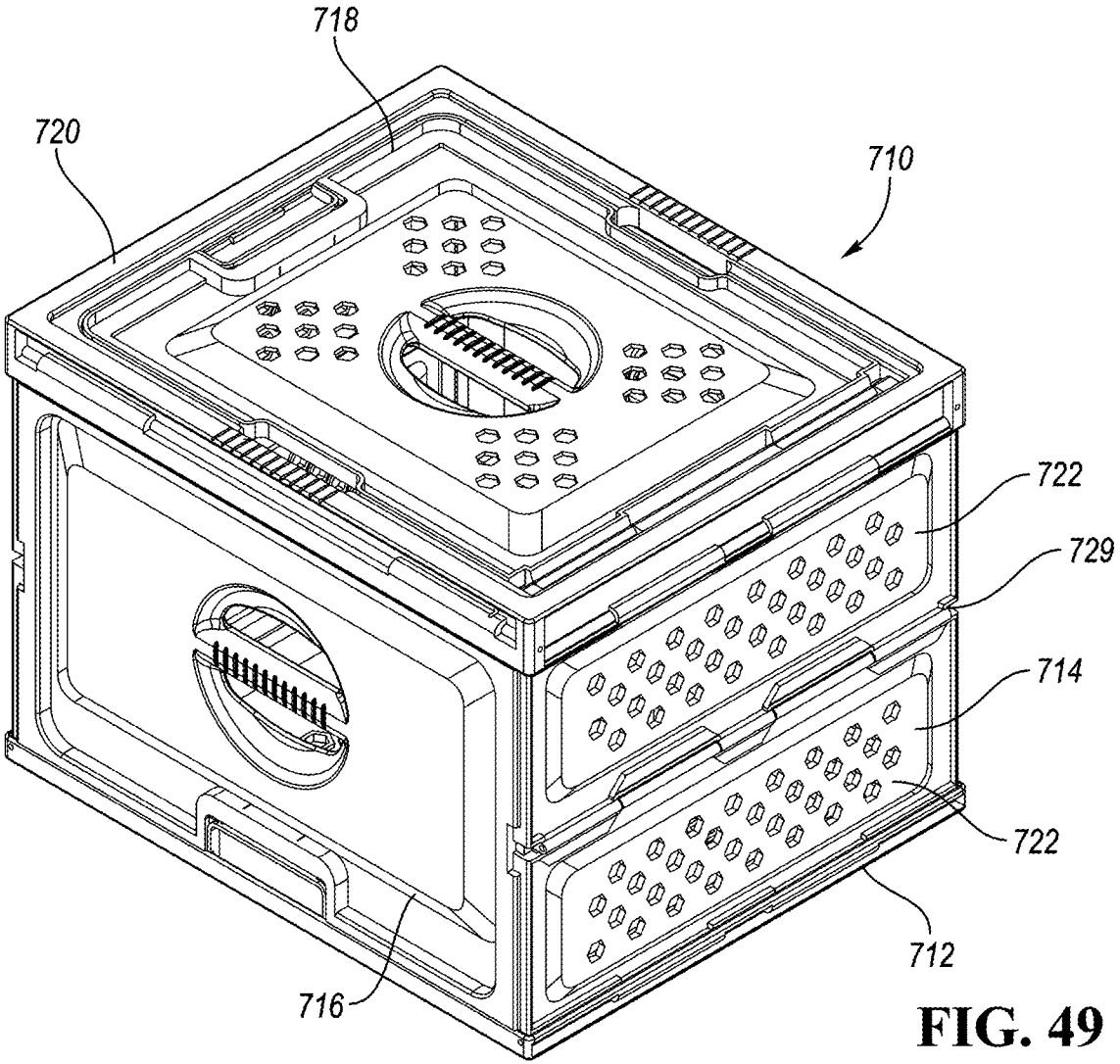
FIG. 49 is a perspective view of a container according to an eighth embodiment.
Figure 50:
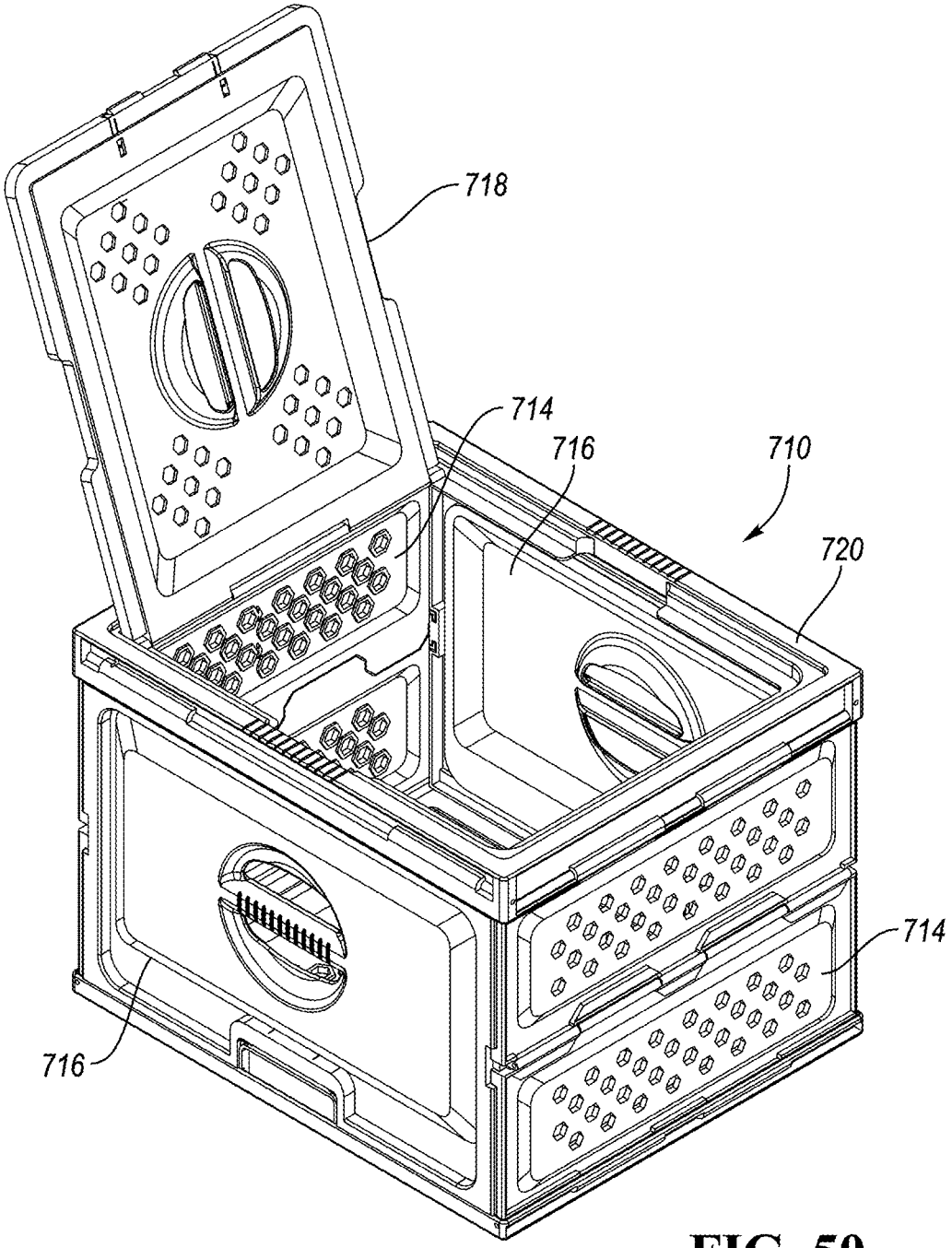
FIG. 50 shows the container of FIG. 49 with the upper wall pivoted upward.
Figure 51:
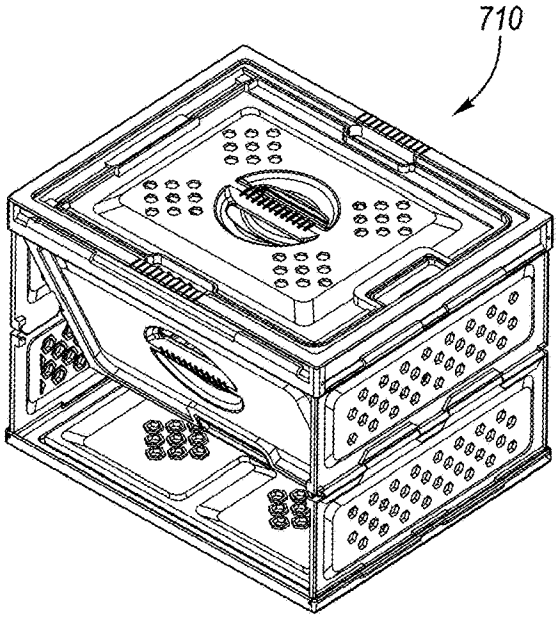
FIGS. 51-53 show a sequence of steps of collapsing the container of FIG. 49.
Figure 52:
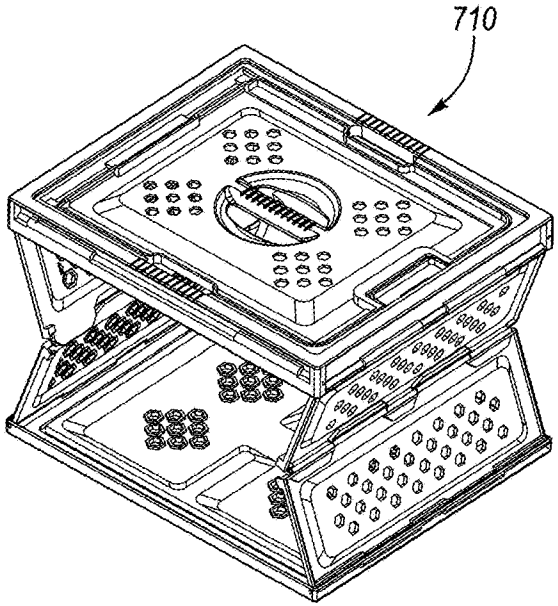
Figure 53:
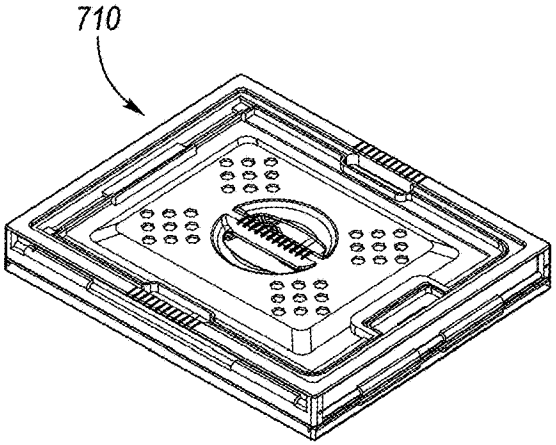

FIGS. 46-48 show a sequence of collapsing the container 610. In FIG. 46, the end walls 616 are pivoted inward (after releasing the latches). This permits the side walls 614 to collapse, with the center hinge 629 and side panels 614 moving inward. This brings the upper wall 618 down onto the base 612 as shown in FIG. 48. In the collapsed position, the container 610 occupies less volume for easy shipping and storage when empty.

FIGS. 49-53 show a container 710 according to an eight embodiment. The container 710 is identical to the container 610 of FIGS. 43-48, except half the size along the side walls 714, upper wall 718 and base 712. The container 710 is compatible with the container 610 in that two of the half-size containers 710 can stack on (or be stacked on by) one of the containers 610.

Figure 56:
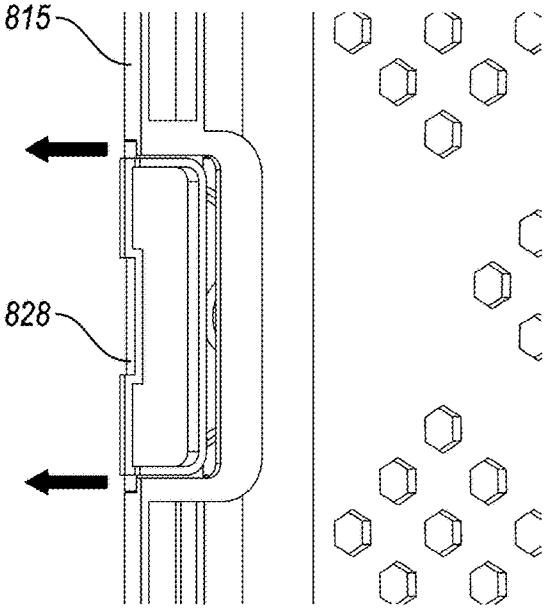
FIG. 56 shows the latch of FIG. 55 in a latched position.
Figure 55:
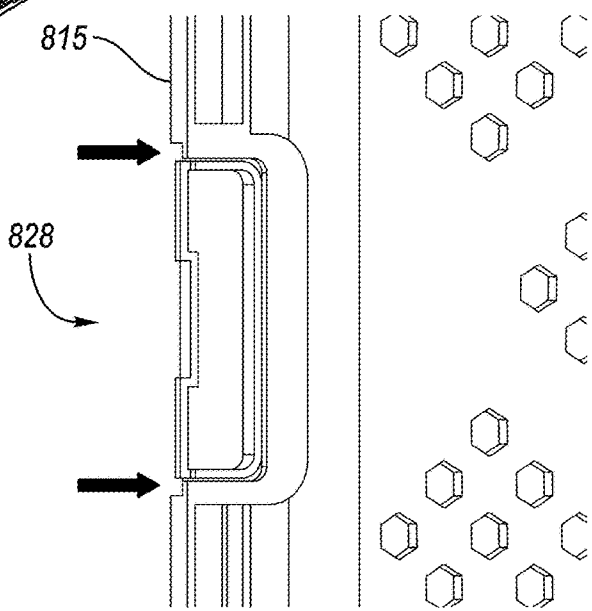
FIG. 55 shows a latch in an unlatched position.
Figure 54:
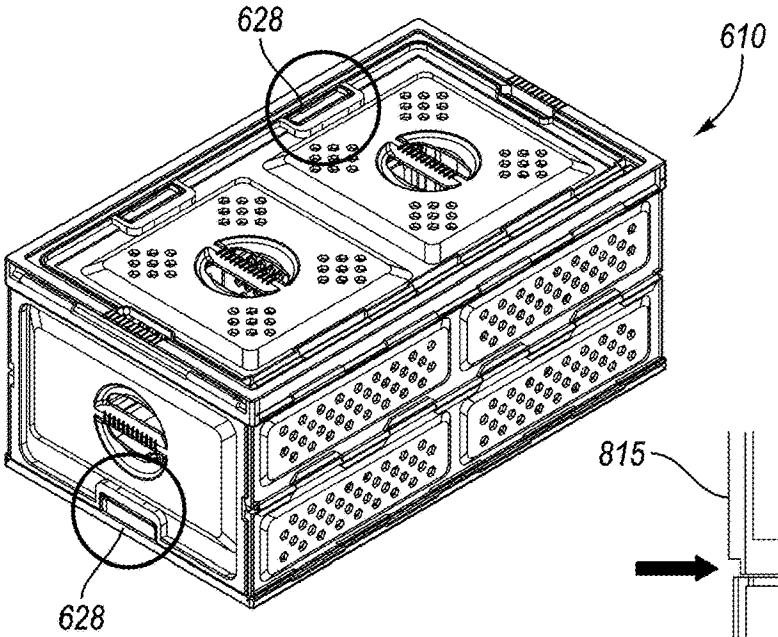
FIG. 54 is a perspective view of the container of FIG. 49.

FIG. 54 shows the container 610 showing the location of the latches 628. FIGS. 55-60 show a latch 828 which could be used as the latch 628 or any of the other latches disclosed above. Referring to FIGS. 55-56, the latch 828 is secured to a wall (generically, wall 815) and movable between a retracted, unlatched position FIG. 55 and an extended, latched position, FIG. 56. The latch 828 is spring biased toward the latched position but may be selectively moved to the unlatched position to release the wall 815 from an adjacent wall.

Figure 58:
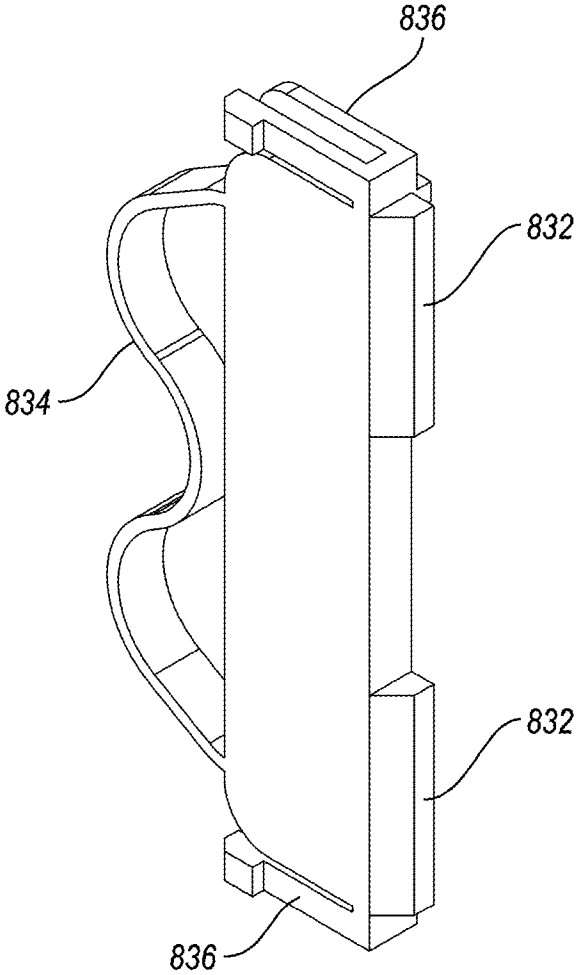
FIG. 58 is an outer perspective view of the latch of FIG. 57.
Figure 60:
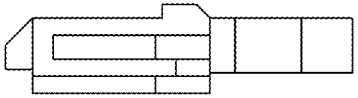
FIG. 60 is an end view of the latch of FIG. 57.
Figure 57:
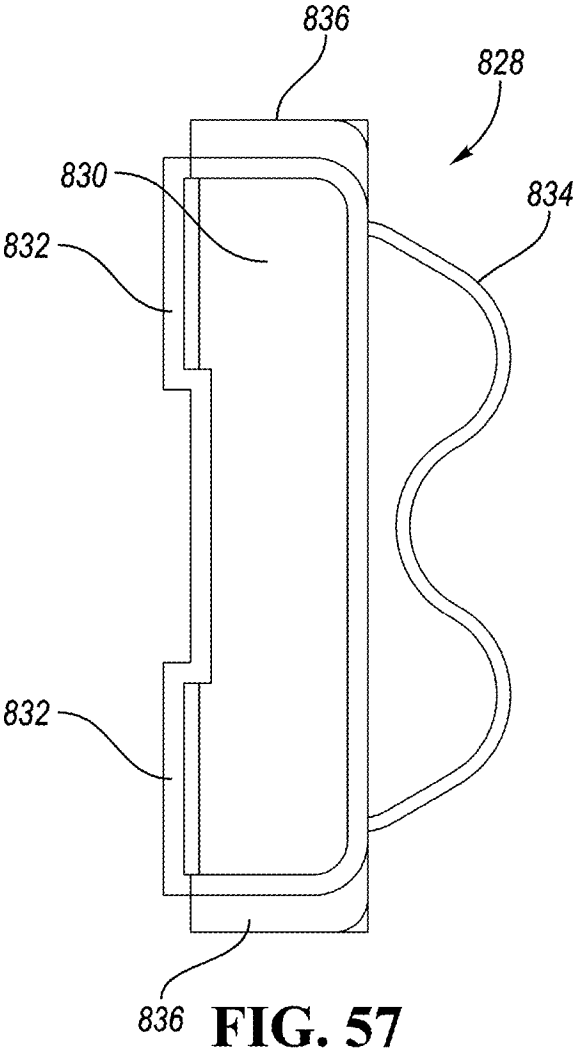
FIG. 57 is a side view of the latch of FIG. 55.
Figure 59:
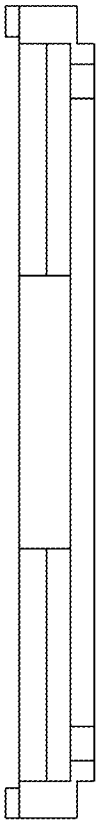
FIG. 59 is an outer view of the latch of FIG. 57.

FIGS. 57-60 show the latch 828. Referring to FIGS. 57-58, the latch 828 includes a body portion having a handle recess 830 on one major surface thereof. Tapered projections 832 project from an outer edge of the latch 828. An integral spring band 834 protrudes from an opposite inner edge of the latch 828. As shown, the spring band 834 may be a flexible, resilient band extending from an upper edge of the inner edge of the latch 828 along a serpentine path to a lower edge of the inner edge of the latch 828 (attached integrally at both ends). Upper and lower ends of the latch 828 include tracks 836 that can be snap-fit into the wall 815 (FIG. 57) to permit the latch 828 to move only between the latched and unlatched positions. The latch 828 is injection molded as a single piece of a suitable plastic.

Figure 61:
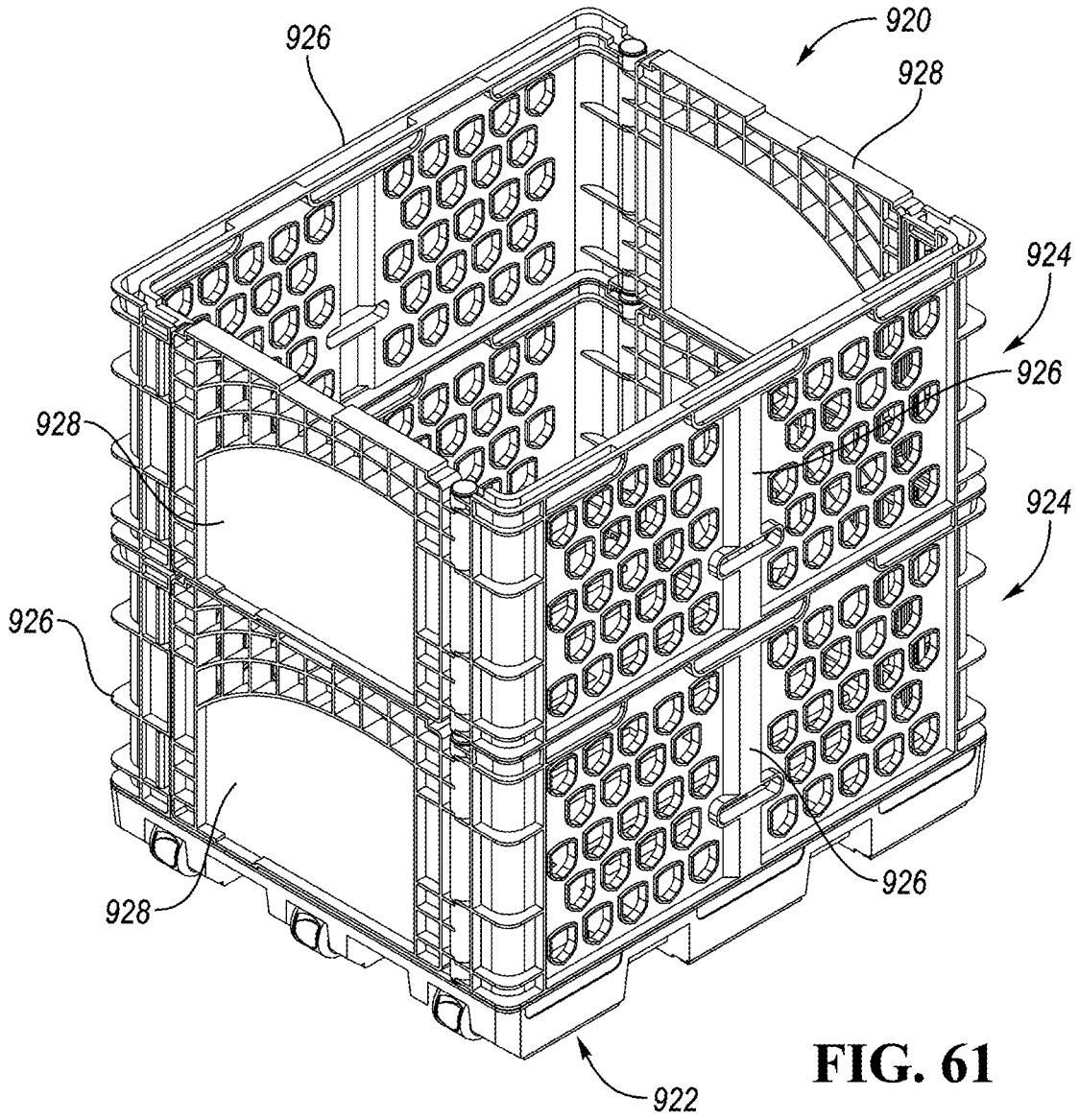
FIG. 61 is a perspective view of a collapsible container according to another embodiment.

FIG. 61 illustrates a container assembly 920. The container assembly 920 includes a pallet assembly 922 forming a base and wall assemblies 924 forming walls of the container assembly 920. Each of the wall assemblies 924 include sidewalls 926 that pivotally connect with end wall doors 928.

Figure 62:
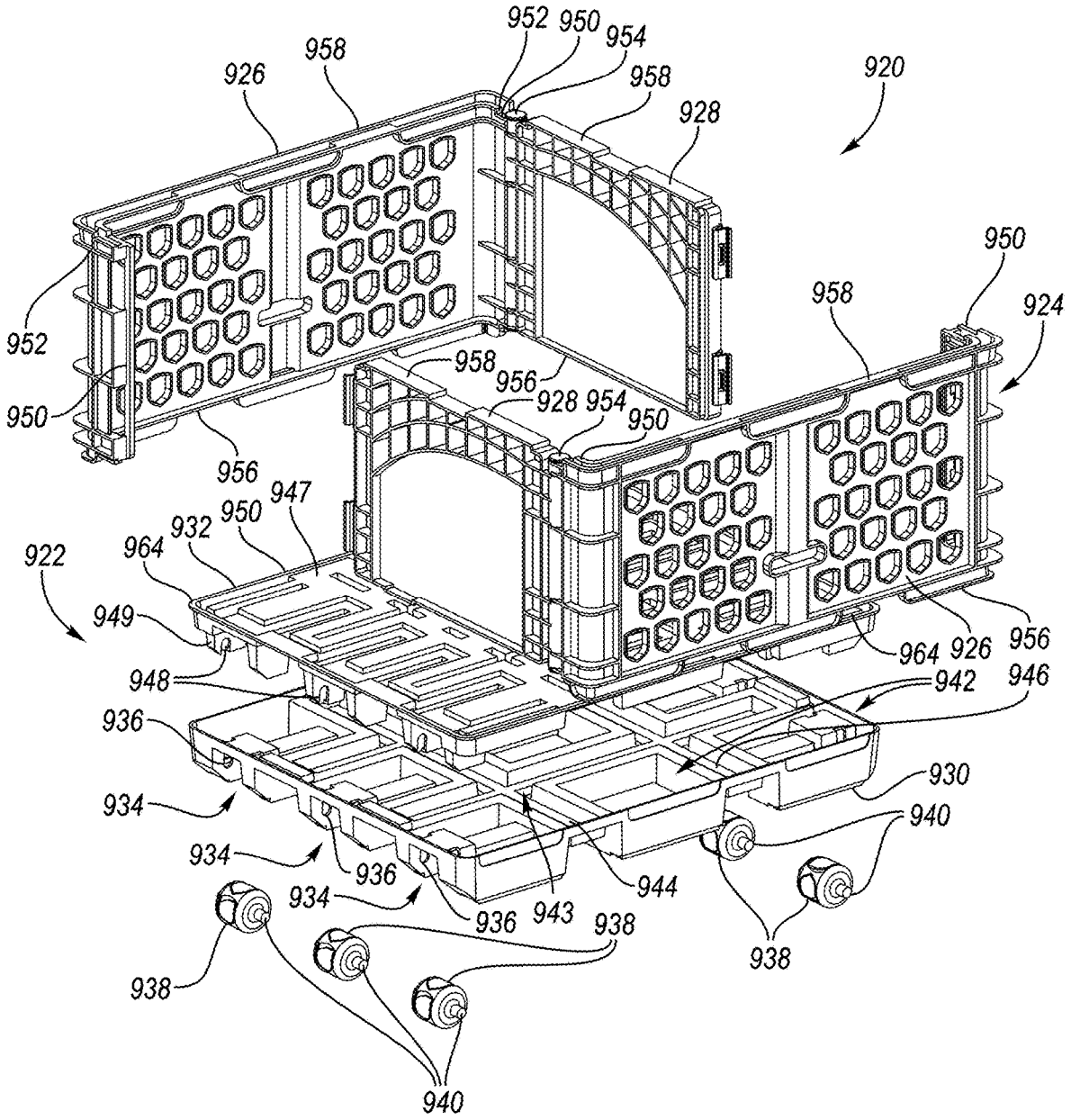
FIG. 62 is an exploded view of the container assembly of FIG. 61.
Figure 64:
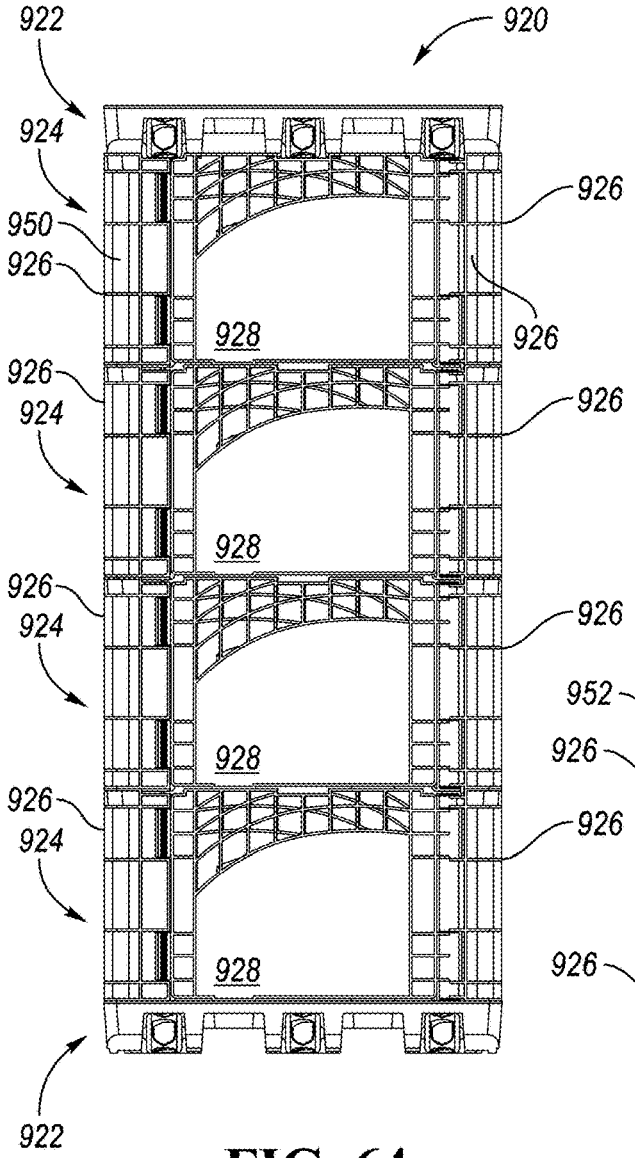
FIG. 64 shows one configuration of the container of FIG. 61 with additional wall assemblies stacked thereon.
Figure 65:
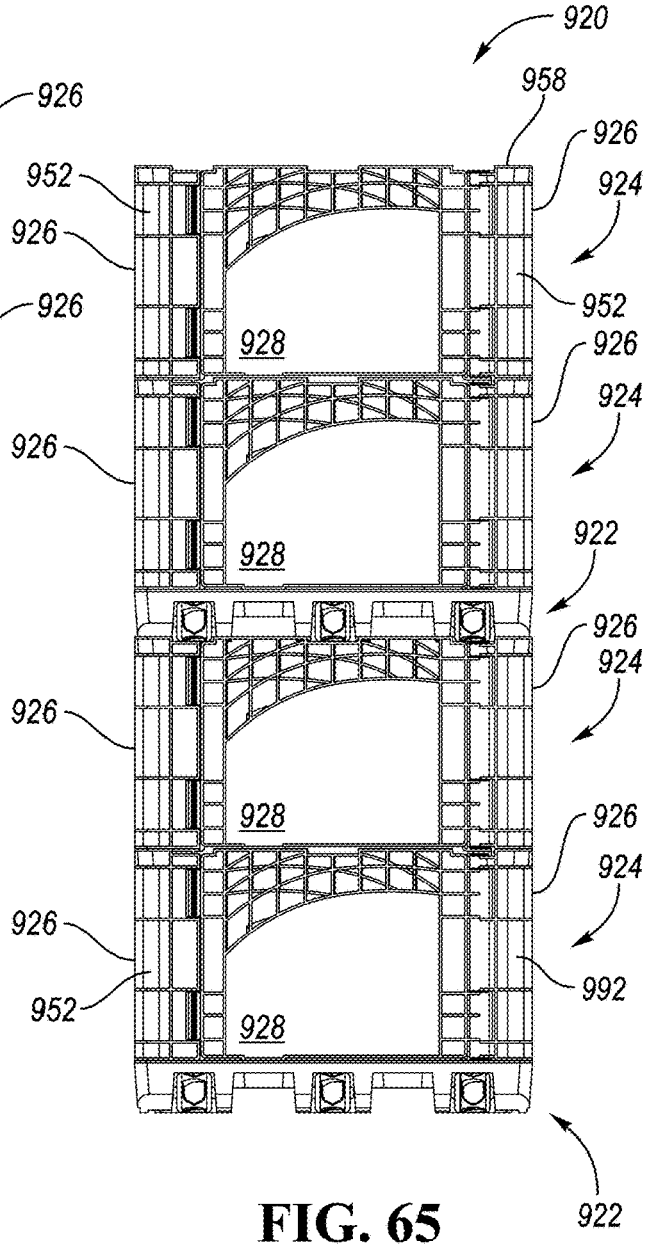
FIG. 65 shows another alternate configuration of the container of FIG. 51.

FIG. 62 illustrates an exploded view of the container assembly 920 with a single wall assembly 924 positioned relative to the pallet assembly 922. The pallet assembly 922 includes a lower portion 930 and an upper portion 932. The lower portion 930 includes wheel recesses 934 along end walls. The wheel recesses 934 include axle openings 936 for accepting axles 940 on a respective one of a plurality of wheels 938. The lower portion 930 includes a plurality of rectangular segments 942 that form a grid. The rectangular segments 942 define an inner trough 943 on an upper side of the lower portion 930. The inner trough 943 includes a structural rib 944 configured in an intersecting pattern. The lower portion 930 is also configured to stack on top of the wall assemblies 24 as shown in FIGS. 64 and 65.

The upper portion 932 of the pallet assembly 922 includes an upper surface 947 for supporting goods thereon and a lower surface 949 having axial openings 948 for also accepting the axles 940 of the wheels 938. The upper portion 932 includes a perimeter 950 at least partially defining receptacles 964 configured to accept a lower edge 956 of the wall assemblies 924.

The wall assemblies 924 include a pair of flanges 952 with one of the pair of flanges 952 located on each opposite end of the sidewall 926. One of the flanges 952 is pivotally connected with the end wall doors 928 through a hinge 954. The hinge 954 allows the end wall doors 928 to pivot relative to the flanges 952 on the sidewalls 926. The wall assemblies 924 also include an upper edge 958 for accepting another wall assembly 924 as shown in FIG. 61 or for accepting another pallet assembly 922 as shown in FIGS. 64 and 65.

Figure 63:
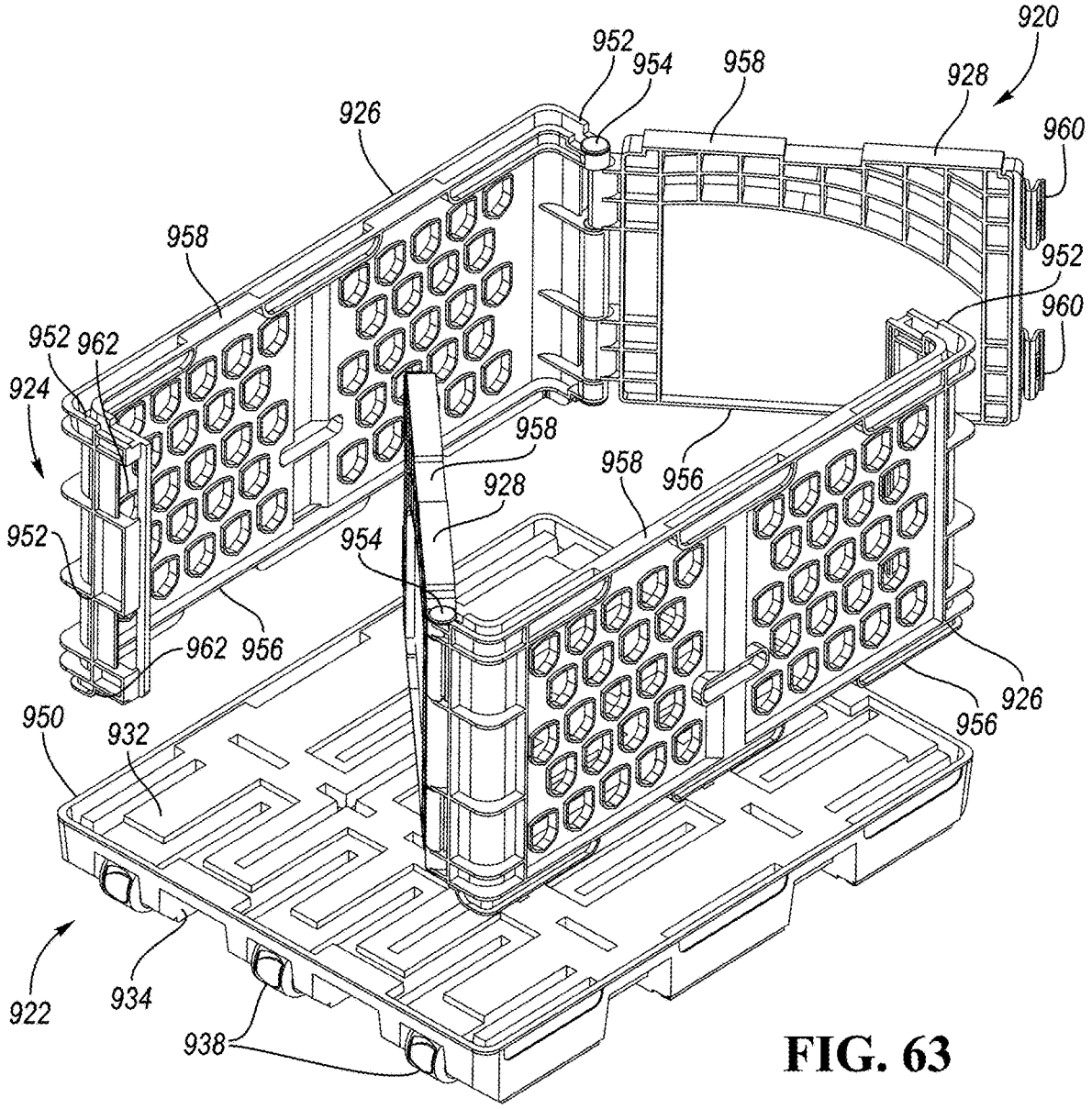
FIG. 63 is a partially exploded view of the container of FIGS. 61, showing the pivoting of the end wall doors.

FIG. 63 illustrates the end wall doors 928 pivoted relative to the sidewalls 926. In the illustrated example of FIG. 63, the end wall doors 928 may pivot inwards or outwards. The end wall doors 928 also include latches 960 located on an opposite edge of the end wall door 928 from the hinge 954. The flange 952 on the sidewalls 926 that is opposite the hinge 954 includes a latch receptacle 962 for accepting the latches 960 on the end wall doors 928 and fixing the end wall doors 928 from moving relative to the sidewalls 926.

FIGS. 64 and 65 illustrate different stacking arrangements for the pallet assemblies 922 and the wall assemblies 924. As shown in FIG. 64, the container assembly 920 includes a pallet assembly 922 at its base with four wall assemblies 924 stacked thereon with an additional pallet assembly 922 stacked on the uppermost wall assembly 924. The uppermost pallet assembly 922 functions as a lid for the container assembly 920 or as a support surface for stacking more goods thereon.

FIG. 65 illustrates a pallet assembly 922 forming the base of the container assembly 920 with two wall assemblies 924 stacked thereon. An additional pallet assembly 922 is stacked on the lower two wall assemblies 924 with two additional wall assemblies 924 stacked on the uppermost of the two pallet assemblies 922. In the illustrated example, the uppermost wall assembly 924 does not include a pallet assembly 922, such that the upper two wall assembly 924 form an open storage space. However, another pallet assembly 922 could be located on the uppermost wall assembly 924.

Figure 66:
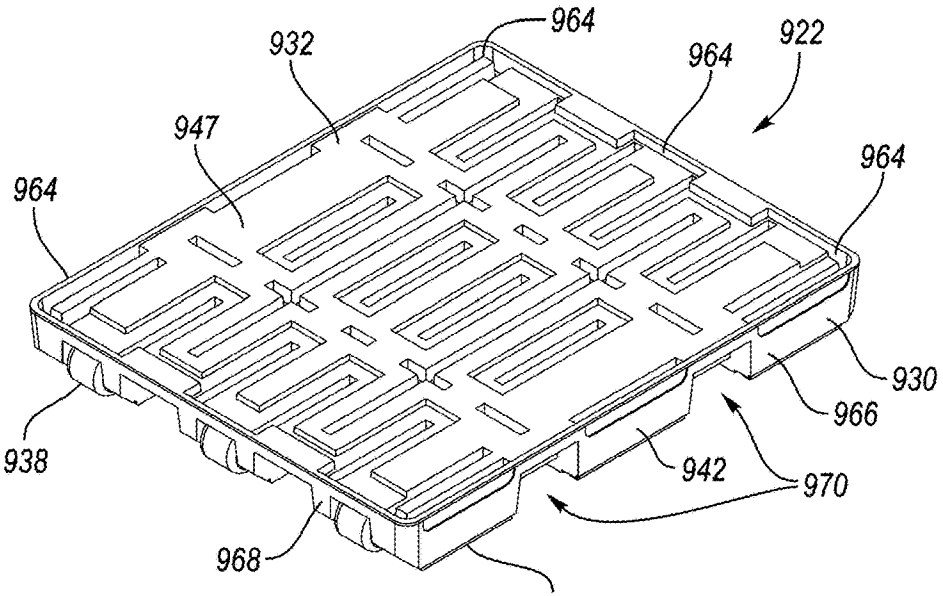
FIG. 66 is a perspective view of the pallet assembly of the container assembly of FIG. 61.

FIG. 66 illustrates a perspective view of the pallet assembly 922. The pallet assembly 922 includes the upper surface 947 for supporting goods thereon and the perimeter 950 of the pallet assembly 922 defines the receptacles 964 for accepting the wall assemblies 924.

Figure 67:
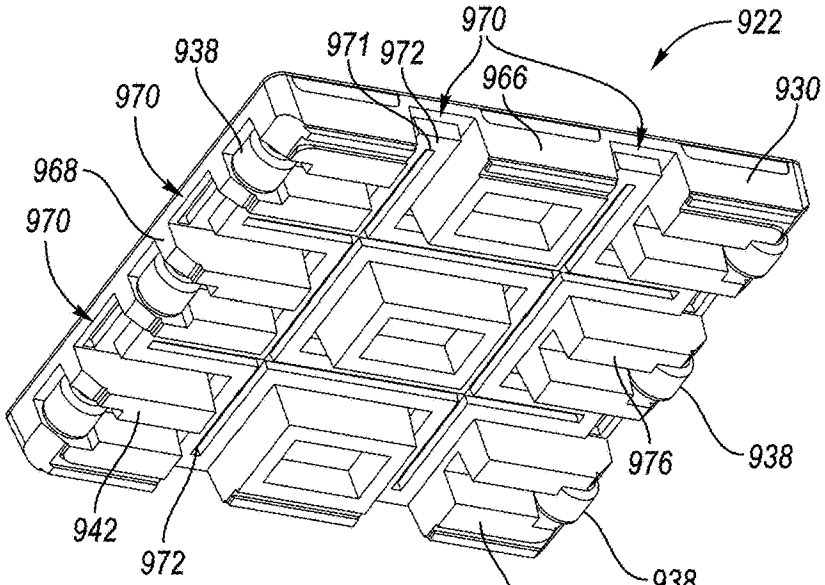
FIG. 67 is a bottom perspective view of the pallet assembly of FIG. 66.
Figure 69:
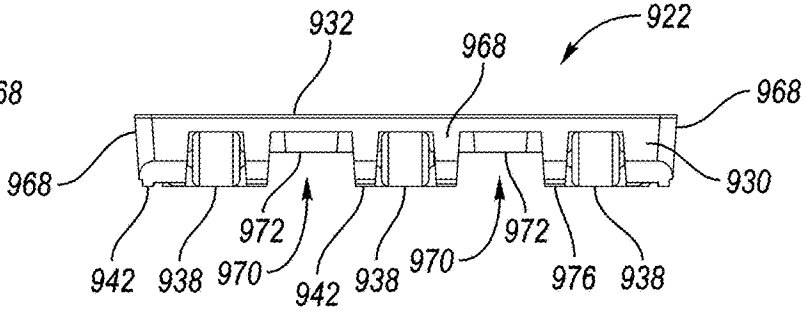
FIG. 69 is a front view of the pallet assembly of FIG. 66.
Figure 68:
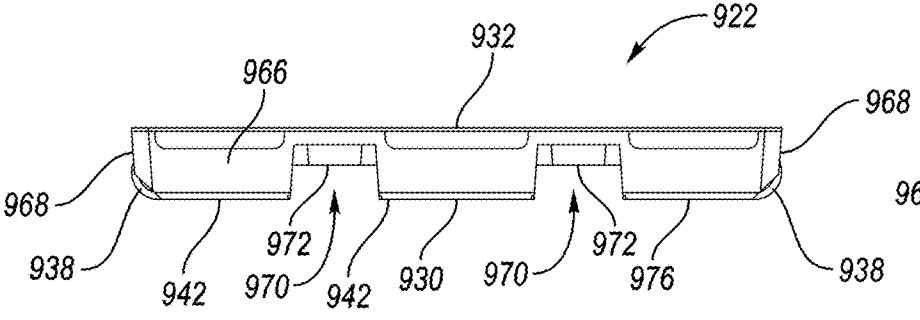
FIG. 68 is a side view of the pallet assembly of FIG. 66.

FIG. 67 illustrates a bottom perspective view of the pallet assembly 922. As shown in FIG. 67, the lower portion 930 is divided into the rectangular segments 942. In the illustrated example, the plurality of rectangular segments 942 are arranged in a three by three orientation. The three by three orientation of the rectangular segments 942 allows the sidewalls 966 and end walls 968 to each define two longitudinal trough 970 therethrough. The longitudinal troughs 970 include an upper surface 972 having a recess 971 that is defined by the structural rib 944 on the opposite side of the lower portion 930. As shown in FIGS. 68 and 69, the longitudinal troughs 970 extend uninterrupted between rectangular segments 942.

Figure 70:
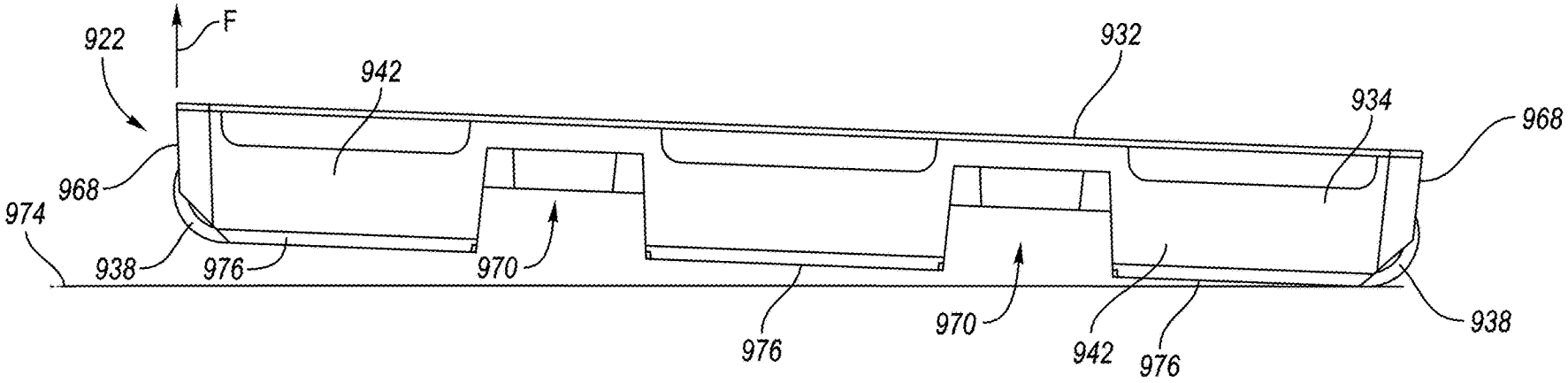
FIG. 70 shows the pallet assembly of FIG. 66 with one end lifted to bring the wheels into contact with the floor.

FIG. 70 illustrates the pallet assembly 922 with the wheels 938 along one of the end walls 968 engaging a working surface 974, such as a floor. As shown in FIG. 70, a lower contact surface 976 of the pallet assembly 922 is located below the wheels 938. This allows the pallet assembly 922 to sit flush against the working surface 974 without engaging the wheels 938 on the working surface 974. When a force is applied to the pallet assembly 922 in the direction F, the pallet assembly 922 tilts upward along one end wall 968 and engages the wheels 938 along an opposite end wall 968. When the pallet assembly 922 is tilted, the pallet assembly 922 and any wall assemblies 924 and goods stacked thereon are easily moved along the working surface 974.

Figure 71:
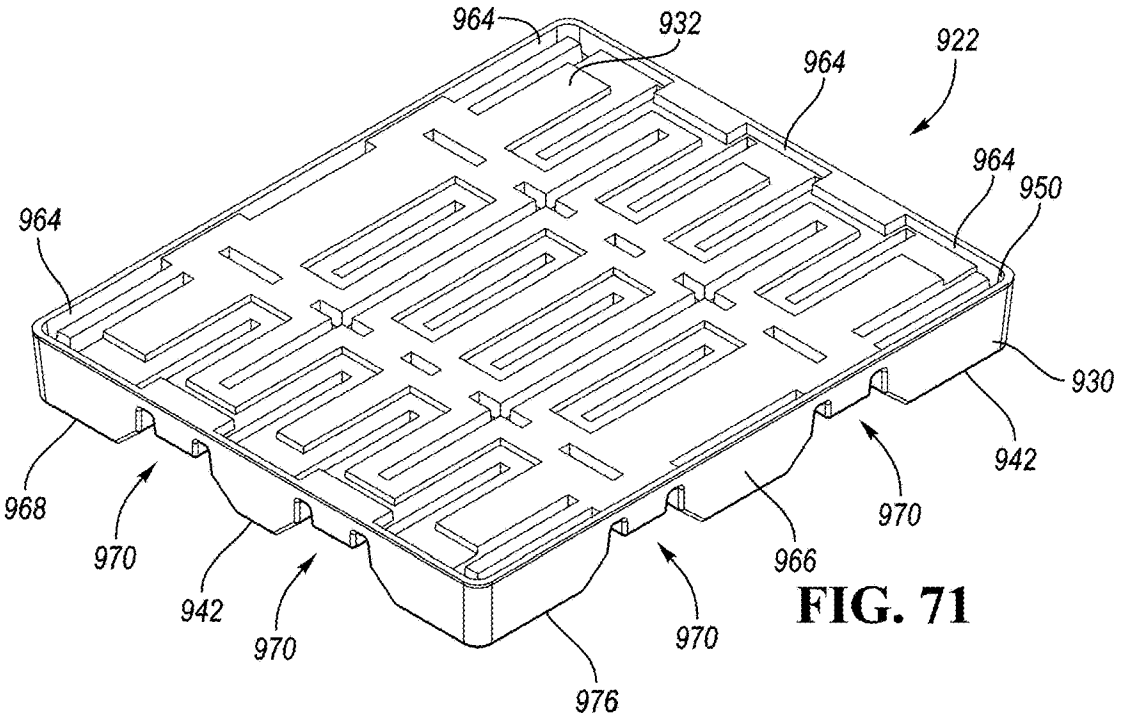
FIG. 71 is a perspective view of a pallet assembly according to another embodiment.

FIG. 71 illustrates another example pallet assembly 1122. The pallet assembly 1122 is similar to the pallet assembly 922 except where described below or shown in the Figures. Like numbers will be used to identify similar elements with 11xx corresponding to 9xx in the previous embodiment.

Figure 73:
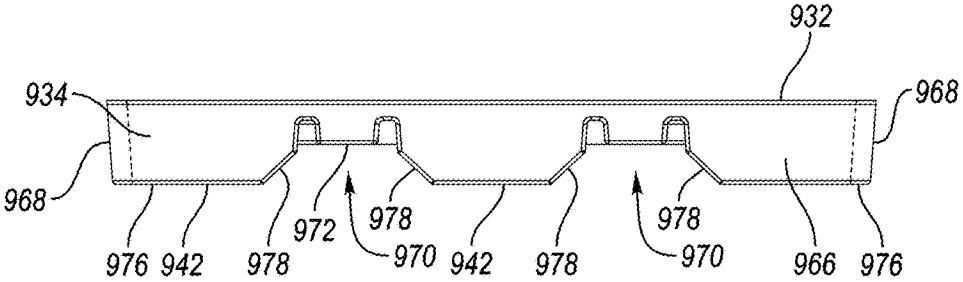
FIG. 73 is an end view of the pallet assembly of FIG. 71.
Figure 72:
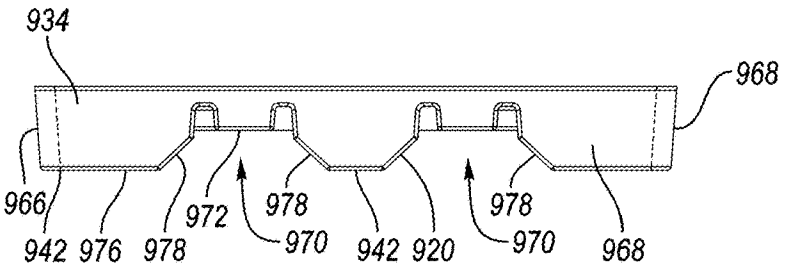
FIG. 72 is a side view of the pallet assembly of FIG. 1.

The pallet assembly 1122 includes a lower portion 1130 and an upper portion 1132. The upper portion 1132 includes a perimeter 1150 at least partially defining recesses 1164 for accepting the wall assembly 924. Unlike the pallet assembly 922, the pallet assembly 1122 does not include any wheels. But the lower portion 1130 of the pallet assembly 1122 does include a plurality of rectangular segments 1142 that at least partially define longitudinal troughs 1170. The longitudinal troughs 1170 extend uninterrupted between pairs of sidewalls 1166 and end walls 1168. The rectangular segments 1142 include a chamfered edge 1178 along the trough 1170. The troughs 1170 extend from a lower support surface 1176 of the base towards an upper surface 1172 of the troughs 1170. As shown in FIGS. 72 and 73, the troughs 1170 extend uninterrupted between the rectangular segments 1142 and between the sidewalls 1166 and the end walls 1168.

FIGS. 74 through 79 illustrate yet another example pallet assembly 1222. The pallet assembly 1222 is similar to the pallet assembly 922 except where described below or shown in the Figures. Like elements between the pallet assembly 1222 and the pallet assembly 922 will be referenced with 12xx to correspond to 9xx.

Figure 77:
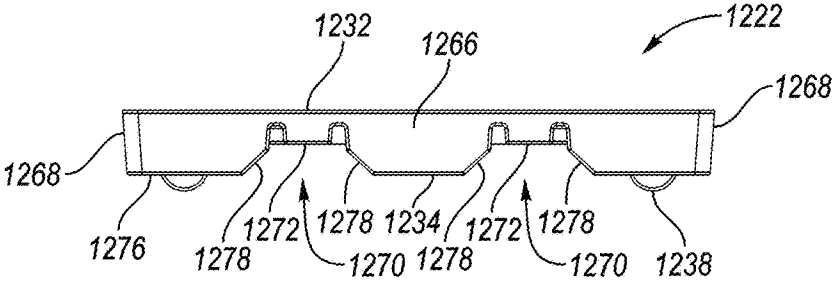
FIG. 77 is a side view of the pallet assembly of FIG. 74.
Figure 76:
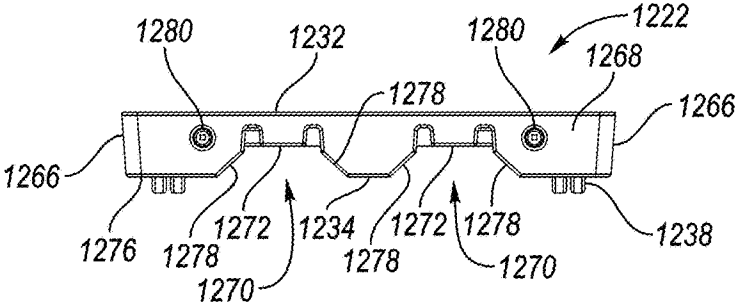
FIG. 76 is a front view of the pallet assembly 74.

The pallet assembly 1222 includes a lower portion 1230 and upper portion 1232. The upper portion 1232 includes a perimeter 1250 at least partially defining recesses 1264 for accepting the wall assembly 924. The lower portion 1230 of the pallet assembly 1222 includes a plurality of rectangular segments 1242 that at least partially define longitudinal troughs 1270. The longitudinal troughs 1270 extend uninterrupted between pairs of sidewalls 1266 and end walls 1268. The rectangular segments 1242 include a chamfered edge 1278 along the troughs 1270. The troughs 1270 extend from a lower support surface 1276 of the base towards an upper surface 1272 of the troughs 1270. As shown in FIGS. 76 and 77, the troughs 1270 extend uninterrupted between the rectangular segments 1242 and between the sidewalls 1266 and the end walls 1268.

Figure 75:
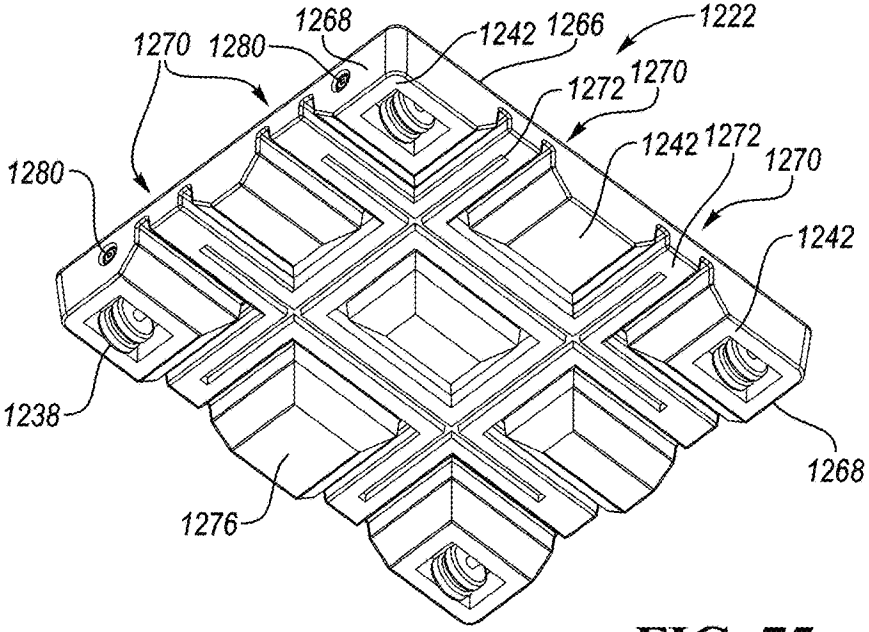
FIG. 75 is a bottom perspective view of the pallet assembly of FIG. 74.
Figure 74:
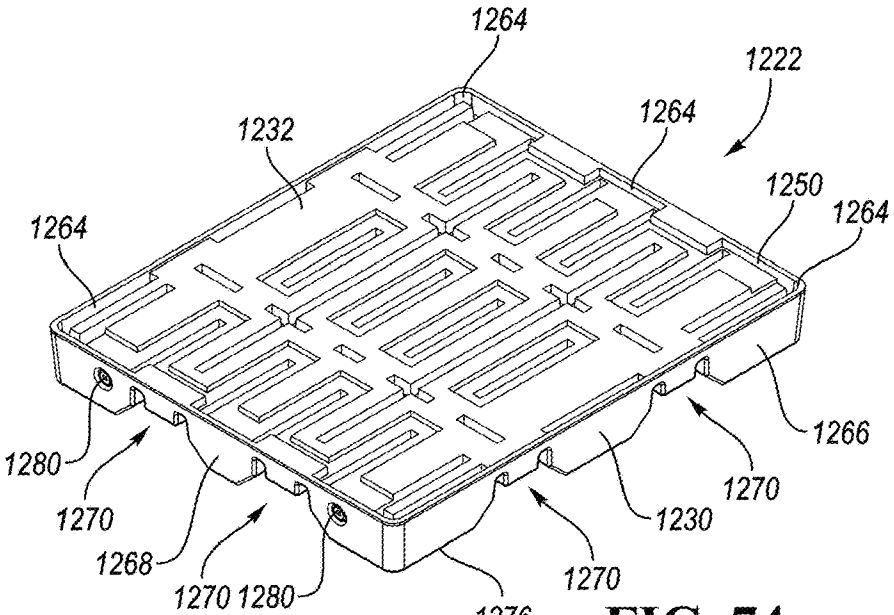
FIG. 74 is a perspective view of a pallet assembly according to another embodiment.
Figure 78:
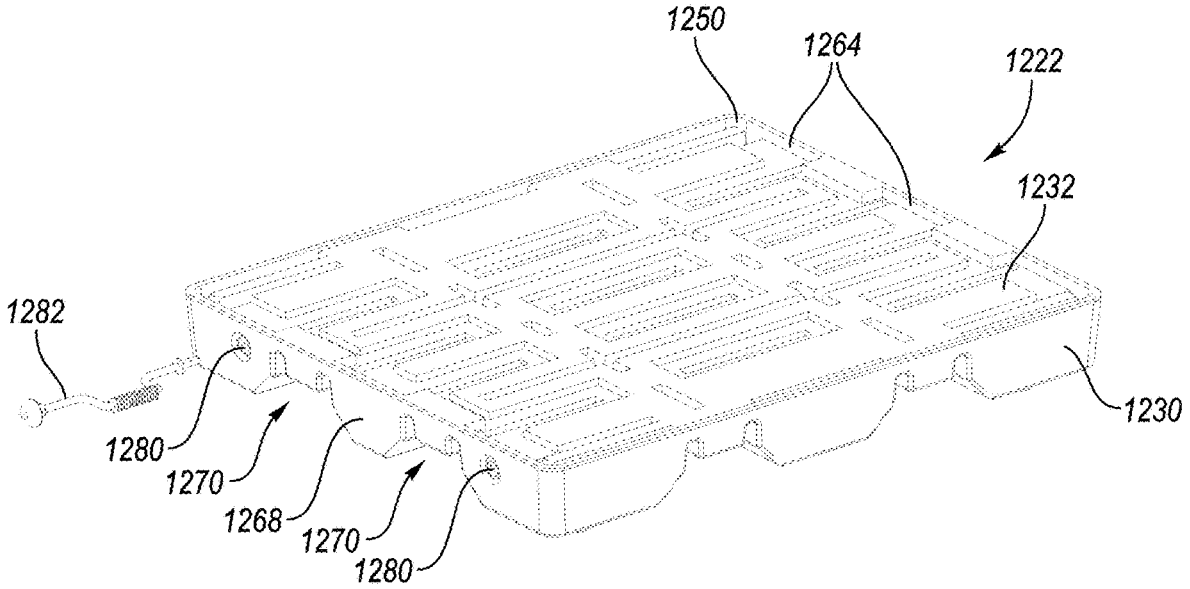
FIG. 78 is a perspective view of the pallet assembly of FIG. 74 and a tool for raising and lowering the wheels.
Figure 79:
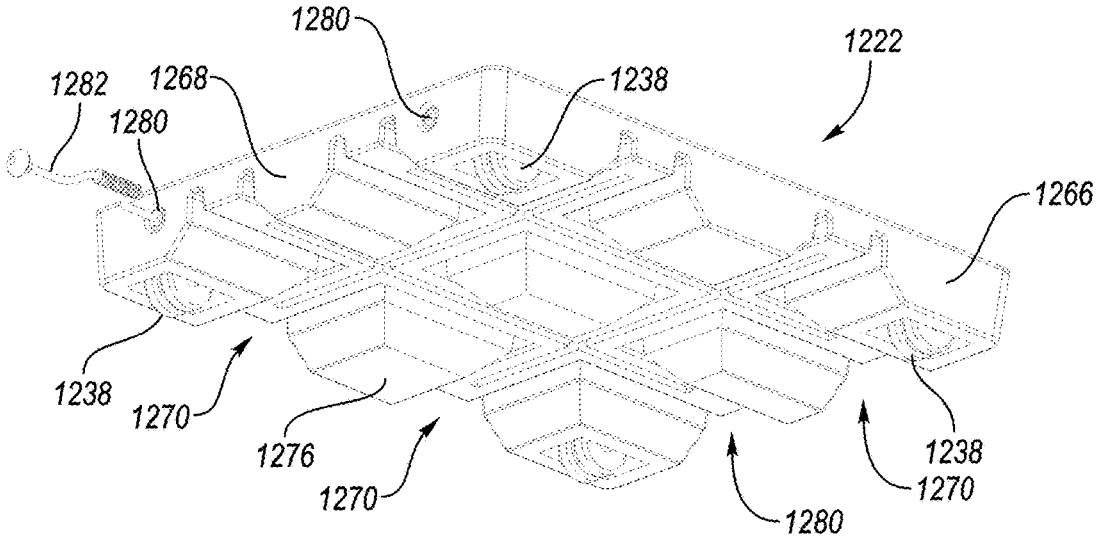
FIG. 79 shows the pallet assembly and tool of FIG. 78, with the tool engaging the pallet assembly.

As shown in FIGS. 75-77, the pallet assembly 1222 includes a plurality of wheels 1238. In the illustrated example, the wheels 1238 are located in one of the rectangular segments 242 located at an intersection of the sidewalls 1266 and the end walls 1268. The wheels 1238 are retractable. As shown in FIGS. 78 and 79, the pallet assembly 1222 includes a lift receptacle 1280 for accepting a tool 1282 that engages the lift receptacle 1280. The lift receptacle 1280 is mechanically connected with an internal jack assembly that raises and lowers the wheels 1238 when a user rotates the tool 1282 in the lift receptacle 1280 in a first and second rotational direction, respectively. When the wheels 1238 are in a fully retracted position, the lower support surface 1276 of the pallet assembly 1222 sits flush on a working surface. The pallet assembly 1222 can then be raised by engaging the internal jack assembly by rotating the tool 1282 located in the lift receptacle 1280.

Figure 80:
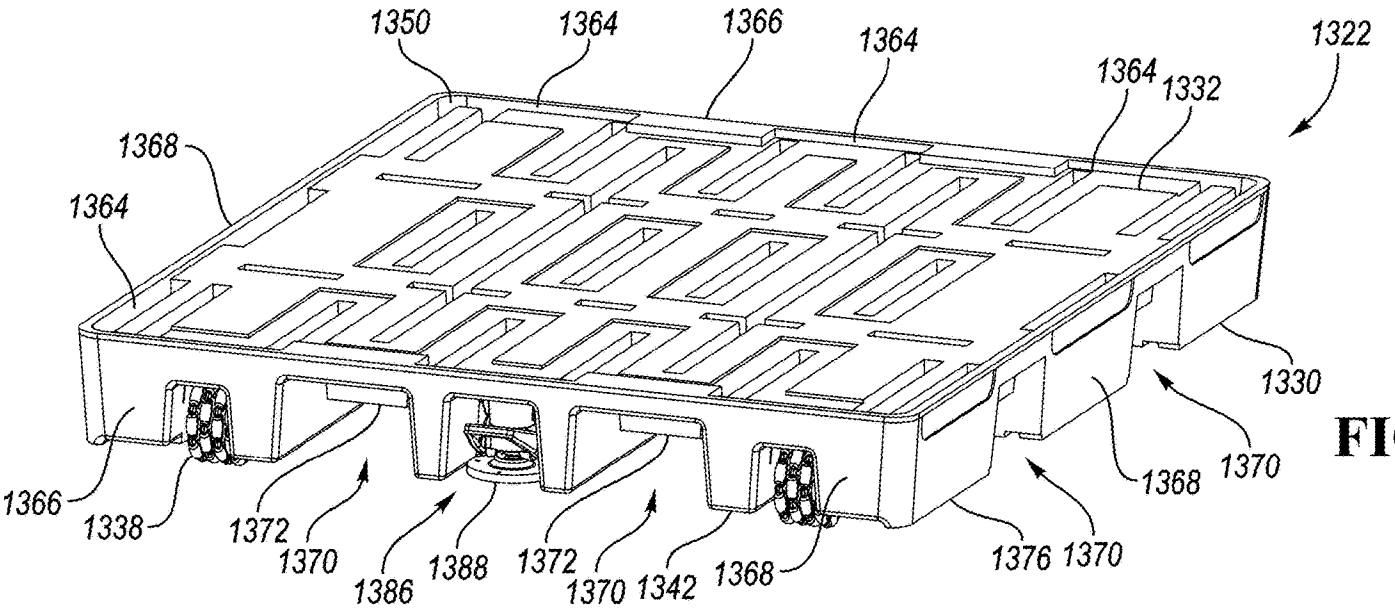
FIG. 80 is a perspective view of a pallet assembly according to another embodiment with a jack in a stowed position.
Figure 81:
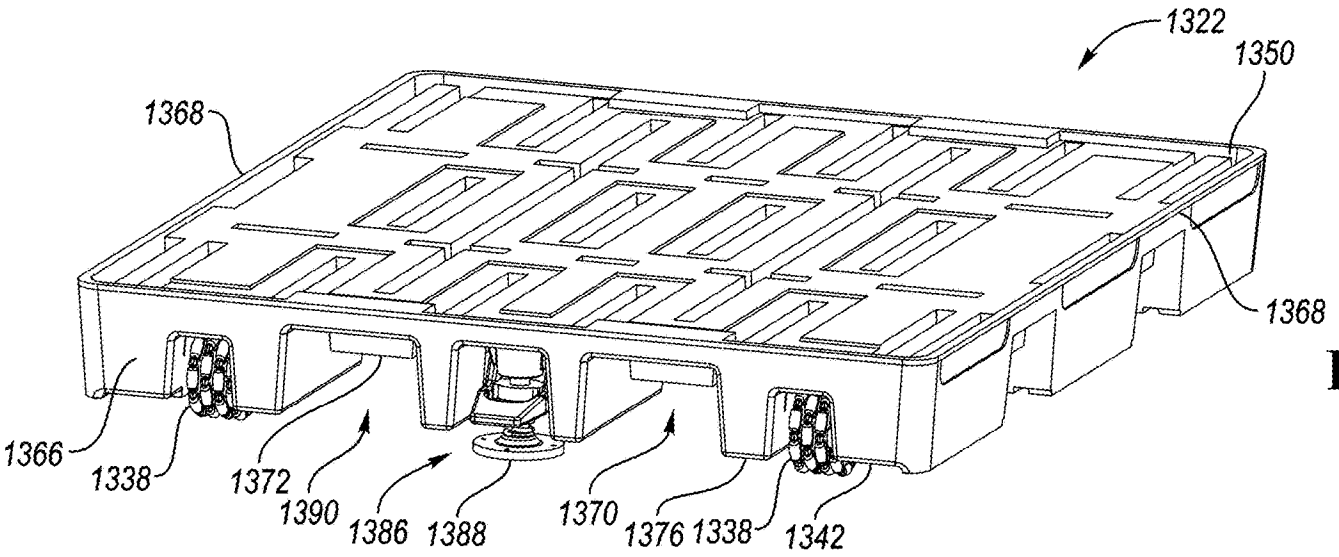
FIG. 81 shows the pallet assembly of FIG. 80 with the jack in the deployed position.

FIGS. 80 and 81 illustrate a further example pallet assembly 1322. The pallet assembly 1322 is similar to the pallet assembly 922 except where described below or shown in the Figures. Like numbers will be used to between the pallet assembly 1322 and the pallet assembly 922 with 13xx to identify similar structure.

The pallet assembly 1322 includes a lower portion 1330 connected to an upper portion 1332. The pallet assembly 1322 includes a perimeter recess 1350 at least partially defining recesses 1364 for accepting the wall assembly 924. The lower portion 1330 of the pallet assembly 1322 includes a plurality of rectangular segments 1342 that at least partially define longitudinal troughs 1370. The longitudinal troughs 1370 extend uninterrupted between pairs of sidewalls 1366 and end walls 1368. The troughs 1370 extend from a lower support surface 1376 of the base towards an upper surface 1372 of the troughs 1370. As shown in FIGS. 76 and 77, the troughs 1370 extend uninterrupted between the rectangular segments 1342 and between the sidewalls 1366 and the end walls 1368.

The pallet assembly 1322 includes wheels 1338 that swivel and rotate relative to the pallet assembly 1322 to allow the pallet assembly 1322 to move in multiple directions. The pallet assembly 1322 includes a jack receptacle 1386 in the lower portion 1330 for accepting a jack 1388. In the illustrated example, each of the sidewalls 1366 include a corresponding jack receptacle 1386. The jack 1388 is moveable between a stowed position in FIG. 80 and a deployed position in FIG. 81. The stowed position allows the pallet assembly 1322 to move freely on the wheels 1338. Conversely, when in the deployed position, the jack 1388 engages the working surface 974 to prevent the pallet assembly 1322 from moving on the wheels 1338.

Figure 83:
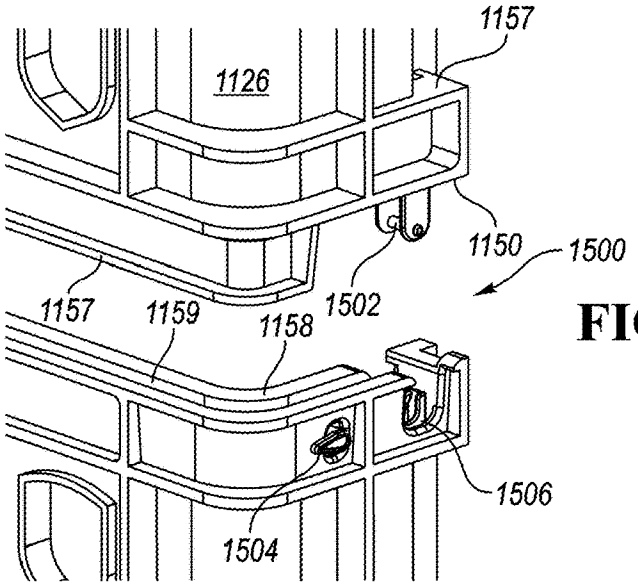
FIG. 83 illustrates the engagement of a pair of stacked wall assemblies.
Figure 84:
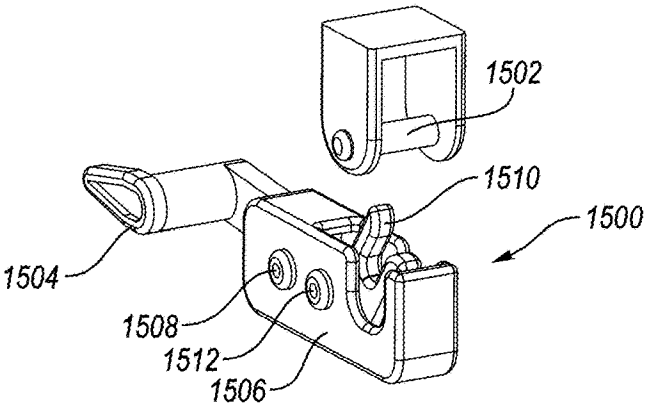
FIG. 84 shows a latch mechanism for connecting the wall assemblies of FIG. 83.
Figure 82:
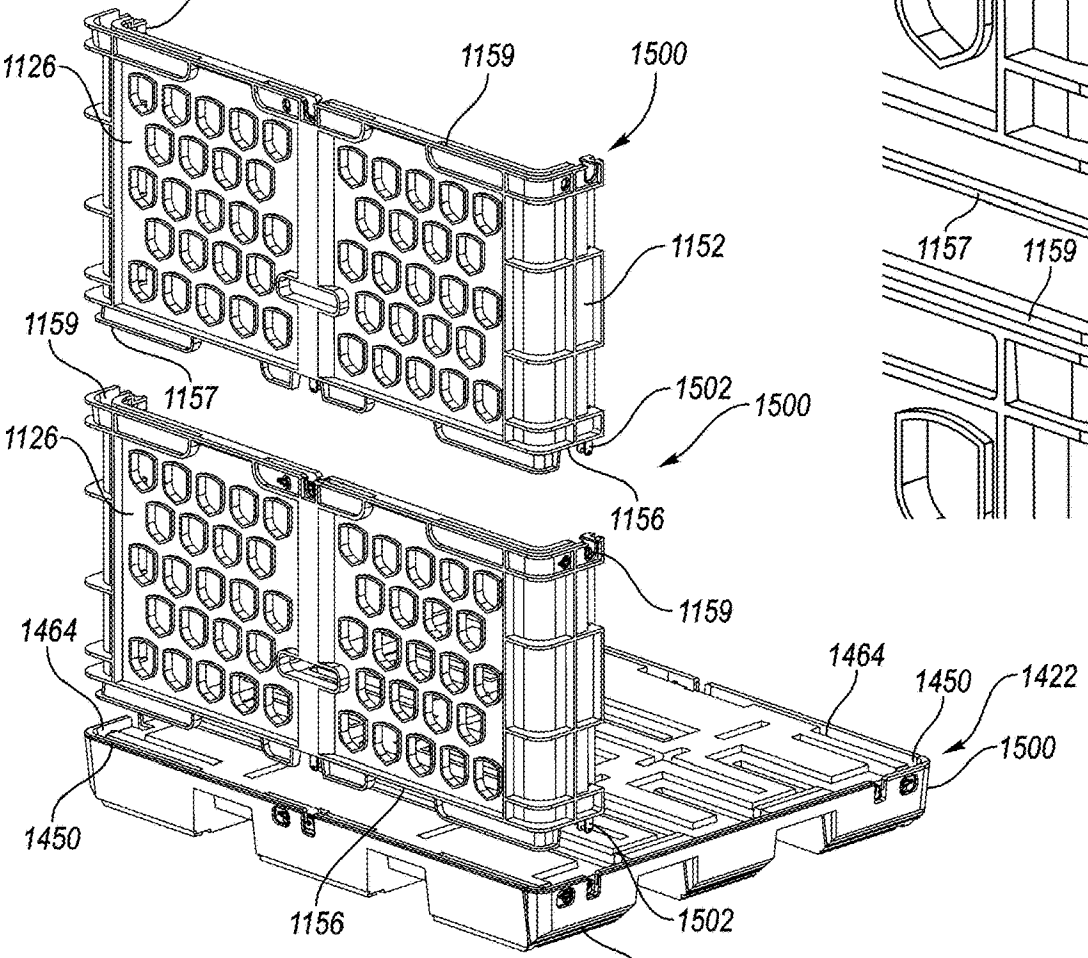
FIG. 82 shows a partially exploded view of a side wall and a pallet assembly.

FIGS. 82-84 illustrate an example latch mechanism 1500 for securing wall assemblies 1124 to either a pallet assembly 1422 or another wall assembly 1124. The wall assemblies 1124 are similar to the wall assemblies 924 and the pallet assembly 1422 is similar to the pallet assemblies 922, 1122, 1222 and 1322 except where described below or shown in the Figures. The latch mechanism 1500 could be used with any of the wall assemblies disclosed herein.

Side walls 1126 include projections 1157 along a lower edge 1156 that are accepted in either receptacles 1159 in an upper edge 1158 of the sidewalls 1126 or in receptacles 1464 formed along a perimeter 1450 of the pallet assembly 1422.

The sidewalls 1126 include multiple latch mechanisms 1500 recessed along the upper edge 1158 and the pallet assembly 1422 also includes multiple latch mechanisms 1500 recessed along the perimeter 1450. The latch mechanisms 1500 engage a corresponding latch pin 1502 adjacent the lower edge 1156 of the sidewall 1126. The latch mechanism 1500 includes a lever arm 1504 that pivots relative to a latch housing 1506 about pivot pin 1508. The latch mechanism 1500 further includes a catch member 1510 that engages the latch pin 1502 and pivots about pivot pin 1512.

Figure 85:
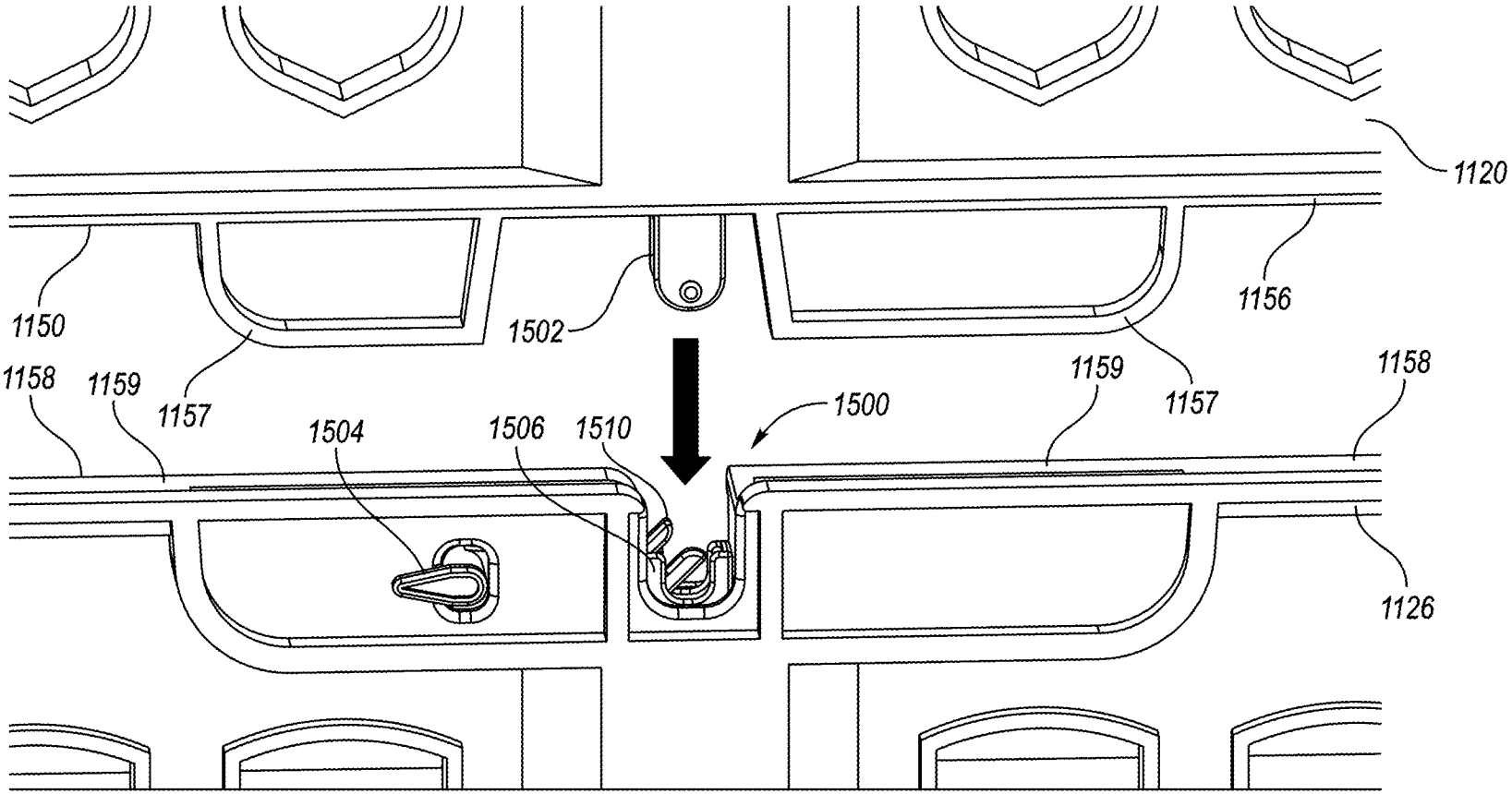
FIG. 85 is a partially exploded view showing the engagement of stacked wall assemblies and a latching mechanism.
Figure 87:
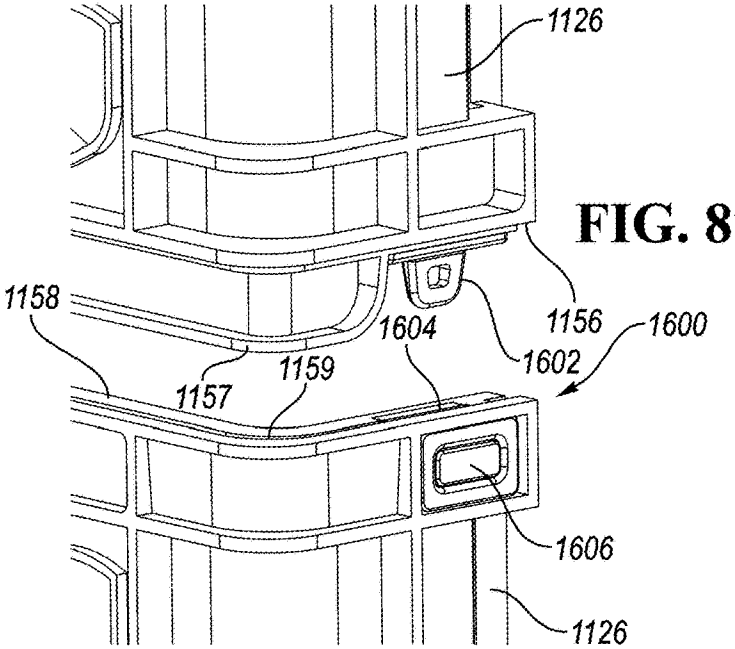
FIG. 87 is an enlarged view showing one wall assembly engaging a lower wall assembly.
Figure 88:
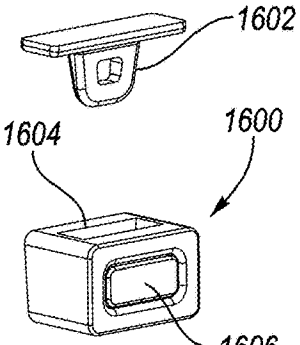
FIG. 88 shows a latch mechanism for securing the wall assemblies of FIG. 87.
Figure 86:
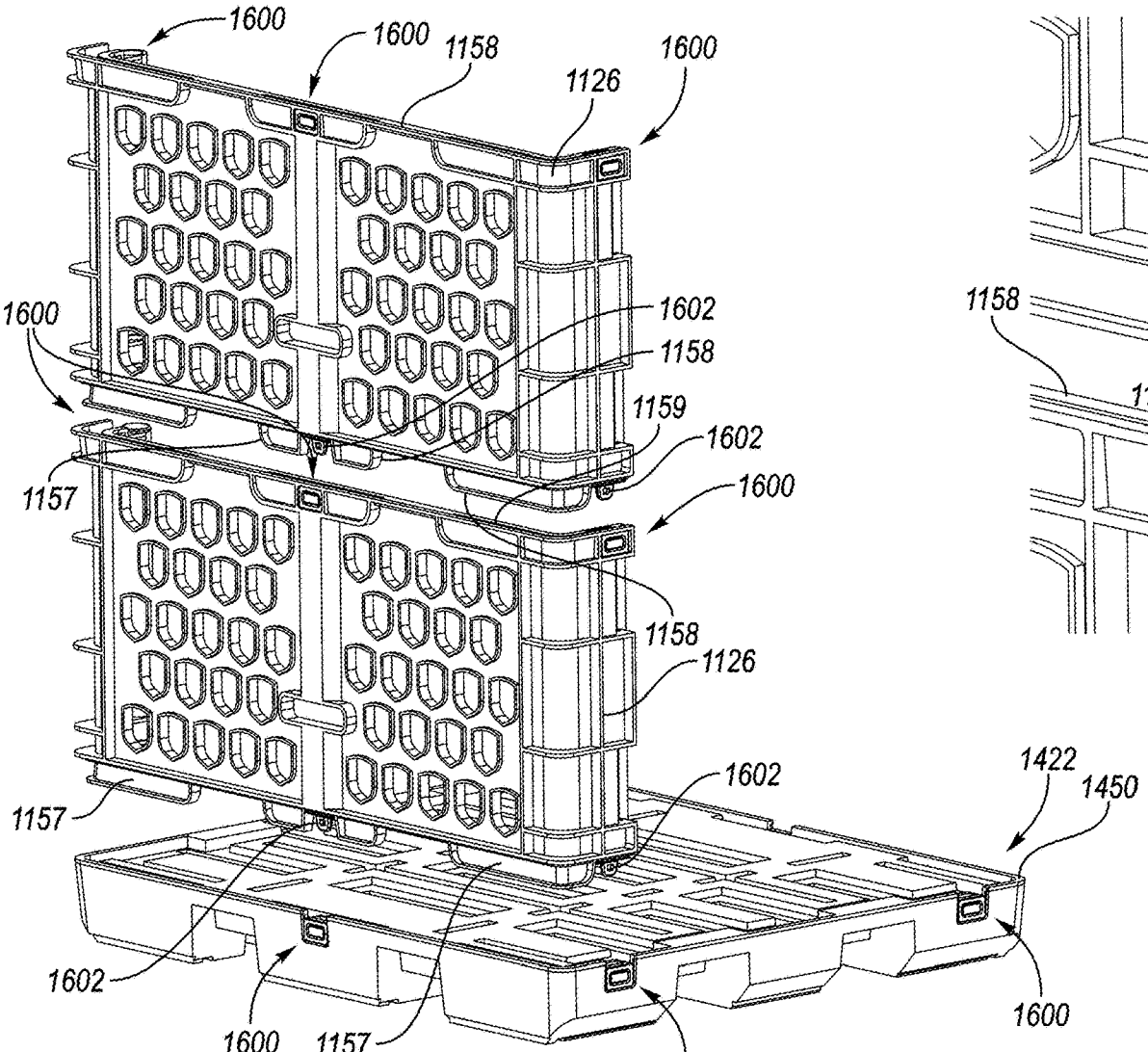
FIG. 86 is a partially exploded view of wall assemblies on a pallet assembly.

Once the latch pin 1502 is accepted within the catch member 1510, the latch pin 1502 and the latch mechanism 1500 are fixed relative to each other such that the sidewalls 1126 cannot be removed. The latch pin 1502 is released from the latch mechanism 1500 by pivoting the latch arm 1504 about the pivot point 1508 to rotate the catch member 1510 and release the latch pin 1502. The pallet assembly 1422 also includes the latch mechanism 1500 in order to secure the sidewalls 1126 relative to the pallet assembly 1422. As shown in FIG. 85, adjacent wall assemblies 1126 are latched together by moving the latch pin 1502 towards the latch mechanism 1500.

Figure 89:
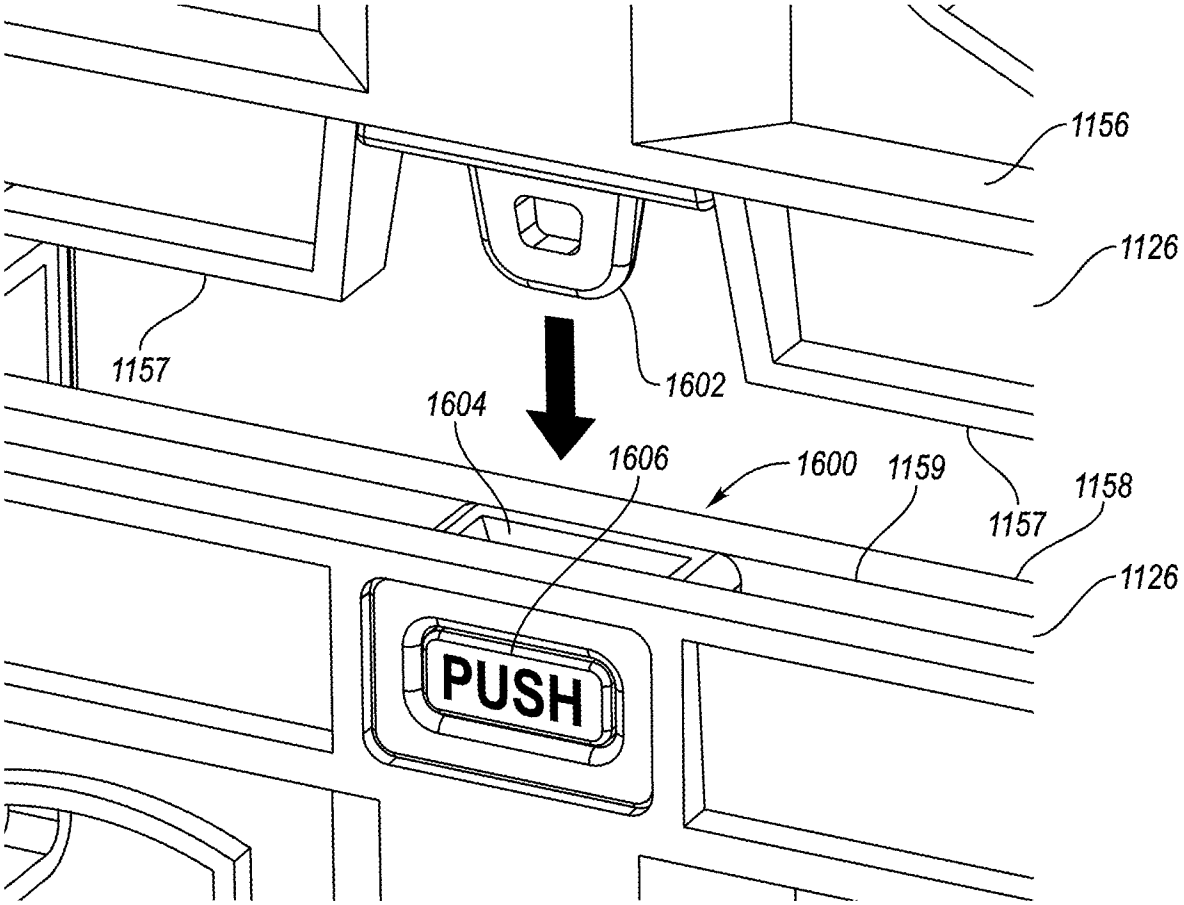
FIG. 89 shows the engagement of a pair of stacked wall assemblies and a latch.

FIGS. 86-89 illustrate the sidewalls 1126 secured relative to another sidewall 1126 or the pallet assembly 1422 with a latch mechanism 1600 located on the pallet assembly 1422 or the upper edge 1158 of the sidewalls 1126. A latch projection 1602 located on one of the sidewalls 1126 is received within the latch mechanism 1600 to secure one of the sidewalls 1126 to the pallet assembly 1422 or another one of the sidewalls 1126. The latch projection 1602 is accepted within a latch receptacle 1604 on the latch mechanism 1600. The latch mechanism 1600 also includes a release button 1606 that releases the latch projection 1602 from the latch mechanism 1600 when pressed. As shown in FIG. 89, the latch projection 1602 is moved toward the latch 1600 in order to secure adjacent sidewalls 1126 to each other.

Figure 91:
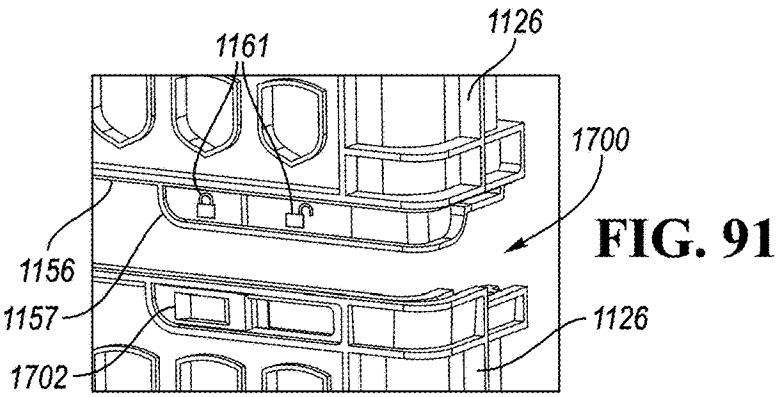
FIG. 91 shows an enlarged view of a portion of the wall assemblies of FIG. 90.
Figure 92:
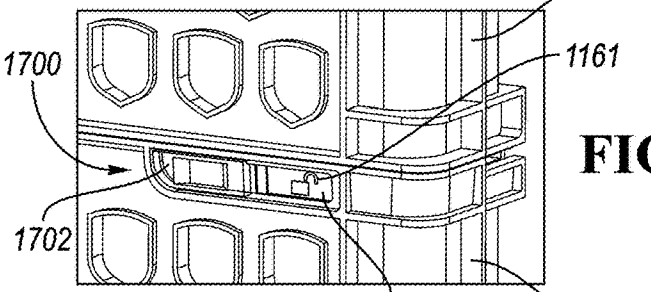
FIG. 92 shows the wall assemblies engaged with the latch in the unlatched position.
Figure 93:
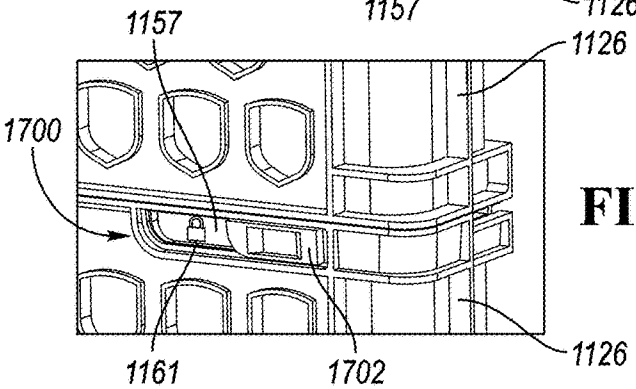
FIG. 93 shows the wall assemblies of FIG. 92 with the latch in the latched position.
Figure 90:
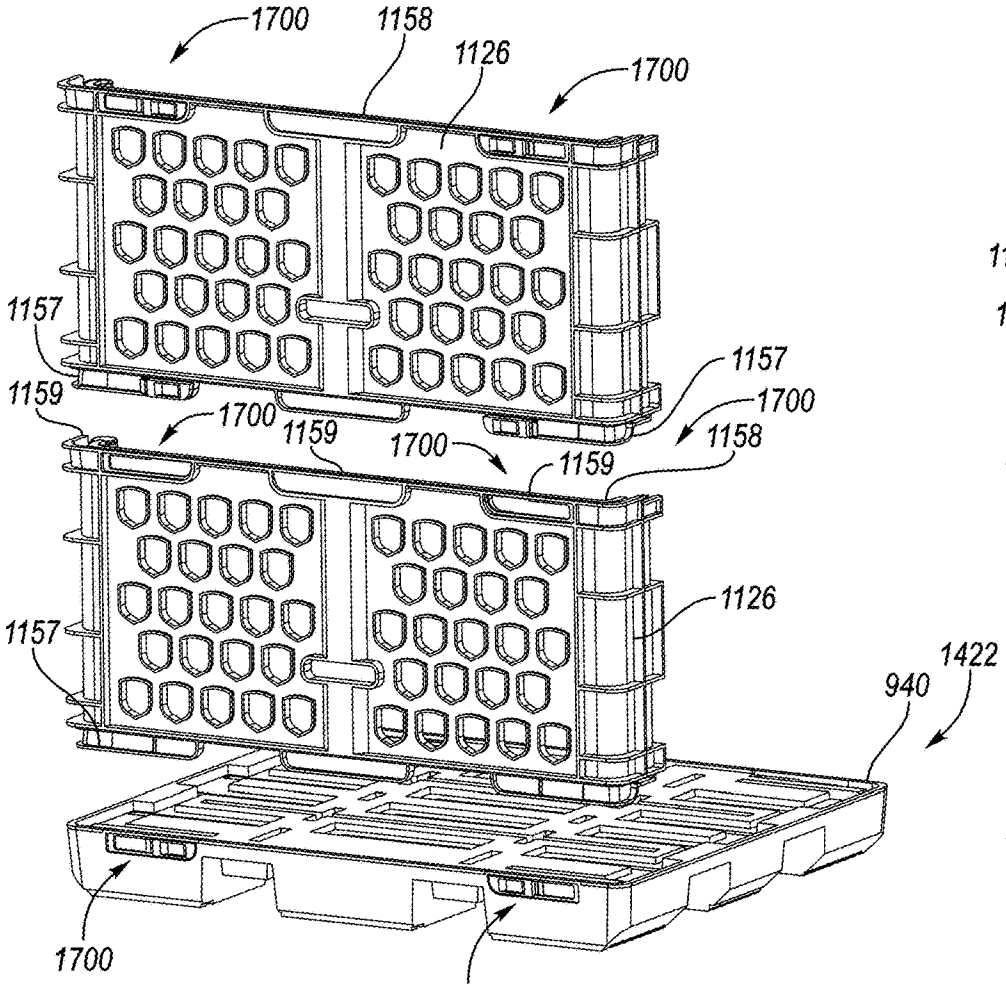
FIG. 90 is partially exploded view of a pair of stacked wall assemblies on a pallet assembly.
Figure 95:
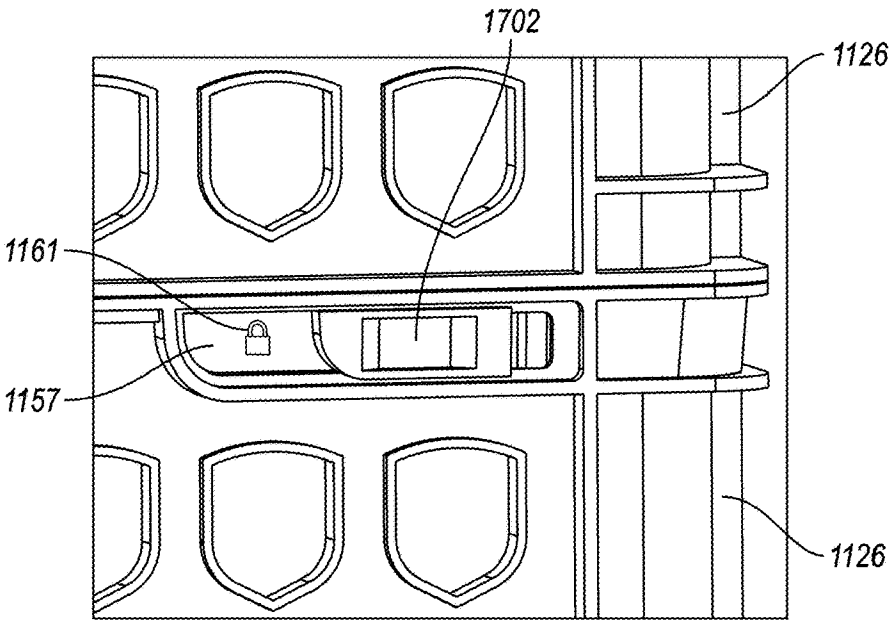
FIG. 95 shows the wall assemblies of FIG. 94 with the latch in the latched position.
Figure 94:
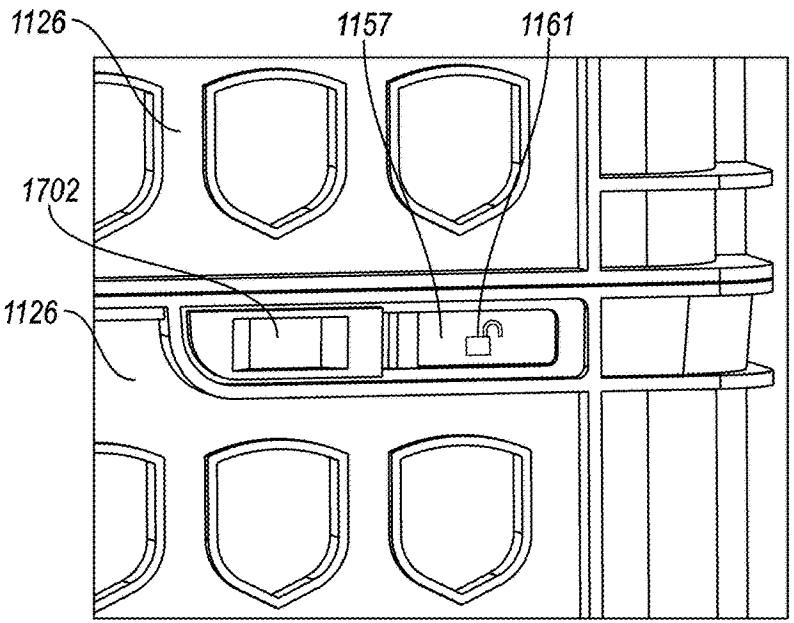
FIG. 94 is a side view of the wall assemblies with the latch in the unlatched position.

FIGS. 90-95 illustrate the sidewalls 1126 secured relative to another sidewall 1126 or the pallet assembly 1422 with a latch mechanism 1700 located on the pallet assembly 1422 or the upper edge 1158 of the sidewalls 1126. The latch mechanism 1700 includes a sliding lock 1702 that is moveable between an unlocked position as shown in FIGS. 91-92 and 94 and a locked position as shown in FIGS. 93 and 95. As the sliding lock 1702 moves between the unlocked position and the locked position, the sliding lock 1702 engages the projection 1157 along the lower edge 1156 of the sidewalls 1126. The projections 1157 also includes insignia 1161 that indicates if the latch mechanism 1700 is in a locked or unlocked position.

Figure 96:
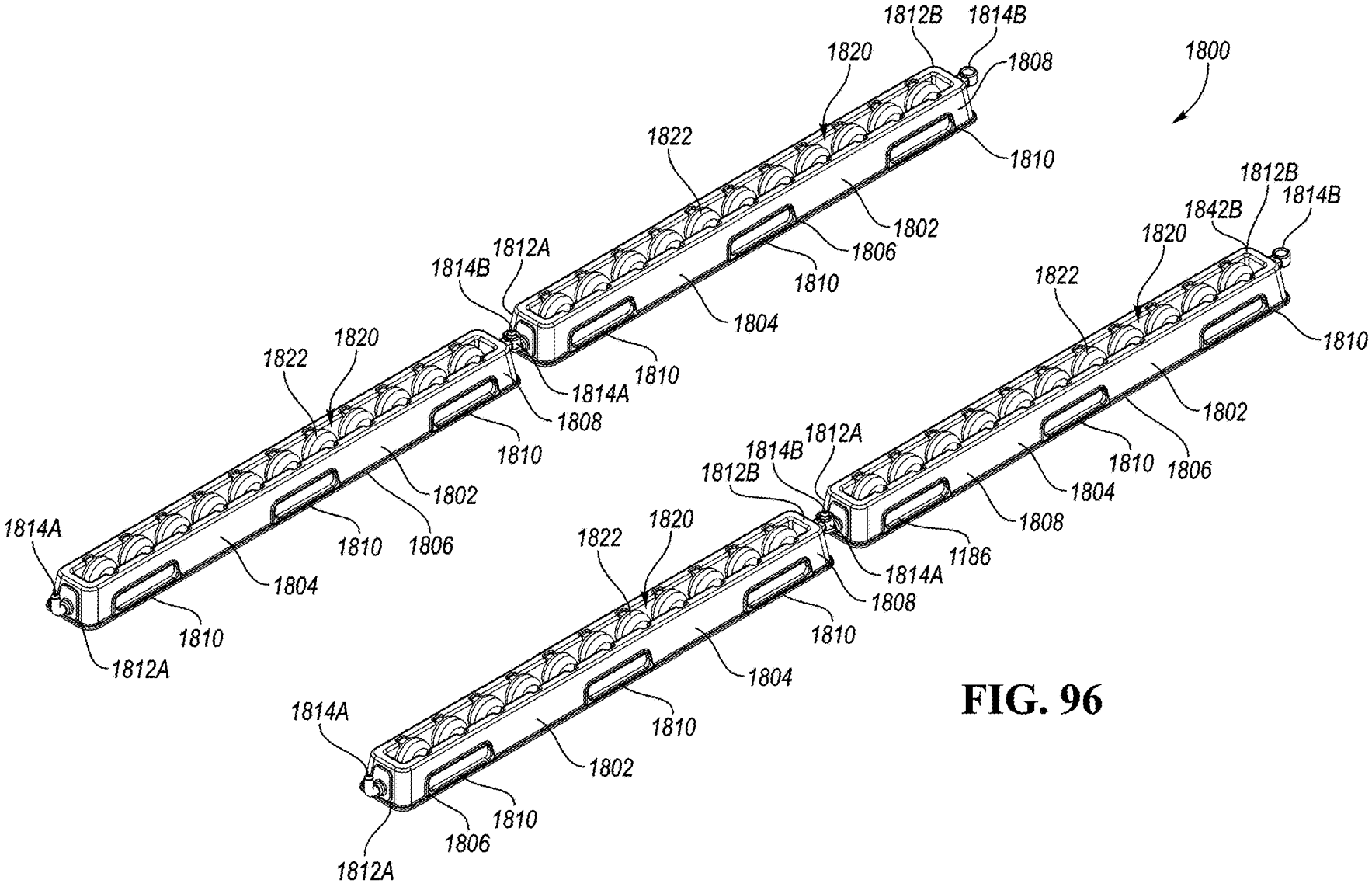
FIG. 96 is a perspective view of a portion of a rail system.
Figure 97:
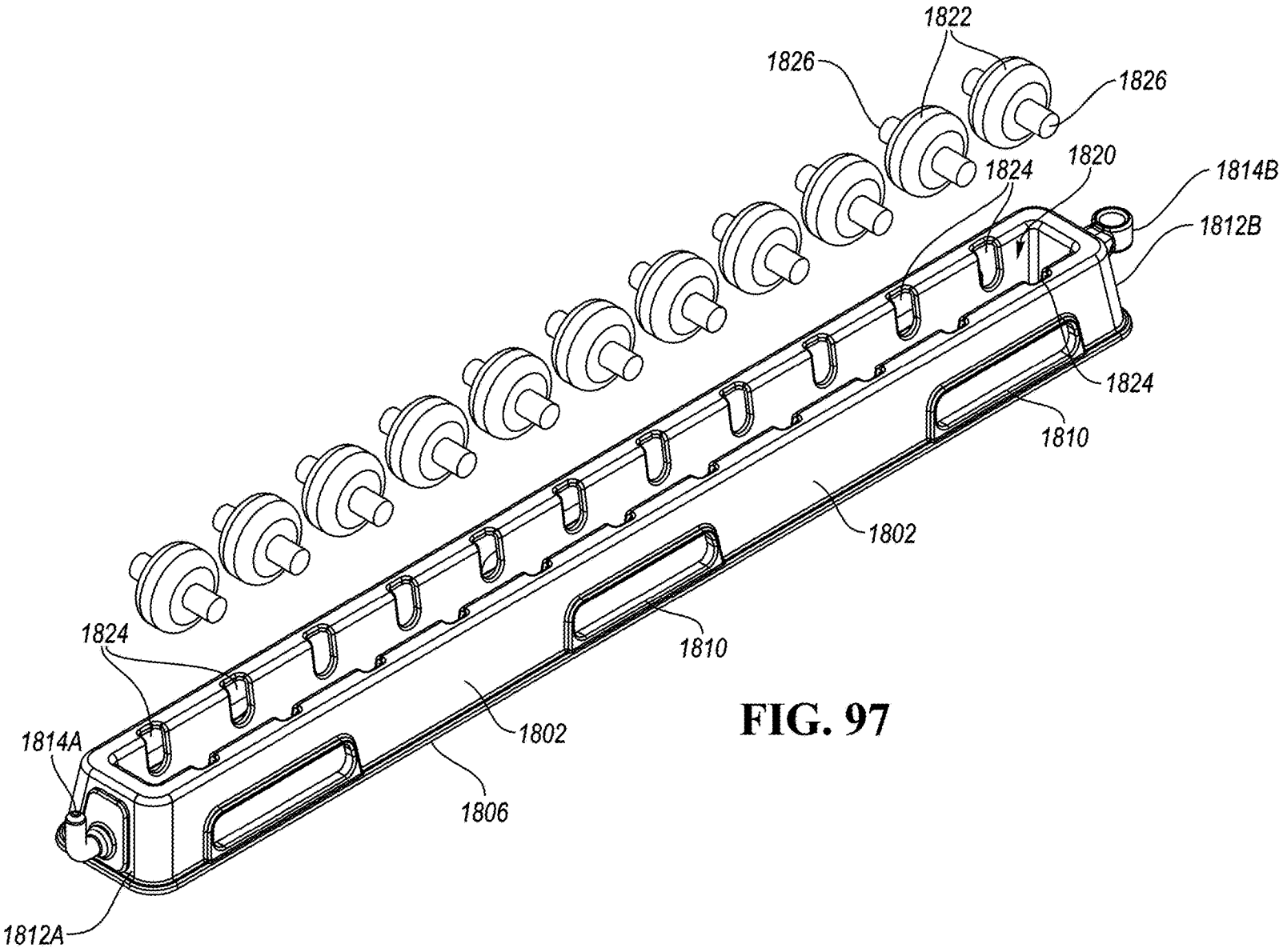
FIG. 97 is a perspective, exploded view of one of the rails of FIG. 96.
Figure 98:
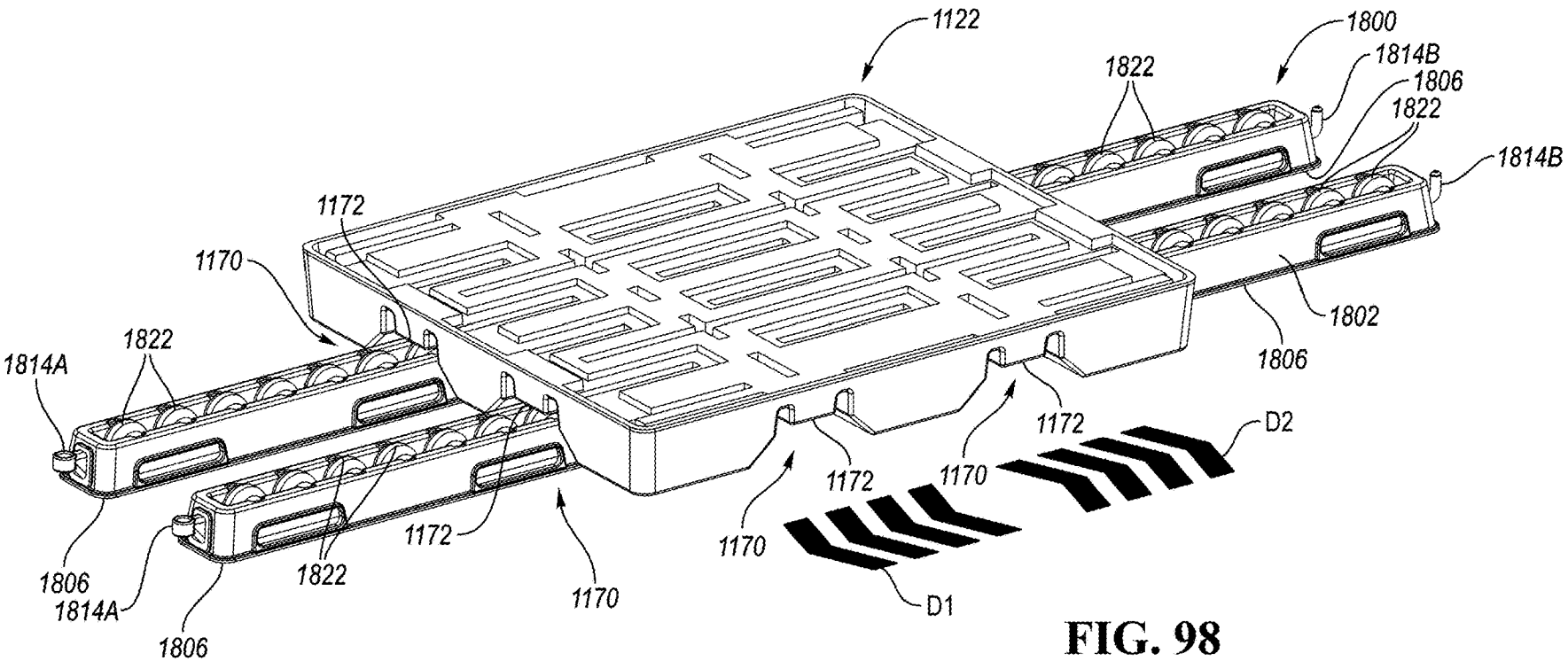
FIG. 98 shows a pallet assembly located on the rail system of FIG. 96.

FIGS. 96-98 illustrate an example rail system 1800. The rail system 1800 includes multiple rails 1802. In the illustrated example, there are only four rails 1802 shown, however, additional rails 1802 could be used depending on the application.

Each of the rails 1802 include a housing 1804 that includes a base surface 1806 for engaging a working surface, such as a floor or trailer bed. The housing 1804 also includes sidewalls 1808 having handle openings 1810, a first end wall 1812A having a female mating receptacle 1814A, and a second end wall 1812B having a male mating receptacle 1814B.

The rails 1802 include a recessed track 1820 in an upper surface of the housing 1804. The recessed track 1820 includes a plurality of axle openings 1824 located on opposite sides of the recessed track 1820 accepting axles 1826 on wheels 1822. The wheels 1822 include sealed bearings that support the axles 1826 and the axles 1826 are press fit into the axle openings 1824 in the rails 1802. The wheels 1822 project slightly from the uppermost surface of the housing 1804.

FIG. 98 illustrates the pallet assembly 1122 located on the rail system 1800.

Figure 99:
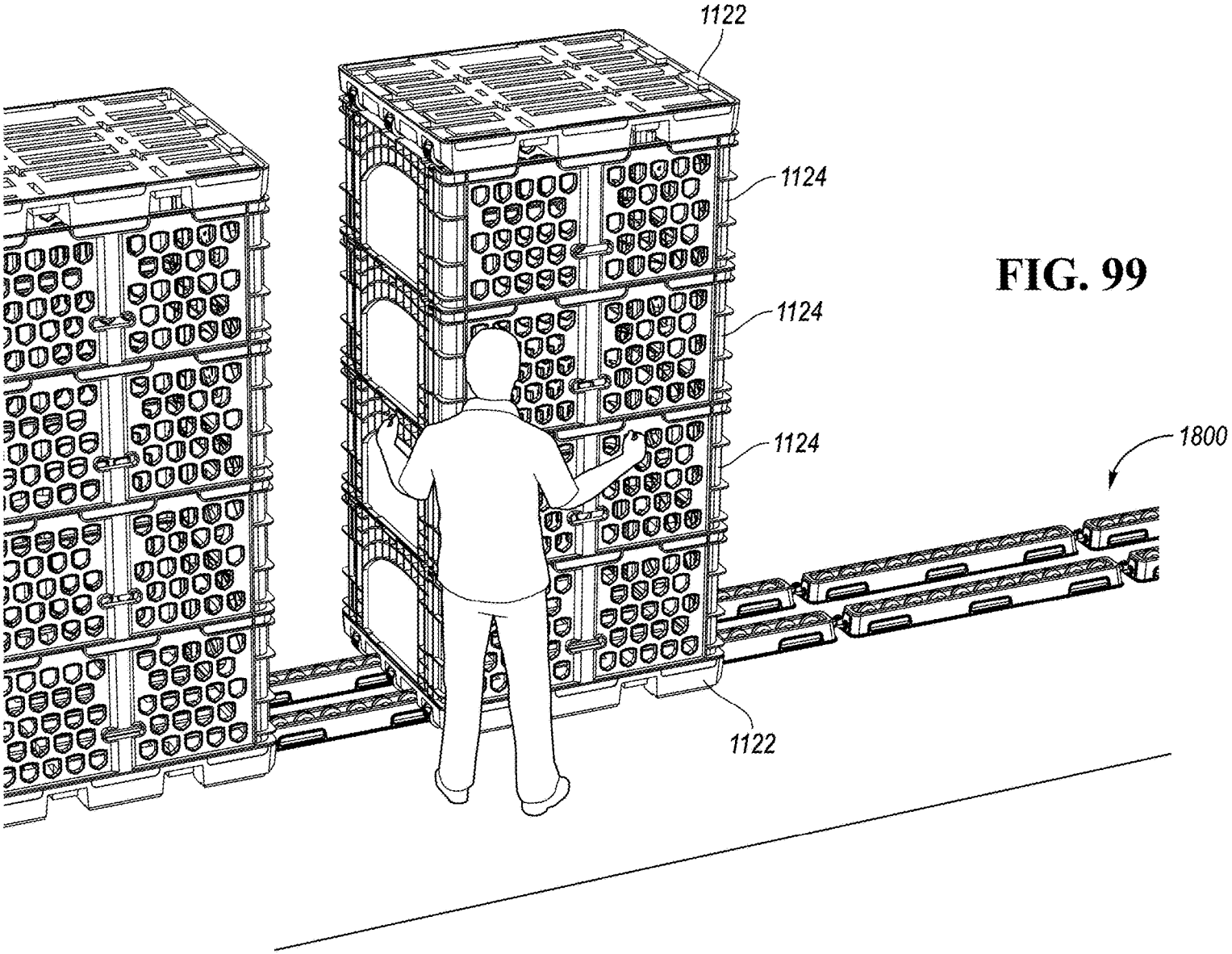
FIG. 99 shows a container on a pallet assembly on a rail system being moved by a user.

Although only the pallet assembly 1122 is shown on the rail system 1800, any of the other pallet assemblies disclosed above will function with the rail system 1800. The rails 1802 are accepted within the longitudinal troughs 1170 of the pallet assembly 1122. The upper surface 1172 of the longitudinal troughs 1170 travel along the wheels 1822 located in each of the individual rails 1802. This allows the pallet assembly 1122 and any goods stored thereon including wall assemblies to be easily transported by a single individual person along the rails 1802. See FIG. 99. As shown by arrows in FIG. 98, the pallet assembly 1122 with the wall assemblies 1124 movable in either direction D1, D2 along the rails 1802.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A container comprising:

a pallet base;

a plurality of walls pivotably connected to the base, the plurality of walls including a first wall, the first wall including a frame portion pivotably connected to the base, the frame portion including a lower portion pivotably connected to the base and an upstanding portion extending upward from each of a pair of opposite ends of the lower portion, the plurality of walls further including a pair of opposed walls, wherein the frame portion occupies less than approximately 25% of the width of an opening between the opposed walls;

a first door hingeably connected to the frame portion, wherein the first door includes a round opening through the first door, the round opening having a handle extending thereacross;

a hinge connecting a first end of the first door to one of the upstanding portions of the frame portion; and a latch selectively connecting a second end of the first door to the frame portion, wherein the first end is opposite the second end.

2. The container of claim 1 wherein the pallet base includes a plurality of columns creating tine openings below a deck.

3. The container of claim 1 wherein the pallet base includes opposed upstanding flanges, wherein the frame portion is hingeably connected to one of the opposed upstanding flanges.

4. The container of claim 1 wherein the hinge is a horizontal hinge parallel to the pallet base.

5. The container of claim 4 wherein the first door is divided into a plurality of sections, wherein the round opening through the door is one of a plurality of round center openings, each of the plurality of sections having one of the plurality of round center openings through the first door, each round center opening having a handle extending thereacross.

6. The container of claim 1 wherein one of the opposed walls includes an opening therethrough, the one opposed wall further including a second door selectively closing the opening through the one opposed wall, the second door hingeably connected at a bottom of the second door to the one opposed wall by a horizontal hinge, the container further including latches at an upper edge of the second door.

7. The container of claim 6 wherein the second door includes a round center opening through the second door, the round opening having a handle extending thereacross.

8. The container of claim 7 wherein the plurality of walls includes a second wall opposite the first wall, and wherein the one opposed wall includes a second frame portion defining the opening through the one opposed wall and wherein the second frame portion occupies less than approximately 25% of the width of an opening between the first wall and the second wall.

9. The container of claim 8 wherein the pallet base includes a plurality of columns creating tine openings below a deck.

10. The container of claim 9 wherein the pallet base includes a pair of opposed upstanding flanges, wherein the second frame portion is hingeably connected to one of the pair of opposed upstanding flanges.

11. A container comprising:

a pallet base including a plurality of columns creating tine openings below a deck, the pallet base including a pair of opposed upstanding flanges projecting upward from opposed edges of the deck;

a pair of opposed walls pivotably connected to the upstanding flanges;

a first wall, the first wall including a frame portion pivotably connected to the base, the frame portion including a lower portion pivotably connected to the base and an upstanding portion extending upward from each of a pair of opposite ends of the lower portion, the lower portion and upstanding portions defining an opening therebetween through the first wall, wherein the frame portion occupies less than approximately 25% of the width of an opening between the pair of opposed walls;

a first door selectively covering the opening in the first wall;

a hinge connecting one a first end of the first door to one of the upstanding portions; and a latch selectively connecting a second end of the first door the other of the upstanding portions, wherein the first end is opposite the second end.

12. The container of claim 11 wherein the frame portion occupies less than approximately 10% of the height of the opening between the pair of opposed walls.

13. The container of claim 11 wherein the first door is divided into a plurality of sections, each having a round center opening through the first door and each round opening having a handle extending thereacross.

14. The container of claim 11 wherein the frame portion occupies less than approximately 10% of the height of an opening between the pair of opposed walls.

15. A container comprising:

a pallet base including a plurality of columns creating tine openings below a deck, the pallet base including a pair of opposed upstanding flanges projecting upward from opposed edges of the deck;

a first wall, the first wall including a first frame portion pivotably connected to the base between the upstanding flanges, the first frame portion including a lower portion pivotably connected to the base and an upstanding portion extending upward from each of a pair of opposite ends of the lower portion, the lower portion and upstanding portions defining an opening therebetween through the first wall;

a first door selectively covering the opening in the first wall, a hinge connecting a first end of the first door to one of the upstanding portions, a first latch selectively connecting a second end of the first door to the other of the upstanding portions, wherein the first end is opposite the second end;

a second wall pivotably connected to one of the upstanding flanges, the second wall including a second opening therethrough;

a second door selectively positionable over the second opening, a hinge connecting a lower end of the second door to the second wall; and a second latch selectively connecting an upper end of the second door to the second wall.

16. The container of claim 15 wherein the first frame portion occupies less than approximately 10% of the height of an opening between the second wall and a third wall extending upward from the other of the upstanding flanges.

* * * * *